US012060192B2

(12) United States Patent
Olsen et al.

(10) Patent No.: US 12,060,192 B2
(45) Date of Patent: Aug. 13, 2024

(54) SYSTEMS AND METHODS FOR WRAPPING LOADS OF GOODS WITH TUBULAR STRETCH FILM

(71) Applicant: Signode Industrial Group LLC, Tampa, FL (US)

(72) Inventors: Flemming B. Olsen, Haderslev (DK); Carsten Fenn, Sonderborg (DK); Tonny Konstmann, Nordborg (DK); Peter Rybicki-Madsen, Broager (DK)

(73) Assignee: Signode Industrial Group LLC, Tampa, FL (US)

( * ) Notice: Subject to any disclaimer, the term of this patent is extended or adjusted under 35 U.S.C. 154(b) by 99 days.

(21) Appl. No.: 17/754,641

(22) PCT Filed: Oct. 22, 2020

(86) PCT No.: PCT/US2020/056777
§ 371 (c)(1),
(2) Date: Apr. 7, 2022

(87) PCT Pub. No.: WO2021/081158
PCT Pub. Date: Apr. 29, 2021

(65) Prior Publication Data

US 2023/0182939 A1 Jun. 15, 2023

(30) Foreign Application Priority Data

Oct. 23, 2019 (DE) ..... 10 2019 216 346.7

(51) Int. Cl.
*B65B 9/13* (2006.01)
*B65B 11/58* (2006.01)

(52) U.S. Cl.
CPC ..... *B65B 9/135* (2013.01); *B65B 11/585* (2013.01)

(58) Field of Classification Search
CPC ..... B65B 9/135; B65B 11/585; B65B 53/02; B65D 71/0088
See application file for complete search history.

(56) References Cited

U.S. PATENT DOCUMENTS 3,965,652 A * 6/1976 Cimins ..... B65B 9/135 53/567
4,712,354 A * 12/1987 Lancaster ..... B65B 11/58 53/399

(Continued)

FOREIGN PATENT DOCUMENTS

CN 101903251 A 12/2010
DE 2614558 A1 10/1977

(Continued)

OTHER PUBLICATIONS

"International Search Report and Written Opinion", from PCT/US2020/056777, Jan. 29, 2021.

(Continued)

*Primary Examiner* — Andrew M Tecco
*Assistant Examiner* — Nicholas E Igbokwe
(74) *Attorney, Agent, or Firm* — Neal, Gerber & Eisenberg LLP

(57) ABSTRACT

Various embodiments of the present disclosure provide systems including stretch-hood machines configured to vertically and horizontally apply tubular stretch film to loads of goods and to methods for wrapping loads of goods with multiple segments of tubular stretch film.

32 Claims, 47 Drawing Sheets

(56) References Cited

U.S. PATENT DOCUMENTS

| | | | | |
|---|---|---|---|---|
| 4,724,652 | A * | 2/1988 | Birkenfeld | B65B 53/02 53/442 |
| 4,724,658 | A * | 2/1988 | Birkenfeld | B65B 53/063 53/442 |
| 6,032,439 | A * | 3/2000 | Birkenfeld | B65B 9/135 53/567 |
| 6,470,654 | B1 * | 10/2002 | Lachenmeier | B65B 9/135 53/461 |
| 6,598,379 | B2 * | 7/2003 | Zitella | B65B 61/00 53/399 |
| 7,913,476 | B2 | 3/2011 | Lachenmeier | |
| 7,937,910 | B2 | 5/2011 | Jaconelli et al. | |
| 9,764,867 | B2 | 9/2017 | Lachenmeier et al. | |
| 10,011,383 | B2 | 7/2018 | Suolahti et al. | |
| 10,279,937 | B2 | 5/2019 | Frenzel et al. | |
| 10,526,097 | B2 | 1/2020 | Lachenmeier et al. | |
| 10,538,354 | B2 | 1/2020 | Hannen et al. | |
| 10,696,506 | B2 | 6/2020 | Hannen et al. | |
| 10,974,857 | B2 | 4/2021 | Hannen et al. | |
| 11,097,860 | B2 | 8/2021 | Lorenzen et al. | |
| 11,097,865 | B2 | 8/2021 | Fenn | |
| 2005/0284783 | A1 | 12/2005 | May | |
| 2006/0053750 | A1 * | 3/2006 | Petersen | B65B 9/135 53/567 |
| 2006/0059864 | A1 | 3/2006 | White et al. | |
| 2008/0229716 | A1 * | 9/2008 | Zitella | B65B 11/025 53/461 |
| 2014/0230380 | A1 | 8/2014 | Geerts et al. | |
| 2015/0307290 | A1 * | 10/2015 | Köhn | B65D 71/0088 206/598 |
| 2018/0105298 | A1 | 4/2018 | Frenzel | |
| 2019/0152632 | A1 * | 5/2019 | Lorenzen | B65B 9/135 |
| 2021/0188467 | A1 | 6/2021 | Bocedi et al. | |

FOREIGN PATENT DOCUMENTS

| | | | | |
|---|---|---|---|---|
| DE | 3941139 | A1 * | 6/1991 | B65B 11/585 |
| DE | 3941139 | A1 | 6/1991 | |
| DE | 4440217.1 | C1 | 5/1996 | |
| DE | 4440217 | C1 * | 5/1996 | B65B 11/585 |
| DE | 102009020454 | B3 | 10/2010 | |
| DE | 102011103366 | B3 | 9/2012 | |
| DE | 102015011766 | A1 | 3/2017 | |
| EP | 1574432 | A1 | 9/2005 | |
| EP | 2036818 | A1 | 3/2009 | |
| EP | 2248722 | A1 | 11/2010 | |
| EP | 3885110 | A1 | 9/2021 | |
| EP | 3924258 | A1 | 12/2021 | |
| ES | 2747425 | B2 | 10/2020 | |
| FR | 3069232 | A1 | 1/2019 | |
| KR | 102140430 | B1 | 8/2020 | |
| PL | 238867 | B1 | 10/2021 | |
| WO | 8203833 | A1 | 11/1982 | |
| WO | 2005042346 | A1 | 5/2005 | |
| WO | 2009068294 | A1 | 6/2009 | |
| WO | 2021058850 | A1 | 4/2021 | |

OTHER PUBLICATIONS

"First Chinese Office Action and Search Report", corresponding Chinese patent application No. 202080073606.1 with English machine translation, Feb. 11, 2023.

"Office Action and Examination Search Report", from corresponding German Patent Application No. 102019216346.7, Jul. 14, 2020.

"Office Action and Examination Search Report", from corresponding German Patent Application No. 10 2019 216 346.7, with English translation, Jan. 25, 2024.

* cited by examiner

SYSTEMS AND METHODS FOR WRAPPING LOADS OF GOODS WITH TUBULAR STRETCH FILM

PRIORITY CLAIM

This patent application is a national stage application of PCT/US2020/056777, filed on Oct. 22, 2020, which claims priority to and the benefit of German Patent Application No. 10 2019 216 346.7, which was filed on Oct. 23, 2019, the entire contents of which are incorporated herein by reference.

FIELD

The present disclosure is related to systems and methods for wrapping loads of goods with tubular stretch film, and particularly to systems including stretch-hood machines configured to vertically and horizontally apply tubular stretch film to loads of goods and to methods for wrapping loads of goods with multiple segments of tubular stretch film.

BACKGROUND

Certain known stretch-hood machines wrap loads of goods with tubular plastic stretch film. These stretch-hood machines include a frame that supports a film-supply assembly, a film-opening assembly, and a reefing-and-wrapping assembly. The reefing-and-wrapping assembly includes a wrapping carriage that supports four reefing devices. Each reefing device includes a support that supports a drive roller and a vertically extending reefing finger. A motor drives the drive roller, and the reefing finger supports a freely rotatable guide roller. The drive roller is movable toward and away from the guide roller.

To wrap a load of goods, the film-supply assembly draws the tubular film from a film roll, cuts the film to a desired length to form a segment of tubular film, and in certain instances heat seals the top of the segment of tubular film closed. The film-opening assembly opens the bottom portion of the segment of tubular film so its perimeter is generally rectangular. Each reefing device moves radially inwardly relative to the segment of tubular film) to respective insertion positions in which they form an insertion configuration. The wrapping carriage then ascends relative to the segment of tubular film until the reefing fingers of the reefing devices enter the open bottom portion of the segment of tubular film near its four corners. The reefing devices then move radially outwardly to respective reefing positions in which they form a reefing configuration in preparation for reefing the segment of tubular film onto the reefing fingers. The drive rollers of the reefing devices move toward their respective guide rollers to engage the outer surface of the segment of tubular film and force the inner surface of the segment of tubular film against the guide rollers, thereby sandwiching the tubular film between the rollers. The motors drive their respective drive rollers in a reefing rotational direction to reef (or gather) the segment of tubular film onto the reefing fingers.

After reefing, the reefing devices each move radially outwardly into respective wrapping positions in which they form a wrapping configuration. Because the film is elastic, it stretches during this movement. After the reefing devices reach the wrapping configuration, the wrapping carriage descends relative to the load. During this descent the motors drive the drive rollers of the reefing devices in an unreefing rotational direction (opposite the reefing rotational direction) at an unreefing speed to unreef the remainder of the film from the reefing fingers. As this occurs, the film attempts to return to its unstretched size and shape and radially contracts onto the load, which unitizes the load and/or secures the load to a pallet. This completes the wrapping process, and a conveyor conveys the load from the stretch-hood machine.

SUMMARY

Various embodiments of the present disclosure provide systems including stretch-hood machines configured to vertically and horizontally apply tubular stretch film to loads of goods and to methods for wrapping loads of goods with multiple segments of tubular stretch film.

Various methods of the present disclosure for wrapping a load with multiple segments of tubular stretch film comprise applying a first segment of tubular stretch film to the load and applying a second segment of tubular stretch film to the load, wherein the first and second segments of tubular stretch film together enclose the load on all sides. In certain embodiments, the first and second segments are horizontally applied to the load. In other embodiments one of the first and second segments is horizontally applied to the load while the other is vertically applied to the load.

Various wrapping systems of the present disclosure comprise a stretch-hood machine comprising a machine frame defining a wrapping area having an infeed area and an outfeed area; a wrapping carriage movable relative to the machine frame between upper and lower positions and rotatable relative to the machine frame between first and second rotational positions; one or more actuators operably connected to the wrapping carriage and configured to move the wrapping carriage between its upper and lower positions and its first and second rotational positions; and multiple reefing devices supported by the wrapping carriage.

Various methods of the present disclosure for wrapping a load with tubular stretch film comprise: with a wrapping carriage of a stretch-hood machine in a first rotational position relative to a machine frame of the stretch-hood machine, reefing a segment of tubular stretch film onto multiple reefing fingers supported by the wrapping carriage; after the segment of tubular film has been reefed onto the reefing fingers, rotating the wrapping carriage relative to the machine frame in a first rotational direction to a second rotational position that is transverse to the first rotational position; lowering the wrapping carriage; moving a load relative to the wrapping carriage in a first direction and into contact with the segment of tubular film; and while continuing to move the load relative to the wrapping carriage in the first direction, unreefing the segment of tubular film from the reefing devices and onto the load.

DETAILED DESCRIPTION

Figure 1:
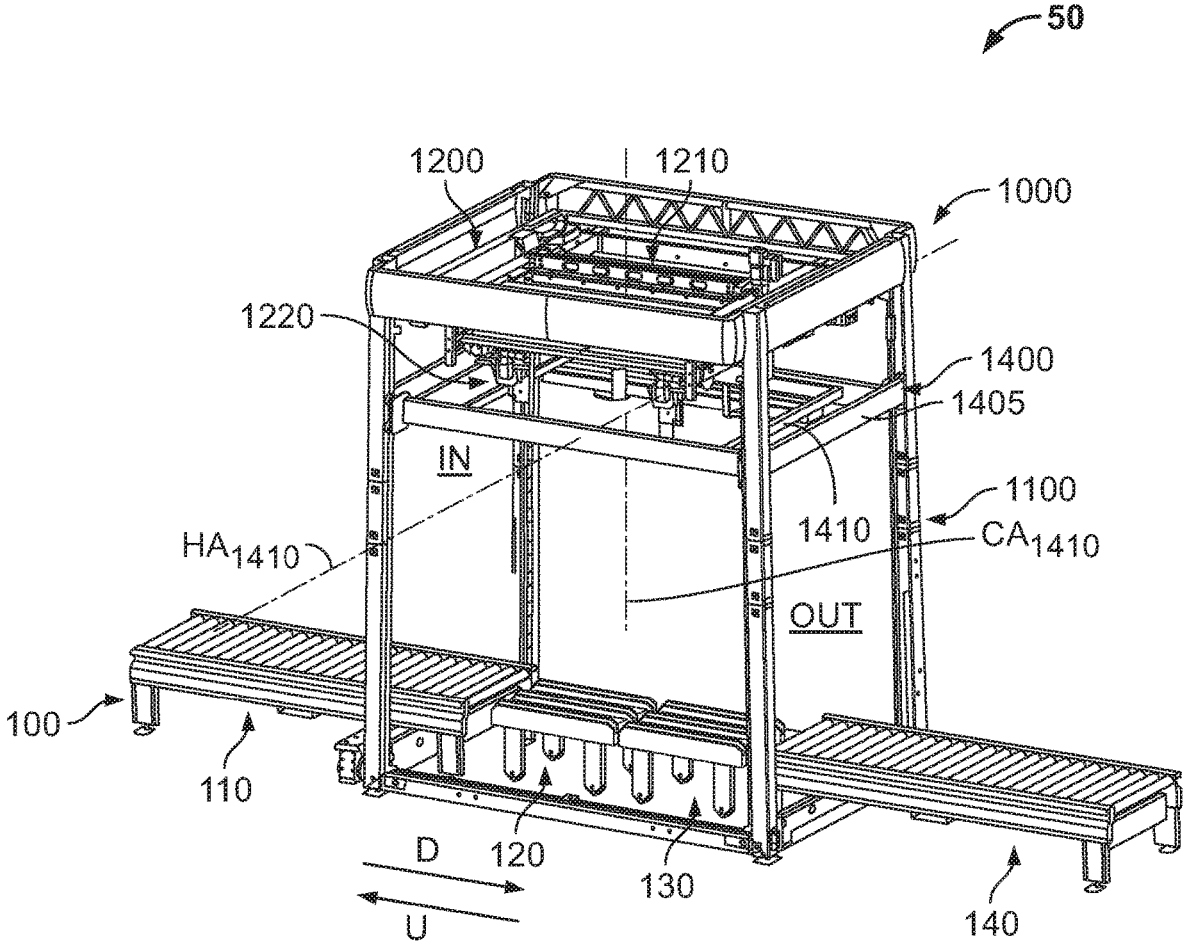
FIG. 1 is a perspective view of one example embodiment of the wrapping system of the present disclosure.

While the systems, devices, and processes described herein may be embodied in various forms, the drawings show and the specification describes certain exemplary and non-limiting embodiments. Not all the components shown in the drawings and described in the specification may be required, and certain implementations may include additional, different, or fewer components. Variations in the arrangement and type of the components; the shapes, sizes, and materials of the components; and the manners of connection of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting processes, such as coupled, mounted, connected, etc., are not intended to be limited to direct mounting processes, but should be interpreted broadly to include indirect and operably coupled, mounted, connected, and like mounting processes. This specification is intended to be taken as a whole and interpreted in accordance with the principles of the present disclosure and as understood by one of ordinary skill in the art.

FIGS. 1-3C show one example embodiment of the wrapping system 50 of the present disclosure and the assemblies and components of the wrapping system 50. The wrapping system 50 is configured to wrap a load of goods by vertically and/or horizontally applying one or more segments of tubular stretch film F to the load. The wrapping system 50 includes a conveying system 100, a controller 500, and a stretch-hood machine 1000.

The stretch-hood machine 1000 is configured to form one or more segment(s) of tubular stretch film and to apply the segment(s) of tubular stretch film to the load during a vertical or a horizontal wrapping process. As best shown in FIG. 1, the stretch-hood machine 1000 includes a machine frame 1100, a film-supply assembly 1200 supported by the machine frame 1100, and a reefing-and-wrapping assembly 1400 supported by the machine frame 1100.

The machine frame 1100 is formed from multiple tubular and/or solid members and other elements (not individually labeled) and is configured to support the other assemblies and components of the stretch-hood machine 1000. The machine frame 1100 defines a wrapping area (not labeled) within its interior and has an infeed area IN at which the load L (sometimes referred to as a stack of goods) is conveyed into the wrapping area for wrapping and an outfeed area OUT at which the load L is conveyed from the wrapping area after wrapping. The illustrated machine frame 1100 is merely one example configuration, and any suitable configuration may be employed.

The film-supply assembly 1200 includes suitable components configured to form a segment of tubular stretch film F that the wrapping system 50 then applies to the load to wrap the load. More specifically (and as is known in the art), the film-supply assembly 1200 includes: (1) components suitable to draw a length of tubular stretch film from a roll (not shown) of tubular stretch film rotatably mounted to or adjacent the machine frame 1100; (2) a cutting-and-sealing assembly 1210 to cut the length of tubular stretch film from the roll and to close its upper end (to form a seam), thereby forming the segment of tubular stretch film; and (3) a film-opening assembly 1220 to open a bottom portion of the segment of tubular stretch film F so it forms a generally rectangular perimeter in preparation for reefing by the reefing-and-wrapping assembly 1400.

In this example embodiment, although not labeled or shown in detail for clarity, the cutting-and-sealing assembly 1210 includes a cutting component (such as a knife) and heat-sealing components (such as a pair of opposing heat-sealing bars movable toward and away from one another) configured to cut the tubular stretch film from the roll R and to heat-seal the upper end of the segment of tubular stretch film F to close it. This is merely one example embodiment of the cutting-and-sealing assembly 1210, and any other suitable cutting-and-sealing assembly may be employed.

In this example embodiment, although not labeled or shown in detail for clarity, the film-opening assembly 1220 includes four suction boxes and four corresponding holding devices that are movable radially inward and outward relative to the longitudinal direction of the segment of tubular stretch film (and the vertical direction from the perspective shown in the Figures). To open the bottom portion of the segment of tubular stretch film, the suction boxes move radially inward so they are positioned adjacent the outer surface of the bottom portion of the segment of tubular stretch film. A vacuum is generated to draw the bottom portion of the segment of tubular stretch film onto the suction boxes, thereby partially opening the bottom portion. The holding devices then clamp the segment of tubular stretch film, and the suction boxes and holding devices move radially outward to open the bottom portion of the segment of tubular stretch film in preparation for reefing. At this point, the perimeter of the bottom portion of the segment of tubular stretch film forms a generally rectangular shape in preparation for reefing. This is merely one example embodiment of the film-opening assembly 1220, and any other suitable film-opening assembly may be employed.

The reefing-and-wrapping assembly 1400 is configured to gather and stretch the segment of tubular stretch film F in preparation for applying the segment of tubular stretch film to the load, and includes a wrapping-carriage mount 1405, a wrapping-carriage-mount actuator 1405*a*; a wrapping carriage 1410; a wrapping-carriage actuator 1410*b*; first, second, third, and fourth reefing devices 1420, 1430, 1440, and 1450; and one or more reefing device actuators 1460 (referred to in the plural below for clarity).

The wrapping-carriage mount 1405, which includes a frame or any other suitable components, such as two opposing horizontal beams as shown in the Figures, is supported by and vertically movable relative to the machine frame 1100 between upper and lower positions. The wrapping-carriage-mount actuator 1405*a*, which may include any suitable actuator (such as an electric or a hydraulic motor), is operably connected to the wrapping-carriage mount 1405 (such as via gearing, straps, chains, and/or any other suitable components) to move the wrapping-carriage mount 1405 between its upper and lower positions.

Figure 6A:
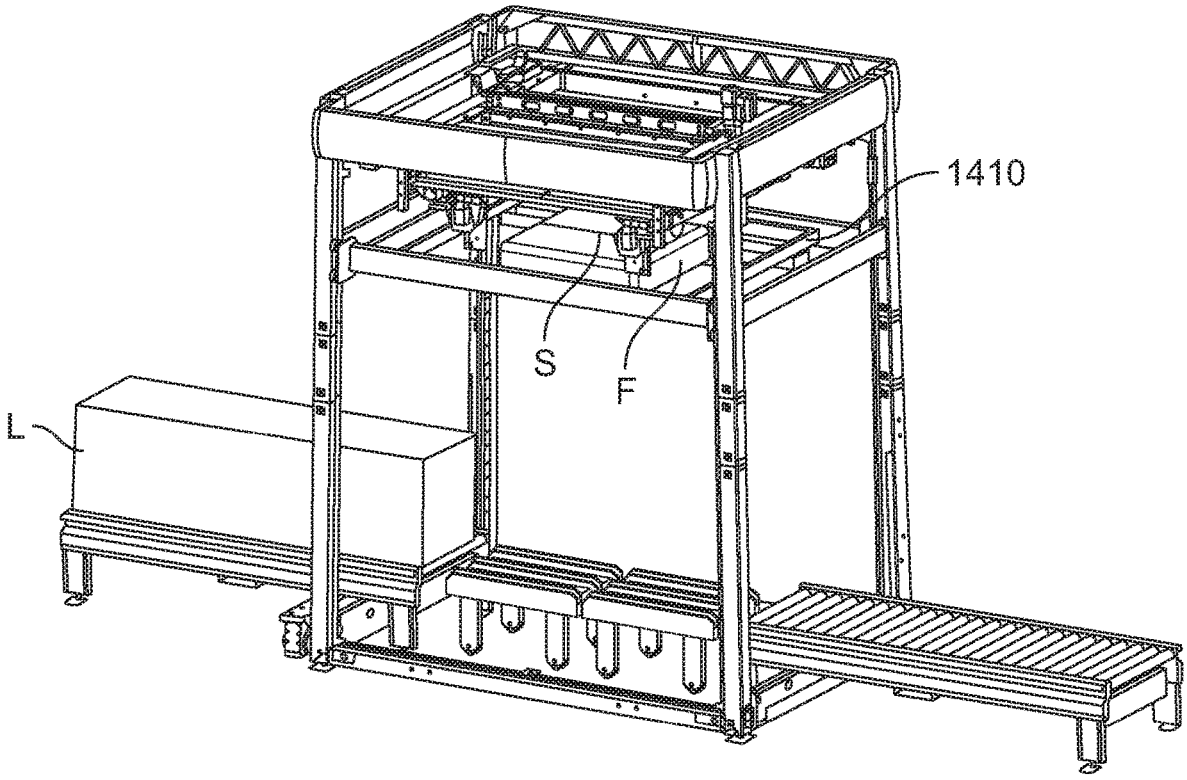
FIGS. 6A-6L are perspective views of the wrapping system during application of a segment of tubular film to a load.
Figure 6D:
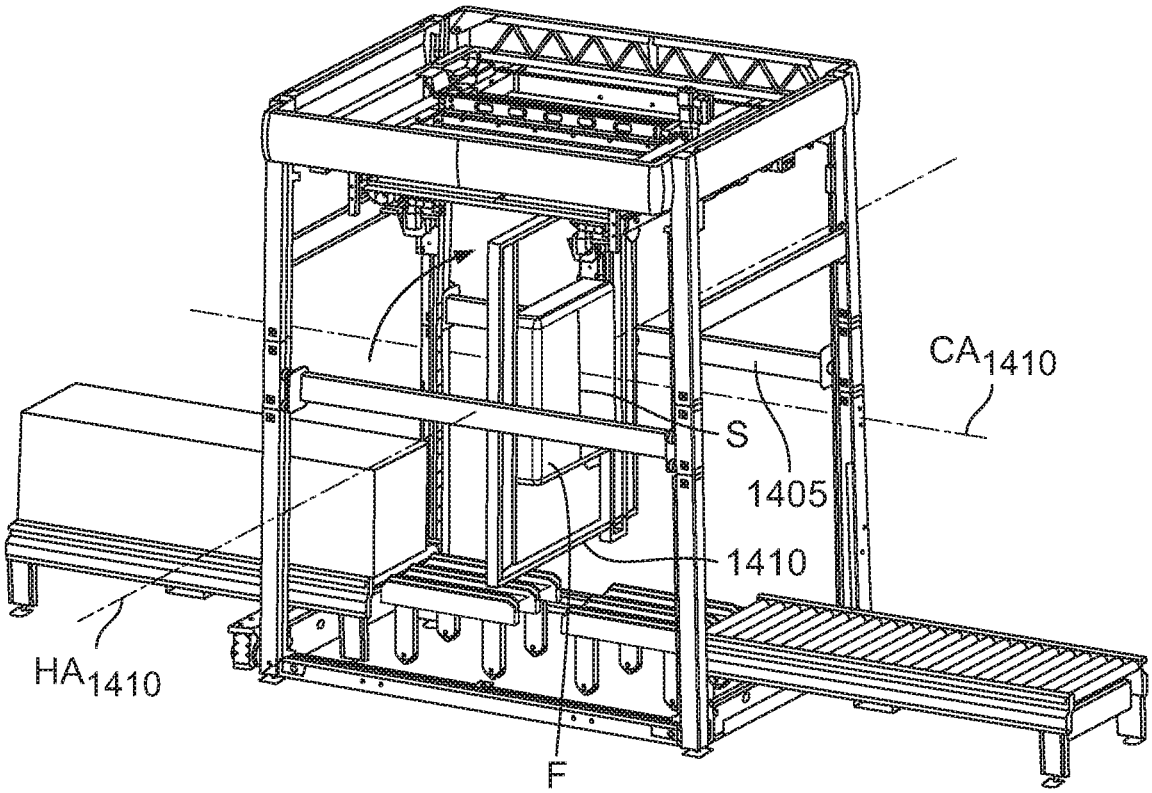
Figure 7A:
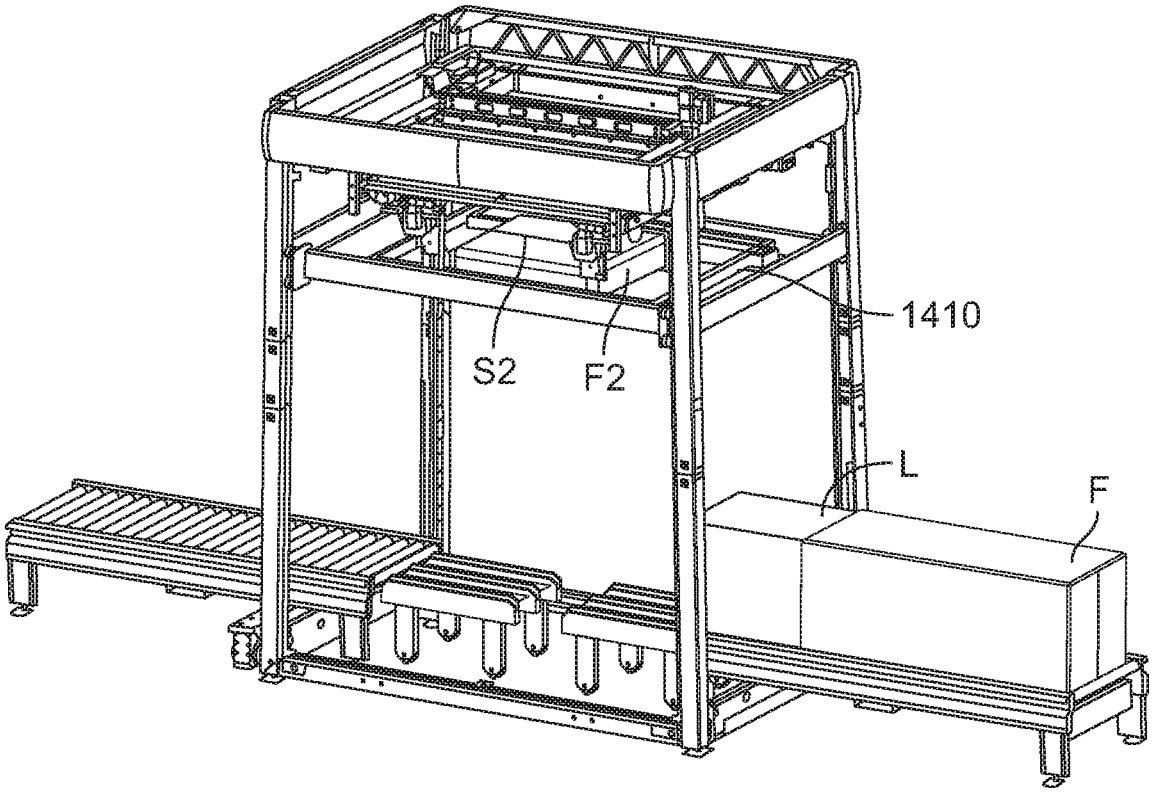
FIGS. 7A-7H are perspective views of the wrapping system during application of a second segment of tubular film to the load of FIGS. 6A-6L.
Figure 7B:
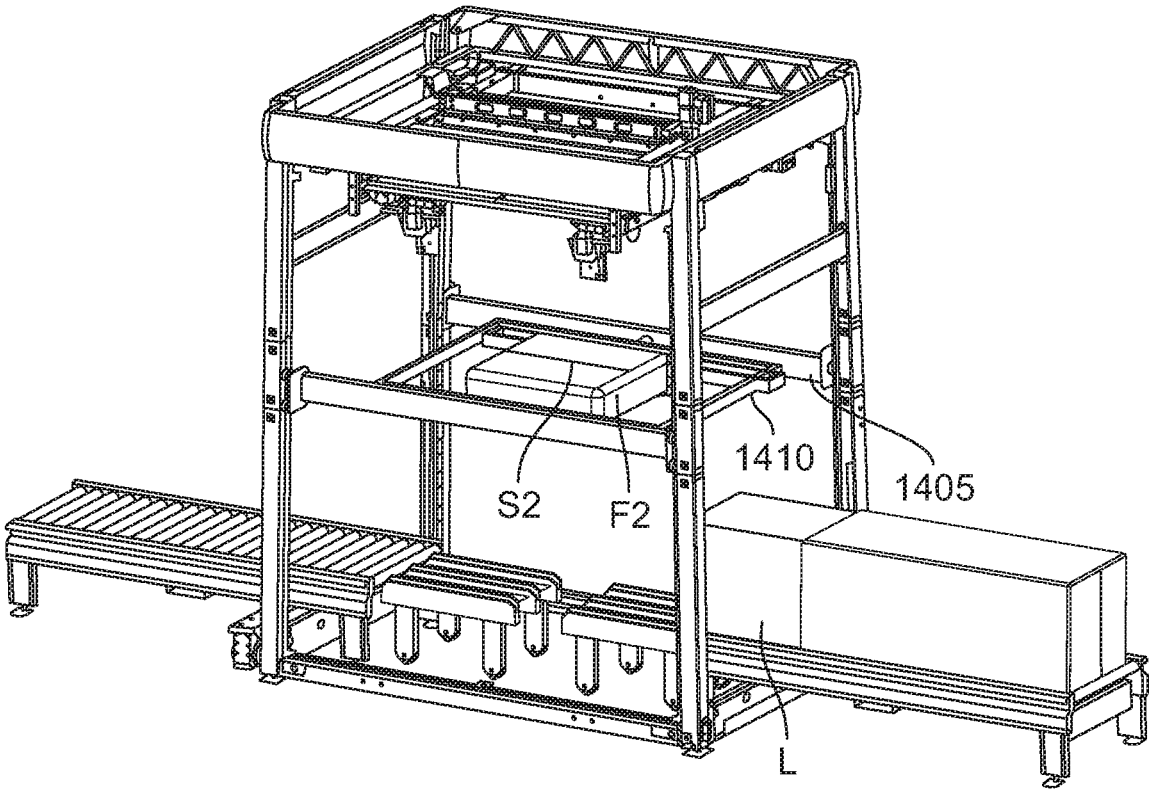
Figure 7C:
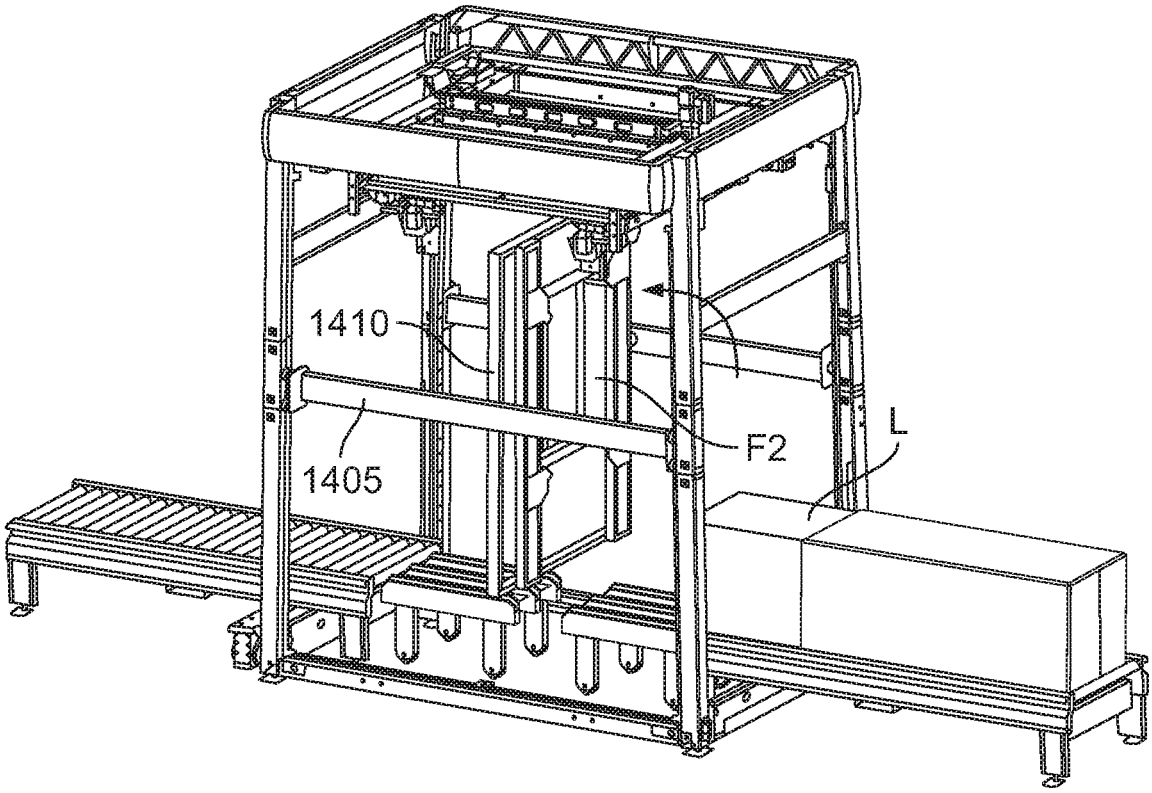

The wrapping carriage 1410 (sometimes referred to as a "stretch frame"), which includes a suitable frame or any other suitable components and has a central axis $CA_{1410}$, is mounted to the wrapping-carriage mount 1405 to move vertically therewith. That is, the wrapping carriage 1410 is vertically movable with the wrapping-carriage mount 1405 and relative to the machine frame 1100 between upper and lower positions as the wrapping-carriage frame 1405 moves between its upper and lower positions. The wrapping-carriage-mount actuator 1405*a* is therefore operably connected to the wrapping carriage 1410 (via the wrapping carriage mount 1405) to move the wrapping carriage 1410 between its upper and lower positions. The wrapping carriage 1410 is rotatable relative to the wrapping-carriage mount 1405 and the machine frame 1100 about a horizontal axis $HA_{1410}$ (FIG. 1) between: (1) a first rotational position in which the wrapping carriage is oriented horizontally and its axis $CA_{1410}$ is oriented vertically (FIG. 1); (2) a second rotational position in which the wrapping carriage is oriented vertically and its central axis $CA_{1410}$ is oriented horizontally (FIG. 6D); and (3) a third rotational position opposite the second rotational position in which the wrapping carriage is oriented vertically and its central axis $CA_{1410}$ is oriented horizontally (FIG. 7C). In this example embodiment and from the perspective shown in FIG. 1, the wrapping carriage 1410 rotates 90 degrees clockwise to move from its first rotational position to its second rotational position and rotates 90 degrees counter-clockwise to move from its first rotational position to its third rotational position. The wrapping-carriage actuator 1410*b*, which may include any suitable actuator (such as an electric or a hydraulic motor), is operably connected to the wrapping carriage 1410 to move (rotate) the wrapping carriage 1410 among its first, second, and third rotational positions.

In this example embodiment the wrapping carriage 1410 includes two opposing shafts (that together define the horizontal axis $HA_{1410}$) that are mounted to the wrapping-carriage mount 1405 and about which the wrapping carriage 1410 rotates, though any suitable mounting mechanism(s) may be employed in other embodiments. In certain embodiments, the stretch-hood machine includes one or more locking devices having locked and unlocked configurations. When the locking devices are in their locked configurations, they prevent the wrapping carriage from rotating, and when the locking devices are in their unlocked configurations, they do not prevent the wrapping carriage from rotating. The controller 500 (described below) is operably connected to the locking devices to switch them between their locked and unlocked configurations.

Figure 3A:
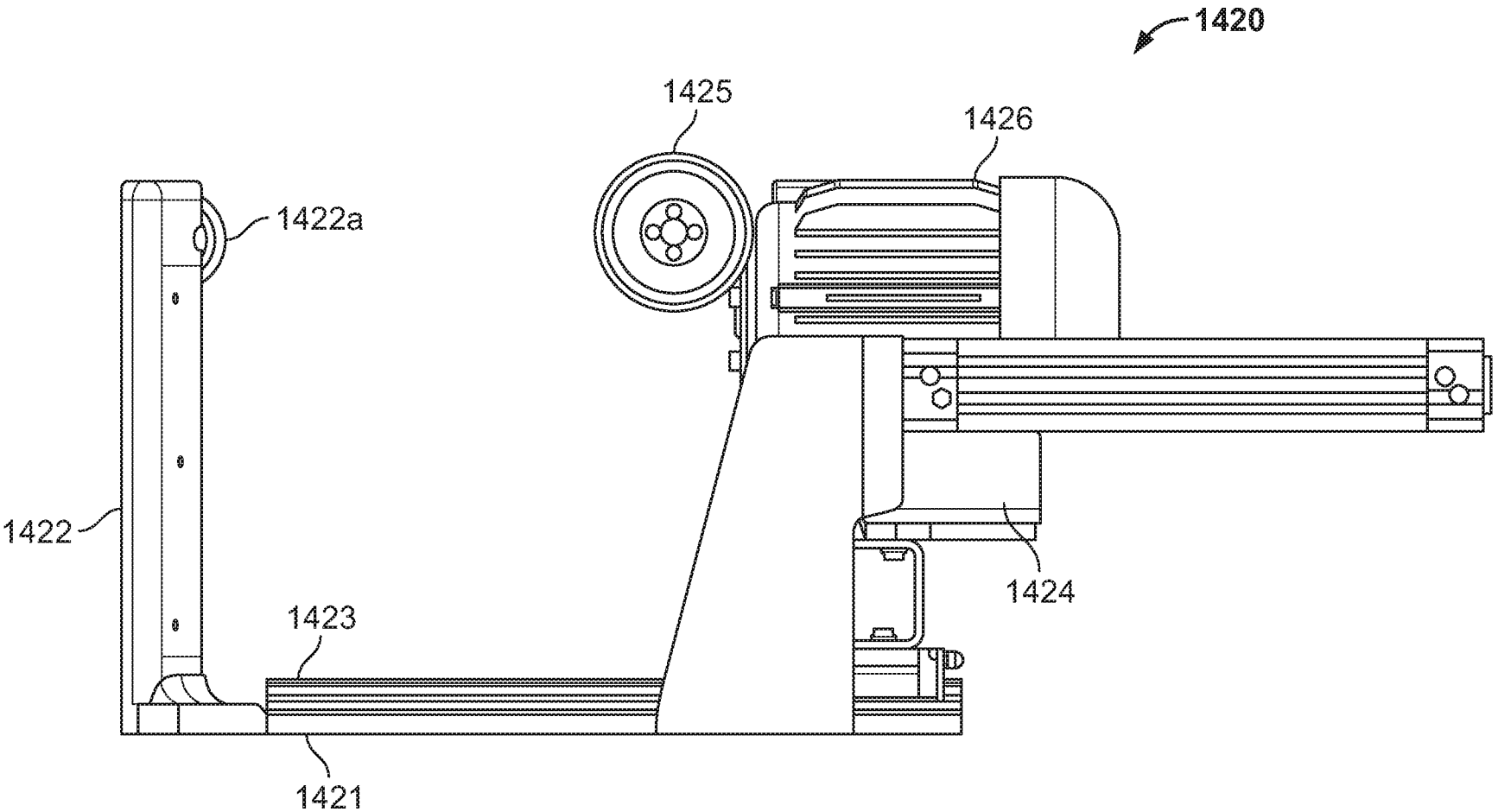
FIG. 3A is a side view of one of the reefing devices of the stretch-hood machine of the wrapping system of FIG. 1 with the reefing carriage in its home position.
Figure 3B:
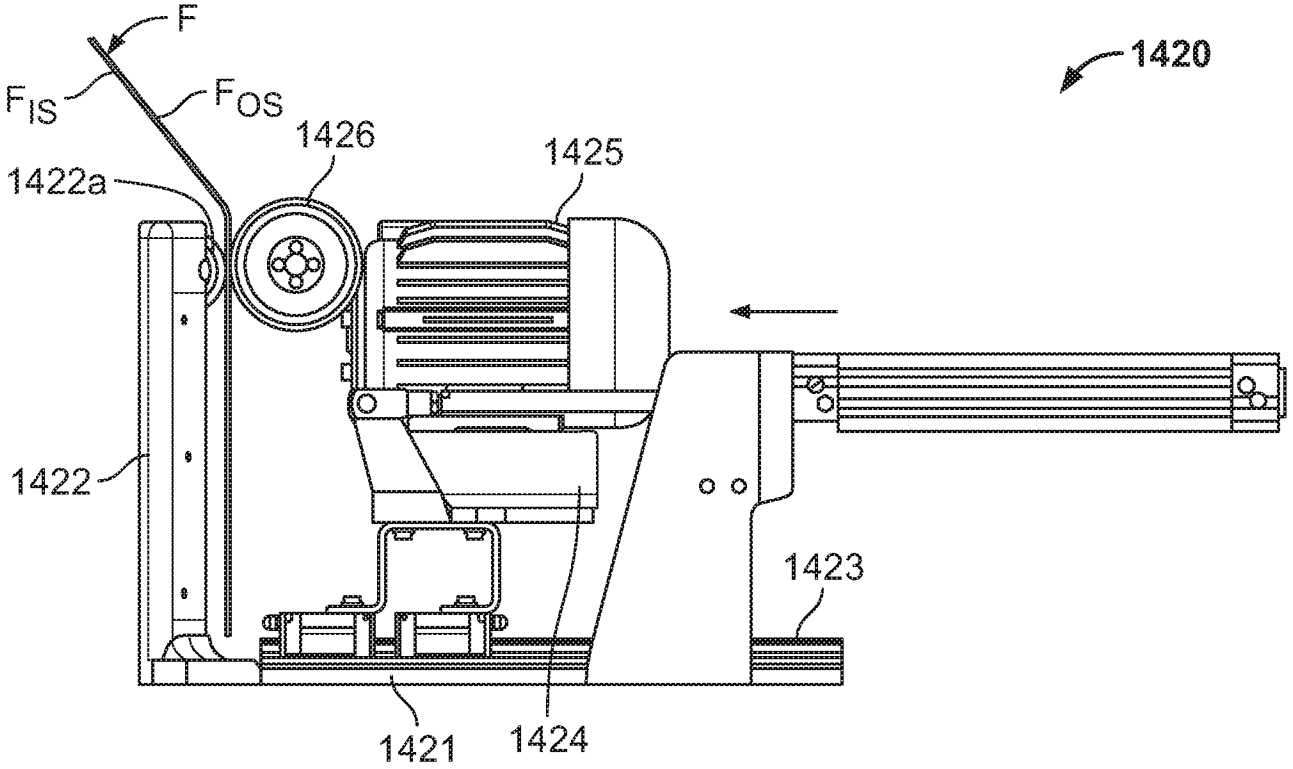
FIG. 3B is a side view of the reefing device of FIG. 3A after its reefing finger has been inserted into the bottom of the segment of tubular film and after its reefing carriage has moved to its reefing positions.
Figure 3C:
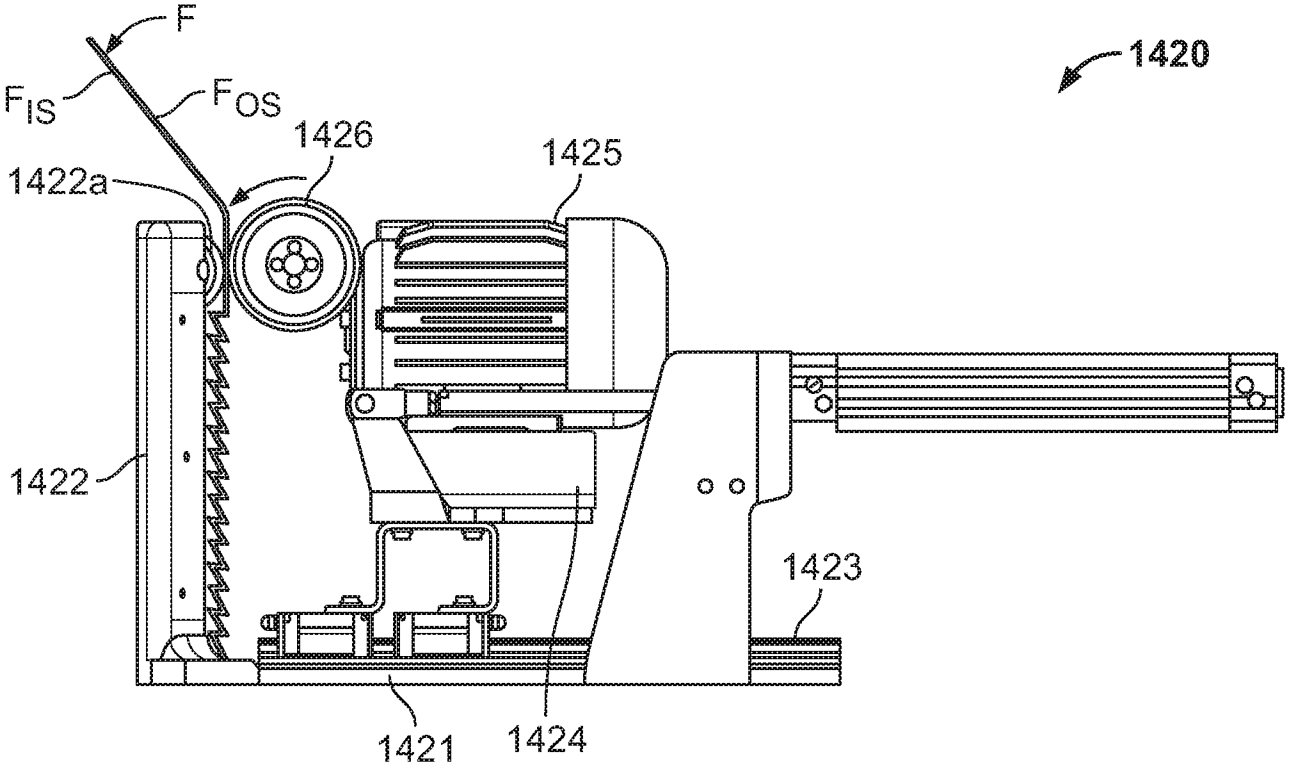
FIG. 3C is a side view of the reefing device of FIG. 3A after the reefing device has reefed the segment of tubular film onto its reefing finger.

FIGS. 3A-3C show the first reefing device 1420, which includes a first support 1421, a first reefing finger 1422 (sometimes referred to as a stretch finger) extending vertically from one end of the first support 1421, a freely rotatable first guide roller 1422*a* mounted to the first reefing finger 1422, a first rail 1423 supported by the first support 1421, a first carriage 1424 mounted to the first rail 1423 and configured to move along the first rail 1423 between a home position spaced-apart from the first guide roller 1422*a* (FIG. 3A) and a reefing position adjacent the first guide roller 1422*a* (FIGS. 3B and 3C), a first drive roller 1425 supported by the first carriage 1424, a first roller actuator 1426 supported by the first carriage 1424 and operably connected to the first drive roller 1425 to rotate the first drive roller 1425 in opposing reefing and unreefing rotational directions, and a first carriage actuator 1427 operably connected to the carriage 1424 to move the carriage 1424 between its home and reefing positions. The second, third, and fourth reefing devices 1430, 1440, and 1450 are similar to the first reefing device 1420 and not shown separately, though their components are provided similar element numbers for clarity.

Figure 4A:
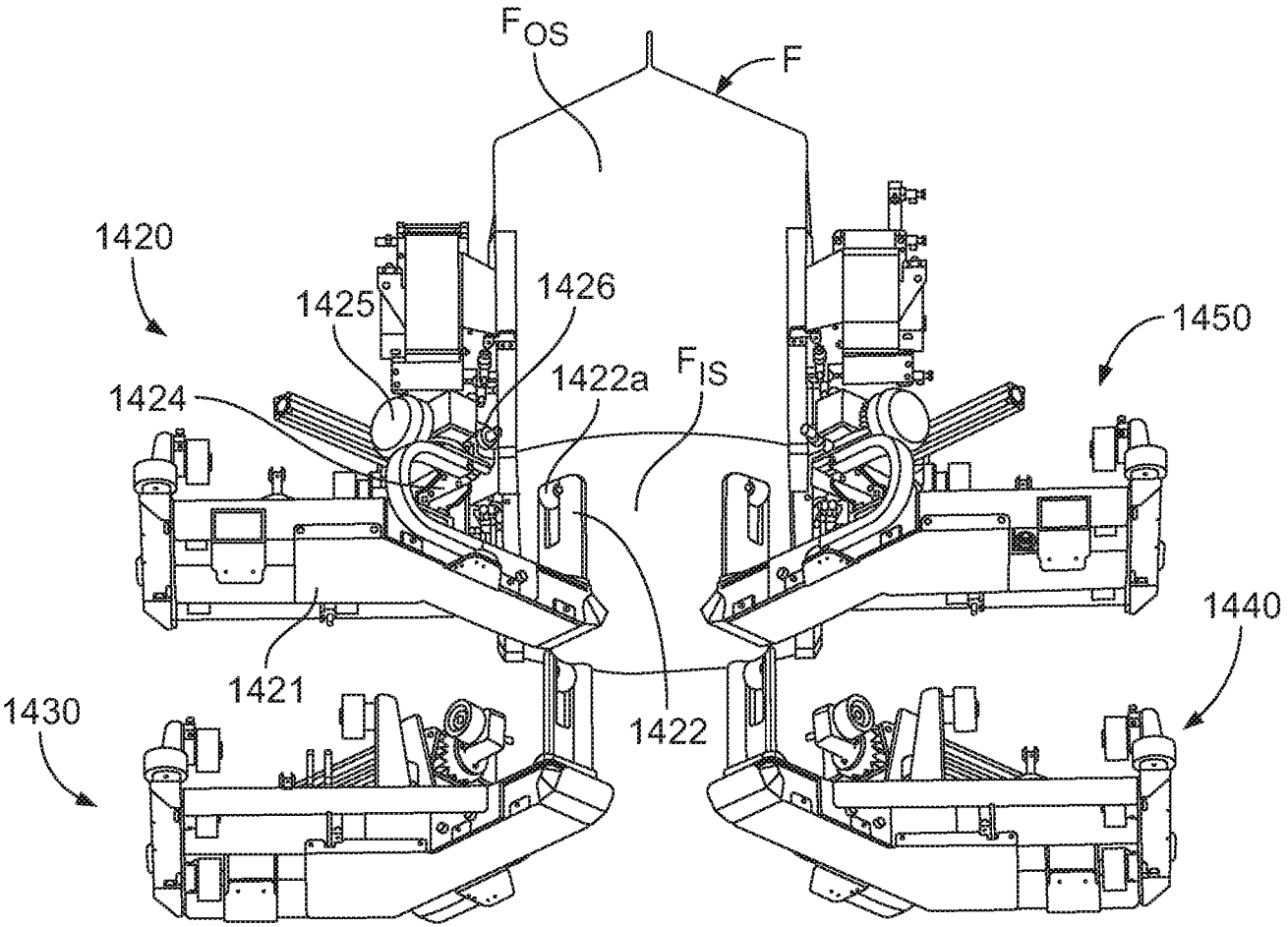
FIG. 4A is a perspective view of the film-opening assembly and the reefing devices of the stretch-hood machine of the wrapping system of FIG. 1 after the film-opening assembly has opened the bottom of a segment of tubular film and before the reefing fingers of the reefing devices have been inserted into the bottom of the segment of tubular film.
Figure 4B:
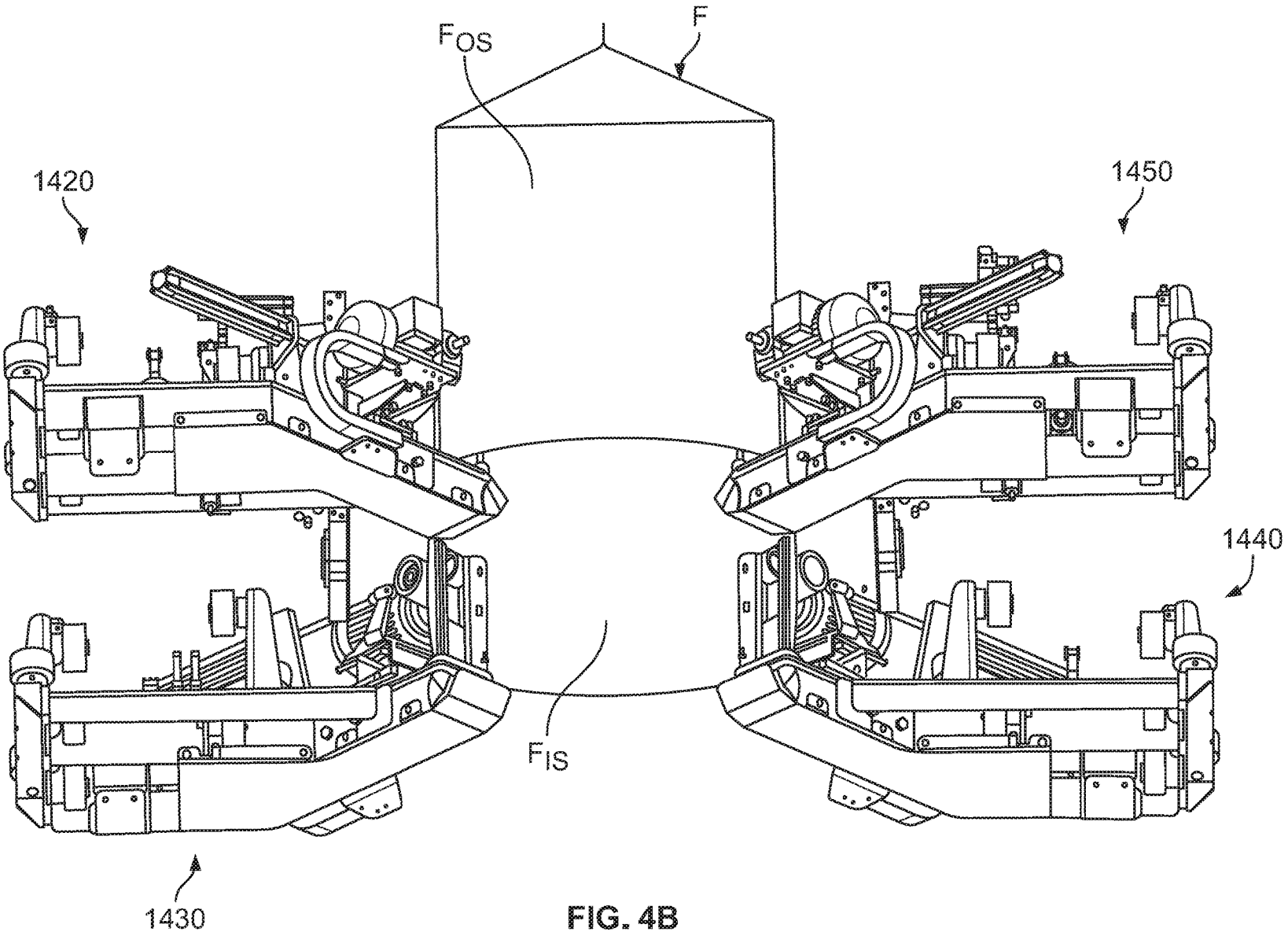
FIG. 4B is a perspective view similar to FIG. 4A but after the reefing fingers of the reefing devices have been inserted into the bottom of the segment of tubular film and after the reefing carriages of the reefing devices have moved to their respective reefing positions.
Figure 4C:
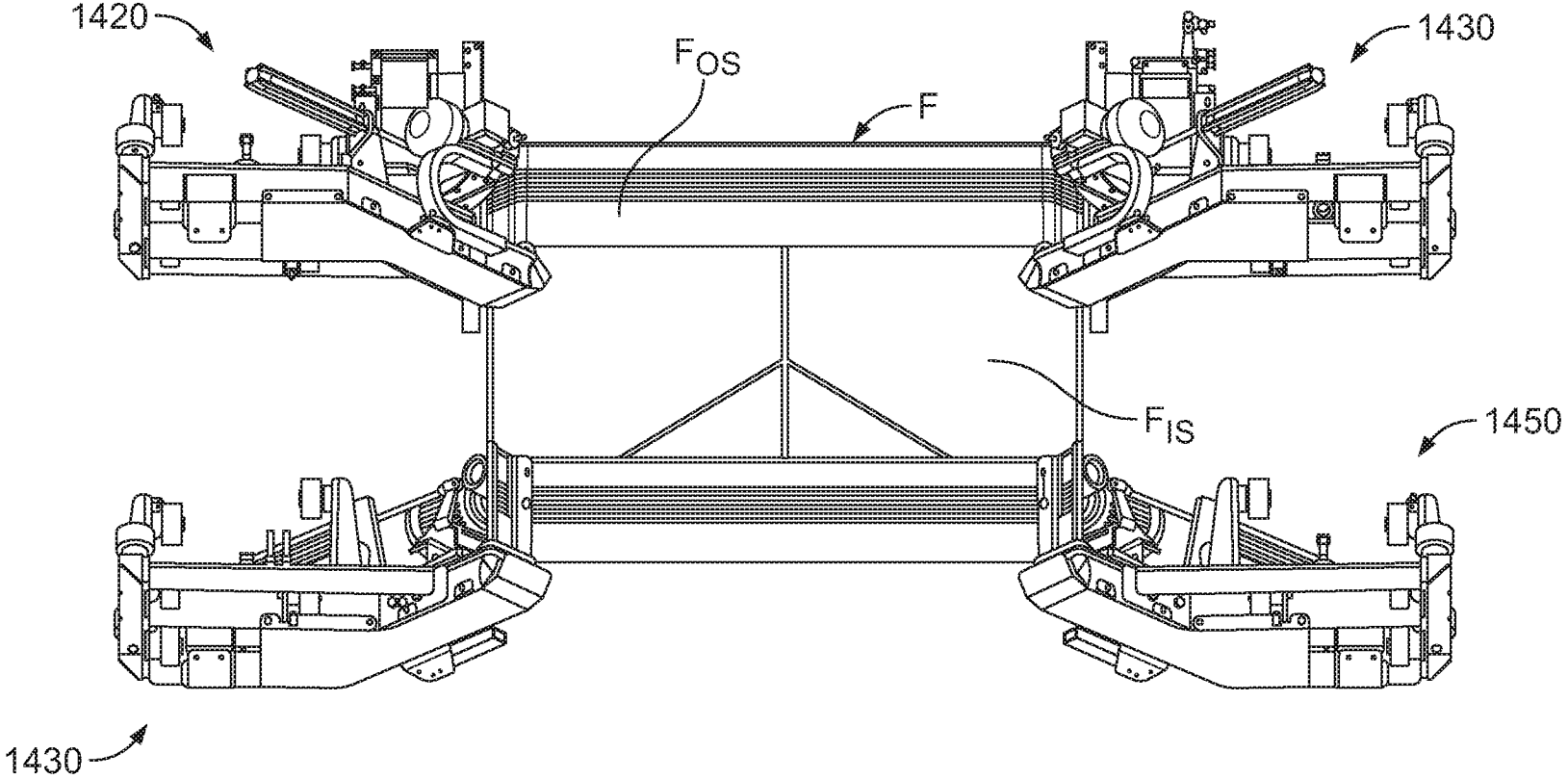
FIG. 4C is a perspective view similar to FIG. 4A but after the reefing devices have reefed the segment of tubular film onto their reefing fingers.

The first, second, third, and fourth reefing devices 1420, 1430, 1440, and 1450 are mounted to the wrapping carriage 1410 in a generally rectangular arrangement. FIGS. 4A-4C show the arrangement of the reefing devices with the wrapping carriage removed for clarity. The first, second, third, and fourth reefing devices 1420, 1430, 1440, and 1450 are movable with the wrapping carriage 1410 between its upper and lower positions and among its first, second, and third rotational positions. The reefing-device actuators 1460 are operably connected to the first, second, third, and fourth reefing devices 1420, 1430, 1440, and 1450 to move the reefing devices radially inwardly and outwardly relative to the central axis $CA_{1410}$ of the wrapping carriage 1410. In this example embodiment, the reefing device actuators include electric motors, but the actuators may be any suitable actuators (such as hydraulic motors) in other embodiments.

Figure 2:
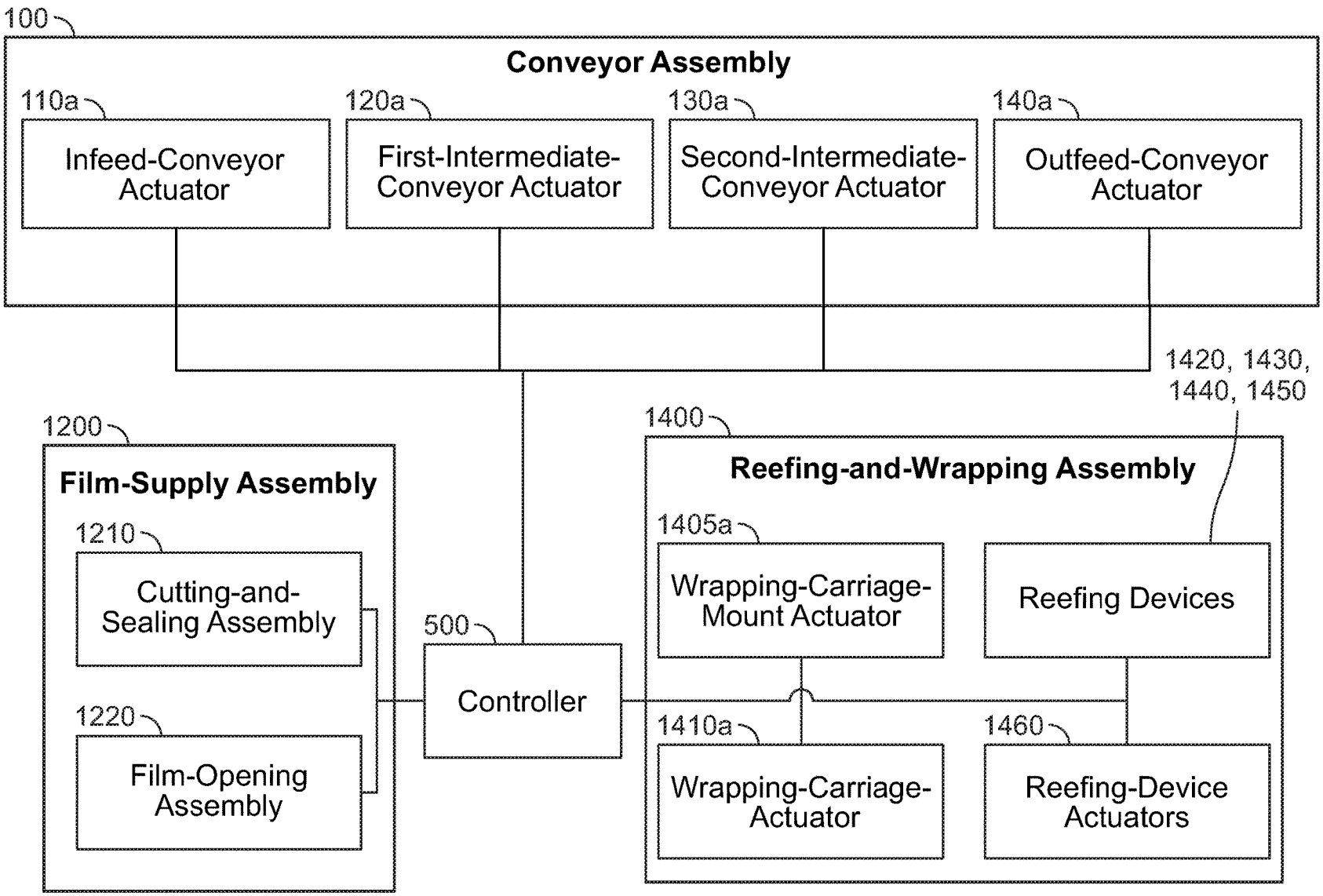
FIG. 2 is a block diagram of certain components of the wrapping system of FIG. 1.

The conveyor assembly 100 is configured to support the load L and to move the load L relative to the stretch-hood machine 1000. As best shown in FIGS. 1 and 2, the conveyor assembly 100 includes an infeed conveyor 110, a first intermediate conveyor 120, a second intermediate conveyor 130, and an outfeed conveyor 140.

The infeed conveyor 110 is positioned and otherwise configured to move the load L through the infeed area IN and into the wrapping area of the machine frame 1100 of the stretch-hood machine 1000. The infeed conveyor 110 includes a frame (not labeled), one or more conveying elements (not labeled) supported by the frame, and an infeed-conveyor actuator 110*a* operably connected to the conveying elements to drive the conveying elements to move the load L in a downstream direction D or an upstream direction U. In this example embodiment, the infeed-conveyor actuator 110*a* includes a motor, the conveying elements include driven rollers, and the infeed-conveyor actuator 110*a* is operably connected to the conveying elements 110 via one or more other components, such as sprockets, gearing, screws, tensioning elements, and/or a chain. The infeed-conveyor actuator 110*a* may include any other suitable actuator in other embodiments. The conveying elements may include any other suitable component or components, such as an endless belt, in other embodiments. The frame may be formed from any suitable combination of solid members, tubular members, plates, and/or any other suitable components attached to one another.

The first intermediate conveyor 120 is positioned and otherwise configured to support the load Las it moves through the wrapping area of the machine frame 1100 of the stretch-hood machine 1000. The first intermediate conveyor 120 includes a frame (not labeled), one or more conveying elements (not labeled) supported by the frame, and a first-intermediate-conveyor actuator 120*a* operably connected to the frame to move the frame relative to the stretch-hood machine 1000 in the downstream direction D and the upstream direction U. In this example embodiment, the first-intermediate-conveyor actuator 120*a* includes a motor and the conveying elements include freely rotatable rollers. The first-intermediate-conveyor actuator 120*a* may include any other suitable actuator in other embodiments. The conveying elements may include any other suitable component or components, such as an endless belt, in other embodiments. The frame may be formed from any suitable combination of solid members, tubular members, plates, and/or any other suitable components attached to one another. In other embodiments the conveying elements may be driven by a suitable actuator.

The second intermediate conveyor 130 is positioned and otherwise configured to support the load L as it moves through the wrapping area of the machine frame 1100 of the stretch-hood machine 1000. The second intermediate conveyor 130 includes a frame (not labeled), one or more conveying elements (not labeled) supported by the frame, and a second-intermediate-conveyor actuator 130*a* operably connected to the frame to move the frame relative to the stretch-hood machine 1000 in the downstream direction D and the upstream direction U. In this example embodiment, the second-intermediate-conveyor actuator 130*a* includes a motor and the conveying elements include freely rotatable rollers. The second-intermediate-conveyor actuator 130*a* may include any other suitable actuator in other embodiments. The conveying elements may include any other suitable component or components, such as an endless belt, in other embodiments. The frame may be formed from any suitable combination of solid members, tubular members, plates, and/or any other suitable components attached to one another. In other embodiments the conveying elements may be driven by a suitable actuator.

The outfeed conveyor 140 is positioned and otherwise configured to move the load L through the outfeed area OUT and out of the wrapping area of the machine frame 1100 of the stretch-hood machine 1000. The outfeed conveyor 140 includes a frame (not labeled), one or more conveying elements (not labeled) supported by the frame, and an outfeed-conveyor actuator 140*a* operably connected to the conveying elements to drive the conveying elements to move the load L in the downstream direction D or the upstream direction U. In this example embodiment, the outfeed-conveyor actuator 140*a* includes a motor, the conveying elements include driven rollers, and the outfeed-conveyor actuator 140*a* is operably connected to the conveying elements 110 via one or more other components, such as sprockets, gearing, screws, tensioning elements, and/or a chain. The outfeed-conveyor actuator 140*a* may include any other suitable actuator in other embodiments. The conveying elements may include any other suitable component or components, such as an endless belt, in other embodiments. The frame may be formed from any suitable combination of solid members, tubular members, plates, and/or any other suitable components attached to one another.

As best shown in FIG. 1: the infeed conveyor 110 is positioned adjacent the infeed area IN of the machine frame 1100 of the stretch-hood machine 1000, the outfeed conveyor 140 is positioned adjacent the outfeed area OUT of the machine frame 1100 of the stretch-hood machine 1000, the first intermediate conveyor 1200 is positioned within the wrapping area of the machine frame 1100 and between the infeed and outfeed conveyors 110 and 140, and the second intermediate conveyor is positioned within the wrapping area of the machine frame 1100 and between the first intermediate conveyor 120 and the outfeed conveyor 140. The first- and second-intermediate-conveyor actuators 120*a* and 130*a* are configured to move the first and second intermediate conveyors 120 and 130 relative to one another (and to the infeed conveyor 110, the outfeed conveyor 140, and the stretch-hood machine 1000) between: (1) a first (spaced-apart) configuration in which the first and second intermediate conveyors 120 and 130 are spaced-apart by a gap G sized so the wrapping carriage 1410 can fit in the gap G when in its lower position and its second or third rotational position (e.g., FIG. 6B); and (2) a second (adjacent) configuration in which the first and second intermediate conveyors are positioned closer to one another such that the gap G is not present and the wrapping carriage 1410 cannot fit between them when in its lower position and its second or third rotational position (e.g., FIG. 1).

The controller 500 includes a processing device communicatively connected to a memory device. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the wrapping system 50 (such as to carry out any of the processes described below). In certain embodiments the controller 500 is part of the stretch-hood machine 1000 or the conveyor assembly 100, though it may be separate from these components in other embodiments.

Although not shown here, in certain embodiments the wrapping system 50 includes one or more sensors communicatively connected to the controller 500. In these embodiments, the one or more sensors are configured to provide feedback to the controller 500 that enables the controller 500 to carry out the various wrapping processes. For instance, the one or more sensors may be configured to sense (depending on the embodiment): the vertical position of the wrapping carriage, the rotational position of the wrapping carriage, the radial positions of the reefing devices, and/or the position of the load relative to the wrapping carriage.

As best shown in FIG. 2, the controller 500 is communicatively and operably connected to the conveyor assembly 100 (including to the actuators 110*a*, 120*a*, 130*a*, and 140*a*); to the film-supply assembly 1200 (including to the cutting-and-sealing assembly 1210 and the film-opening assembly 1220); and to the reefing-and-wrapping assembly 1400 (including to the actuators 1405*a*, 1410*a*, and 1460 and to the reefing devices 1420, 1430, 1440, and 1450) and configured to control operation of these components to carry out the various processes described below.

As noted above, the wrapping system 50 is configured to wrap a load of goods by vertically or horizontally applying one or more segments of tubular stretch film to the load. In either scenario, the segment(s) of tubular stretch film are reefed onto and stretched by the reefing-and-wrapping assembly 1400 in generally the same manner, which is now described with reference to FIGS. 3A-4C. Once the film-opening assembly 1220 has opened the bottom portion of a segment of tubular stretch film F (as generally described above and as known in the art), the controller 500 controls the reefing-device actuators 1460 to move radially inwardly relative to the central axis $CA_{1410}$ of the wrapping carriage 1410 to respective insertion positions. At this point, and as shown in FIGS. 3A and 4A, the first, second, third, and fourth carriages 1424, 1434, 1444, and 1454 of the first, second, third, and fourth reefing devices 1420, 1430, 1440, and 1450 are in their respective home positions. The controller 500 controls the wrapping-carriage-mount actuator 1405*a* to raise the wrapping-carriage mount 1405 (and thus the wrapping carriage 1410 mounted thereon) so the reefing fingers 1422, 1432, 1442, and 1452 of the respective reefing devices 1420, 1430, 1440, and 1450 are received in the open bottom portion of the segment of tubular stretch film F, as shown in FIG. 4B.

The controller 500 controls the reefing-device actuators 1460 to move the reefing devices 1420, 1430, 1440, and 1450 radially outwardly relative to the central axis $CA_{1410}$ of the wrapping carriage 1410 to respective reefing positions in preparation for reefing the segment of tubular stretch film F. The controller 500 controls the first, second, third, and fourth carriage actuators 1427, 1437, 1447, and 1457 to move the respective carriages 1424, 1434, 1444, and 1454 from their respective home positions to their respective reefing positions, which causes the drive wheels 1425, 1435, 1445, and 1455 of the reefing devices 1420, 1430, 1440, and 1450 to contact the inner surface $F_{IN}$ of the segment of tubular stretch film F and force the outer surface $F_{OUT}$ of the segment of tubular stretch film F against the respective guide wheels 1422*a*, 1432*a*, 1442*a*, and 1452*a*. FIGS. 3B and 4B show the reefing devices 1420, 1430, 1440, and 1450 in their reefing positions after their carriages have moved to their respective reefing positions. In certain embodiments, the carriages move to their reefing positions as the reefing devices move to their reefing positions. The controller 500 then controls the first, second, third, and fourth roller actuators 1426, 1436, 1446, and 1456 to drive the first, second, third, and fourth drive rollers 1425, 1435, 1445, and 1455 in a reefing rotational direction to reef the segment of tubular stretch film F onto the reefing fingers 1422, 1432, 1442, and 1452. FIGS. 3C and 4C show the reefing devices 1420, 1430, 1440, and 1450 after reefing. The controller 500 controls the reefing-device actuators 1460 to move the reefing devices 1420, 1430, 1440, and 1450 radially outwardly relative to the central axis $CA_{1410}$ of the wrapping carriage 1410 from their respective reefing positions to their respective wrapping positions. This movement causes the segment of tubular stretch film F to stretch in preparation for wrapping.

Figure 5:
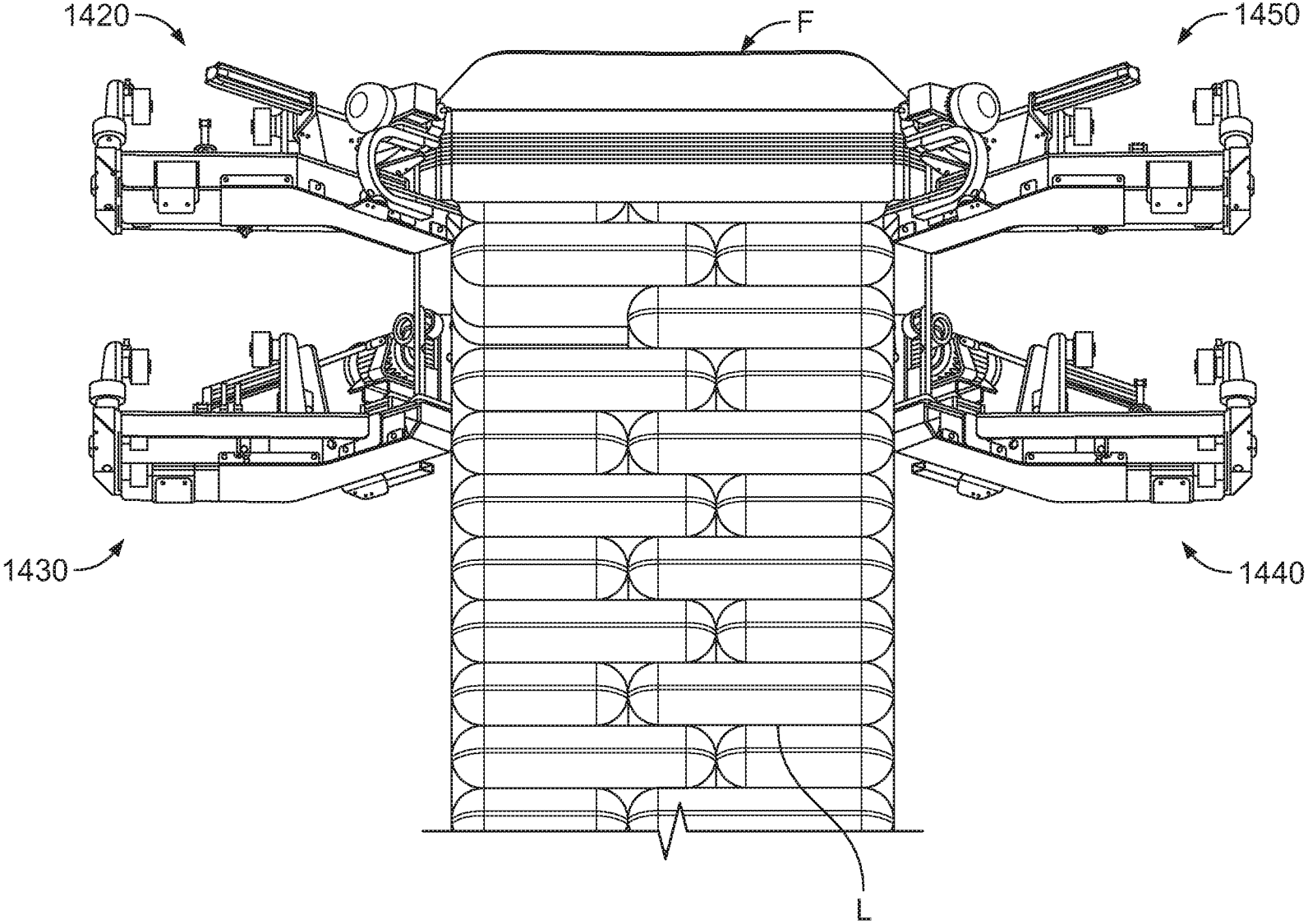
FIG. 5 is a perspective view similar to FIG. 4A but after the reefing devices have descended to just above the load in preparation for unreefing the segment of tubular film from the reefing fingers and onto the load.

To wrap the load L of goods vertically (or as sometimes used herein, to "vertically apply" the segment of tubular film to the load or to carry out a "vertical wrapping process"), the controller 500 controls the first- and second-intermediate-conveyor actuators 120*a* and 130*a* to move the first and second intermediate conveyors 120 and 130 to their second (adjacent) configuration (if they are not already in that configuration) and controls the conveyor assembly 100 (by controlling the infeed-conveyor actuator 110*a*) to move the load L into the wrapping area of the machine frame 1100 of the stretch-hood machine and below the wrapping carriage 1410. The controller 500 controls the wrapping-carriage-mount actuator 1405*a* to lower the wrapping-carriage mount 1405 (and the wrapping carriage 1410 thereon) while controlling the first, second, third, and fourth roller actuators 1426, 1436, 1446, and 1456 to drive the first, second, third, and fourth drive rollers 1425, 1435, 1445, and 1455 in the unreefing rotational direction at an unreefing speed to unreef the remainder of the segment of tubular stretch film F from the reefing fingers 1422, 1432, 1442, and 1452. FIG. 5 shows the reefing devices 1420, 1430, 1440, and 1450 just before unreefing the segment of tubular stretch film F onto the load. As the segment of tubular stretch film F is unreefed, it attempts to return to its unstretched size and shape and radially contracts onto the load L, which unitizes the load L and/or secures the load L to a pallet. The controller 500 then controls the wrapping-carriage-mount actuator 1405*a* to raise the wrapping-carriage mount 1405 and then controls the conveying assembly (by controlling the outfeed-conveyor actuator 140*a*) to move the load L out of the wrapping area, thereby ending the vertical wrapping process. Although the term "vertically" is used, the wrapping carriage need not move precisely vertically, so long as the primary component of movement of the wrapping carriage during the vertical wrapping process is vertical.

Figure 6B:
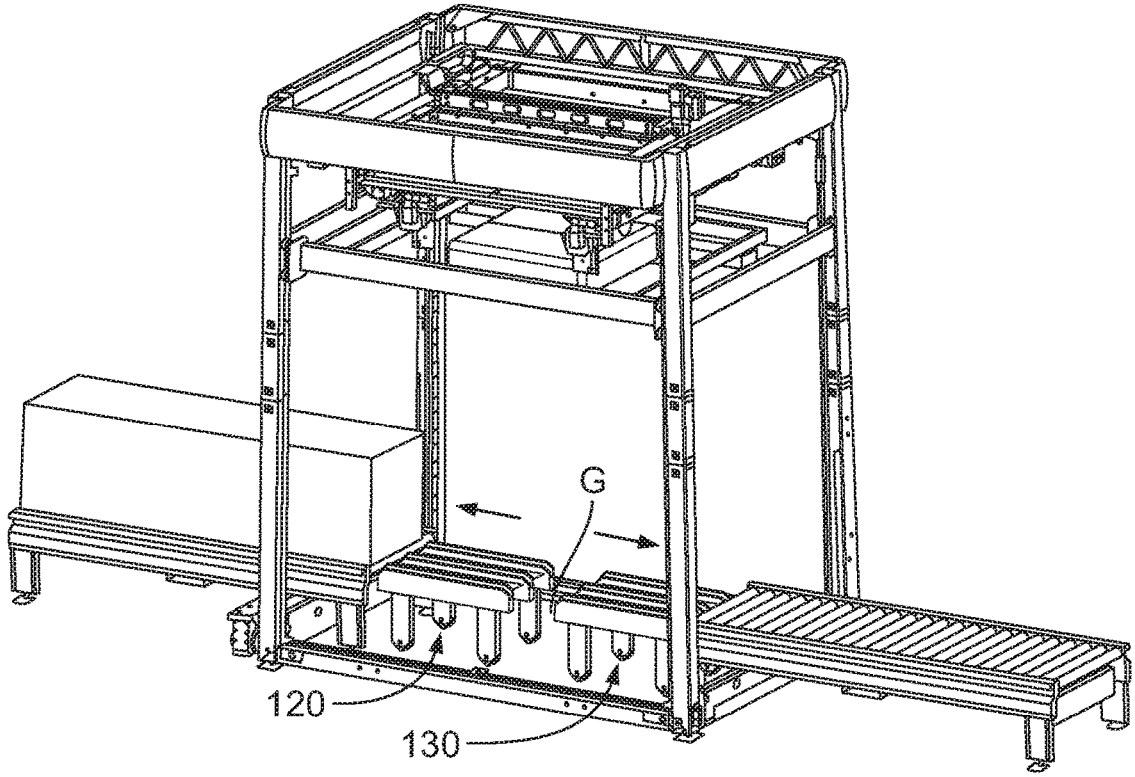
Figure 6C:
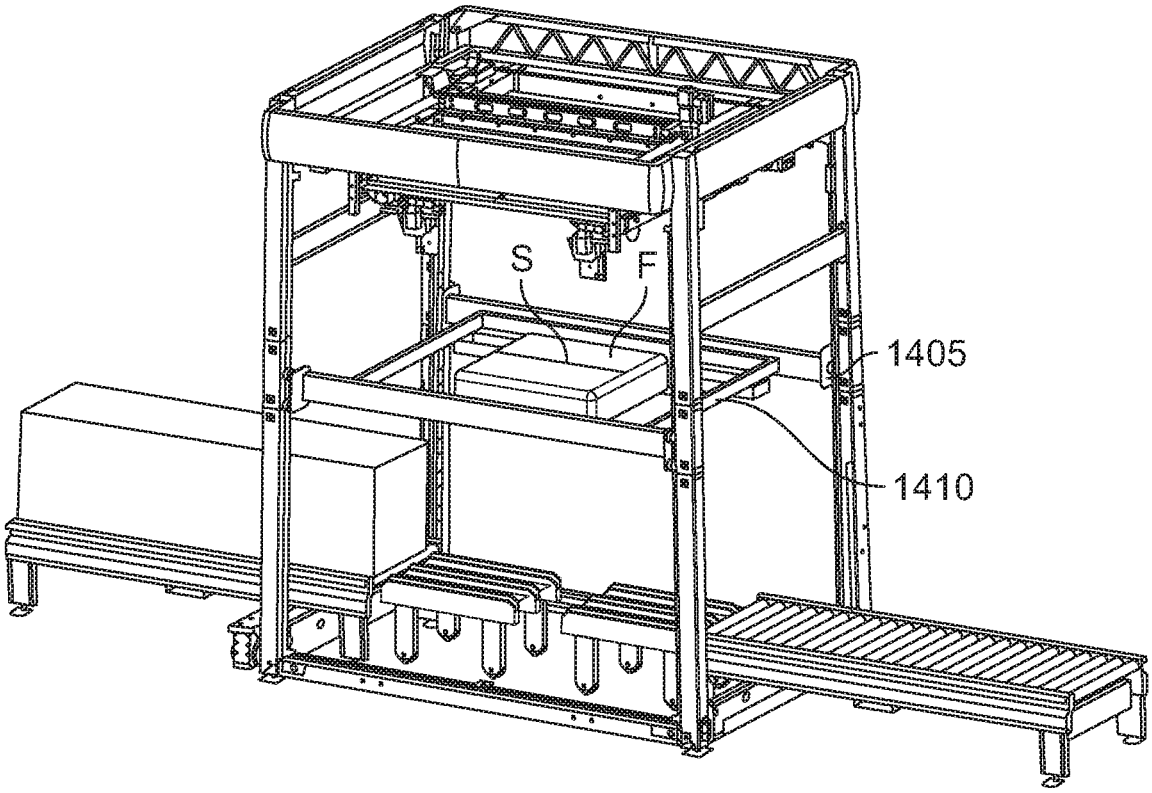

To wrap the load L of goods horizontally (or as sometimes used herein, to "horizontally apply" the segment of tubular film to the load or to carry out a "horizontal wrapping process"), the segment of tubular stretch film F is reefed onto the reefing fingers of the wrapping carriage 1410 and stretched, as generally described above and as shown in FIG. 6A (in which the reefing devices are not shown in detail for clarity, though certain of the Figures show the reefing fingers of the reefing devices). The controller 500 controls the first- and second-intermediate-conveyor actuators 120*a* and 130*a* to move the first and second intermediate conveyors 120 and 130 into their first (spaced-apart) configuration (if they are not already in that configuration), as shown in FIG. 6B. The controller 500 controls the wrapping-carriage-mount actuator 1405*a* to begin moving the wrapping-carriage mount 1405 (and the wrapping carriage 1410 thereon) downward, as shown in FIG. 6C. The controller 500 controls the wrapping-carriage actuator 1410*a* to rotate the wrapping carriage 1410 to its second rotational position, as shown in FIG. 6D. After this rotation, the seam S of the segment of tubular stretch film F is oriented vertically.

Figure 6E:
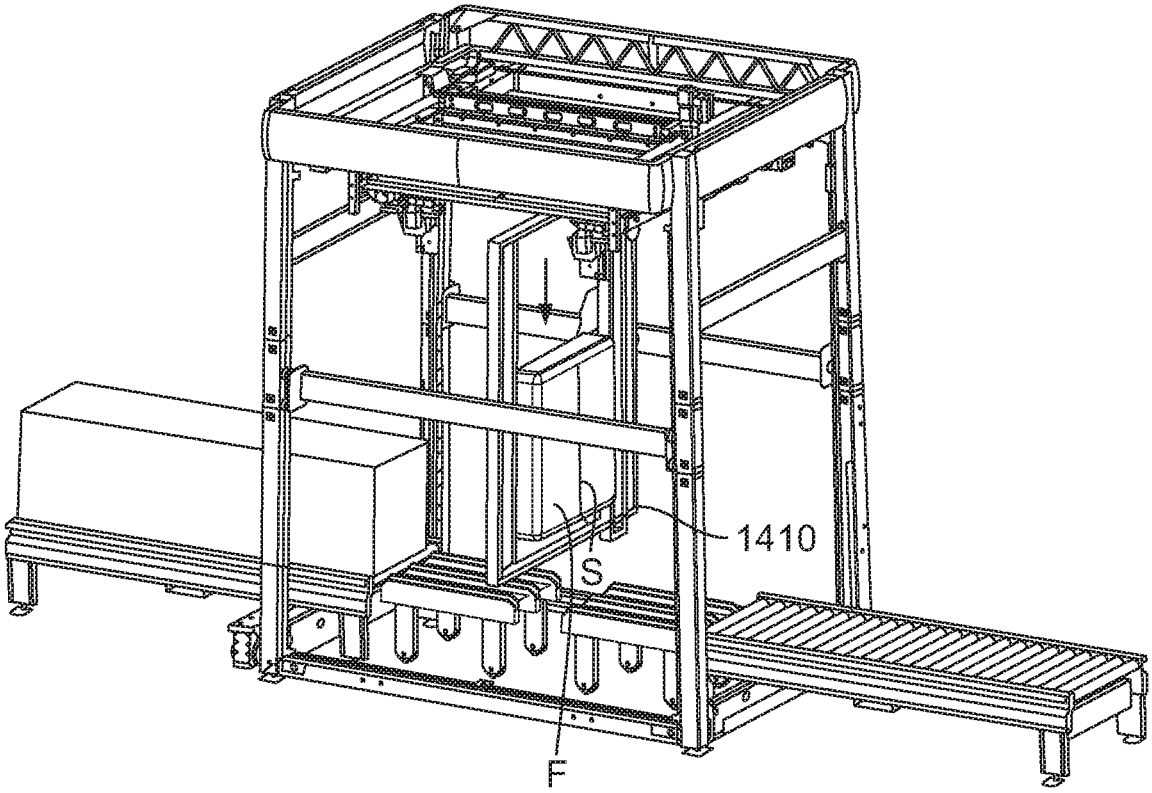
Figure 6F:
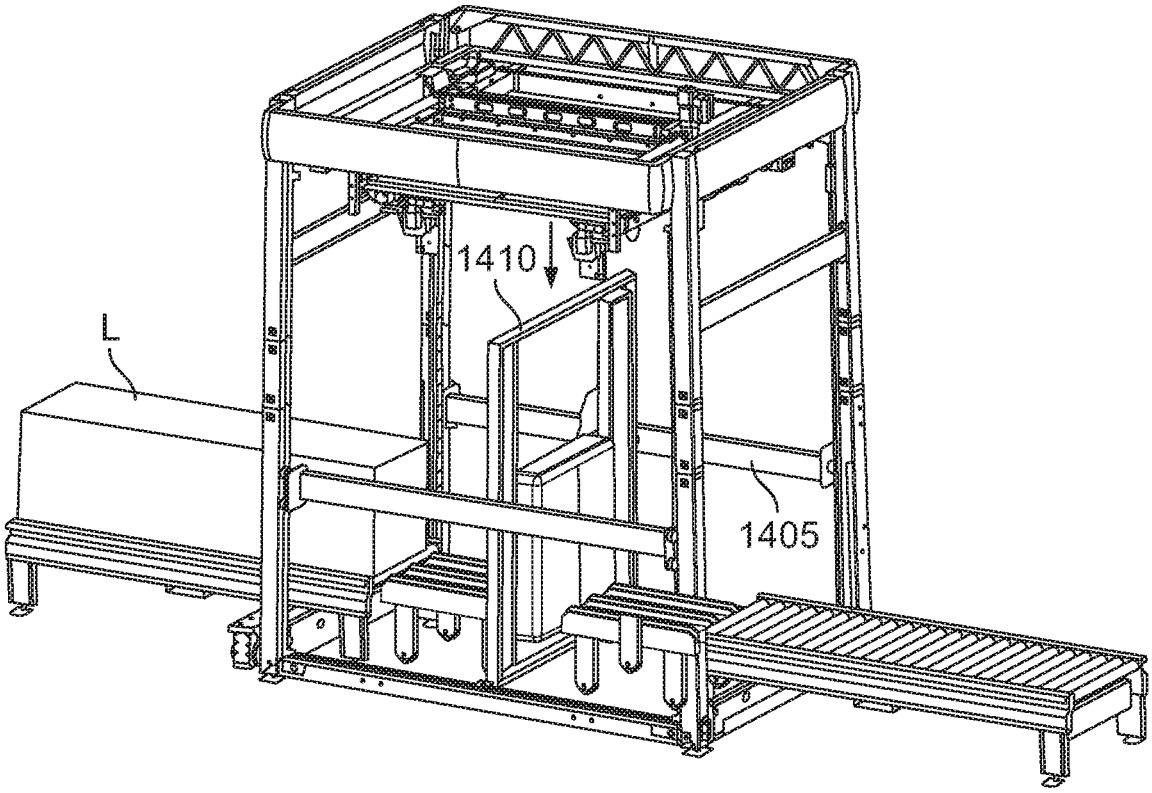
Figure 6G:
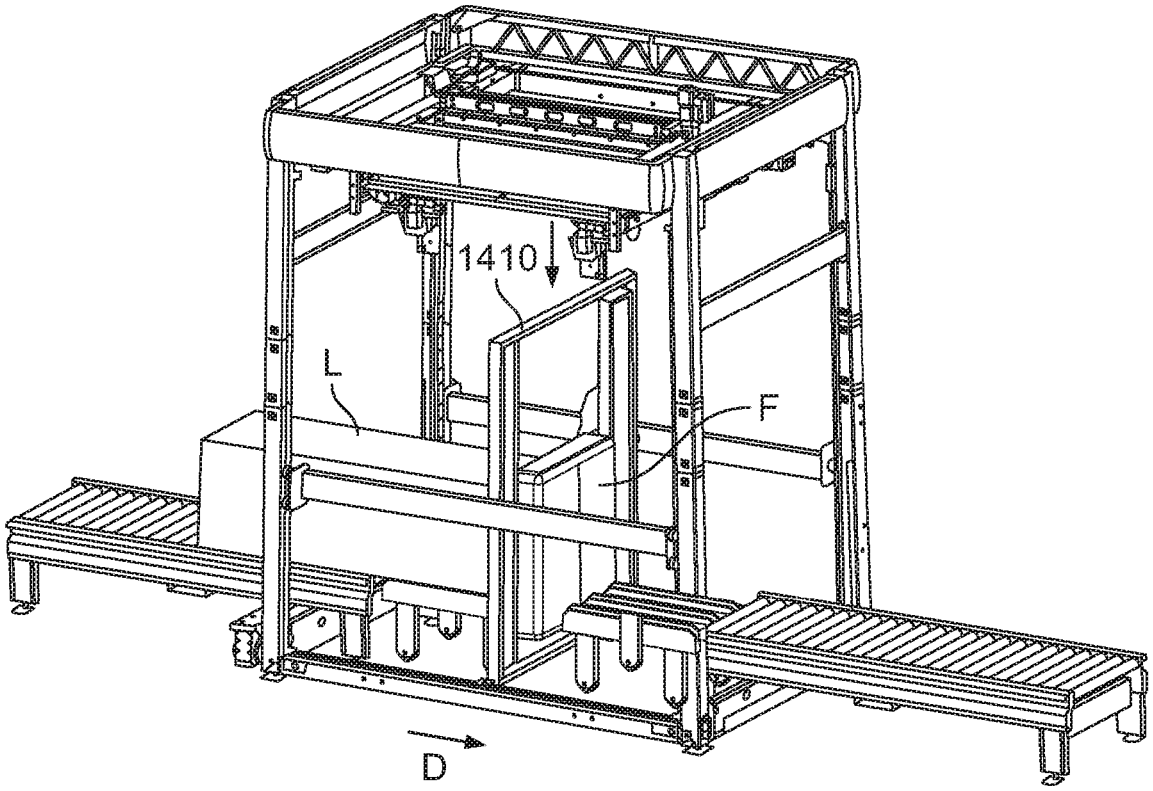
Figure 6H:
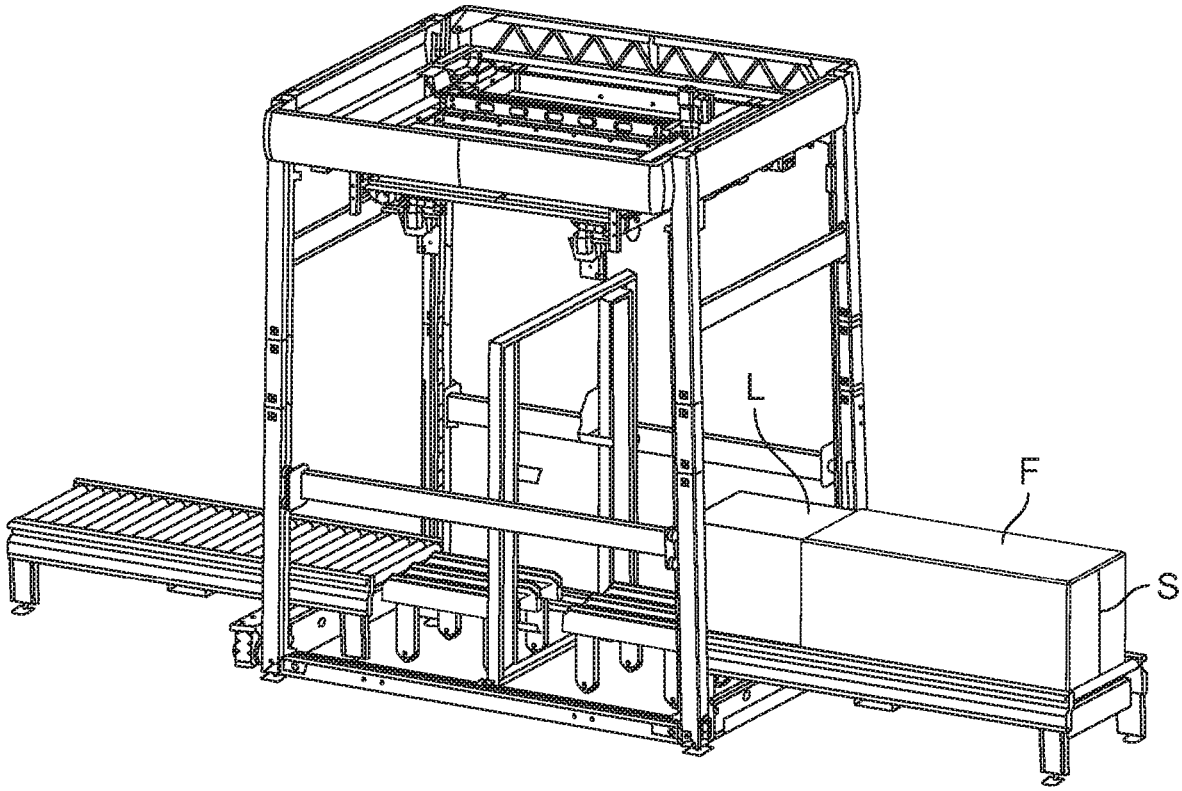

The controller 500 then controls the reefing-device actuators 1460 to move the reefing devices 1420, 1430, 1440, and 1450 downward toward the (now) bottom of the wrapping carriage 1410, as shown in FIG. 6E (though this step is omitted in other embodiments). The controller 500 controls the wrapping-carriage-mount actuator 1405*a* to continue to move the wrapping-carriage mount 1405 (and the wrapping carriage 1410 thereon) downward until the wrapping carriage 1410 moves into the gap G and the segment of tubular stretch film F is positioned adjacent the load L, as shown in FIG. 6F. The controller 500 controls the conveyor assembly 100 (by controlling the infeed-conveyor actuator 110*a*) to move the load L in the downstream direction D and into the (open bottom of the) segment of tubular stretch film F, as shown in FIG. 6G. As shown in FIG. 6H, continued movement of the load L in the downstream direction D (via the infeed and outfeed conveyors 110 and 140) coupled with unreefing of the segment of tubular stretch film F from the reefing fingers (as described above) applies the segment of tubular stretch film F to the load L.

Figure 6I:
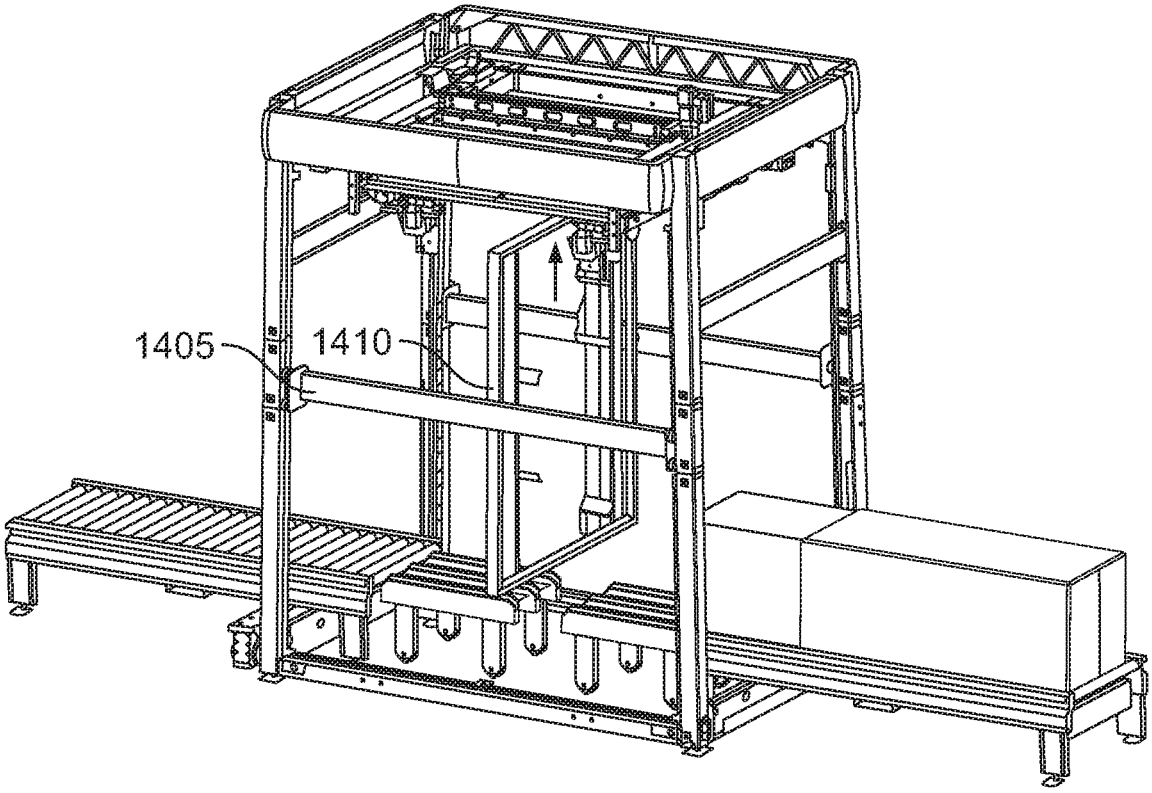
Figure 6J:
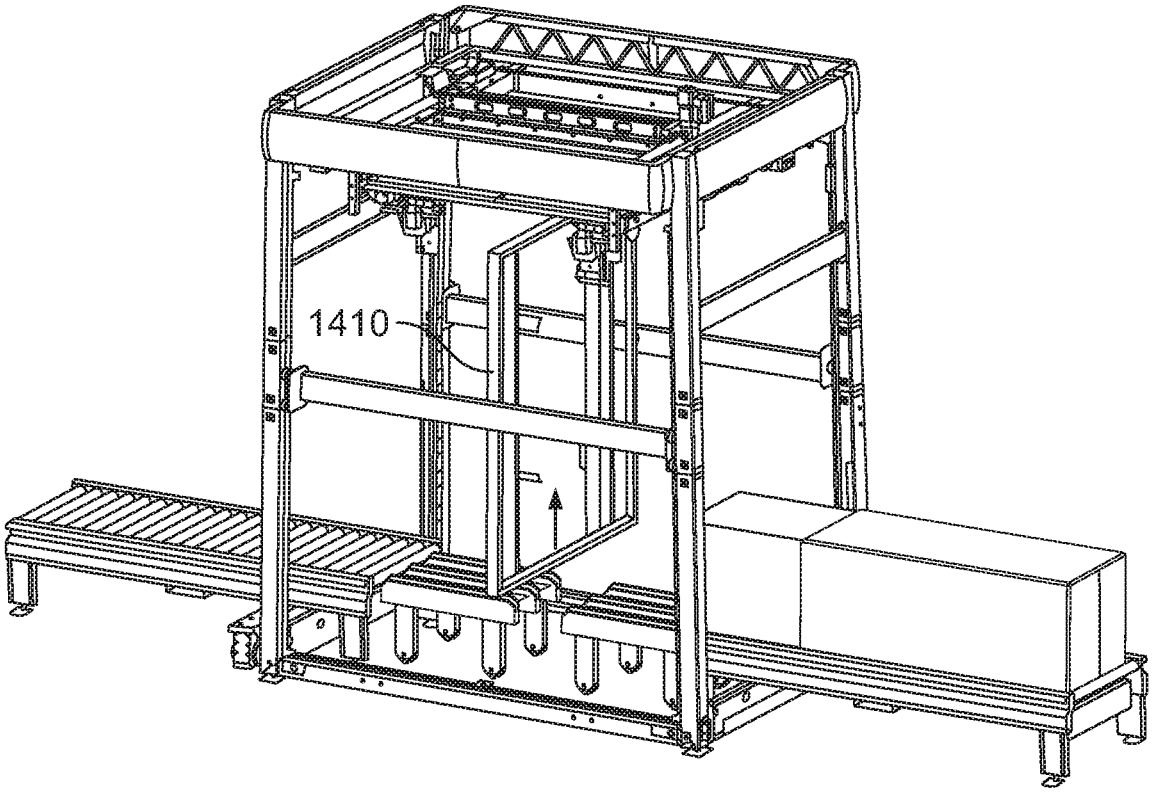
Figure 6K:
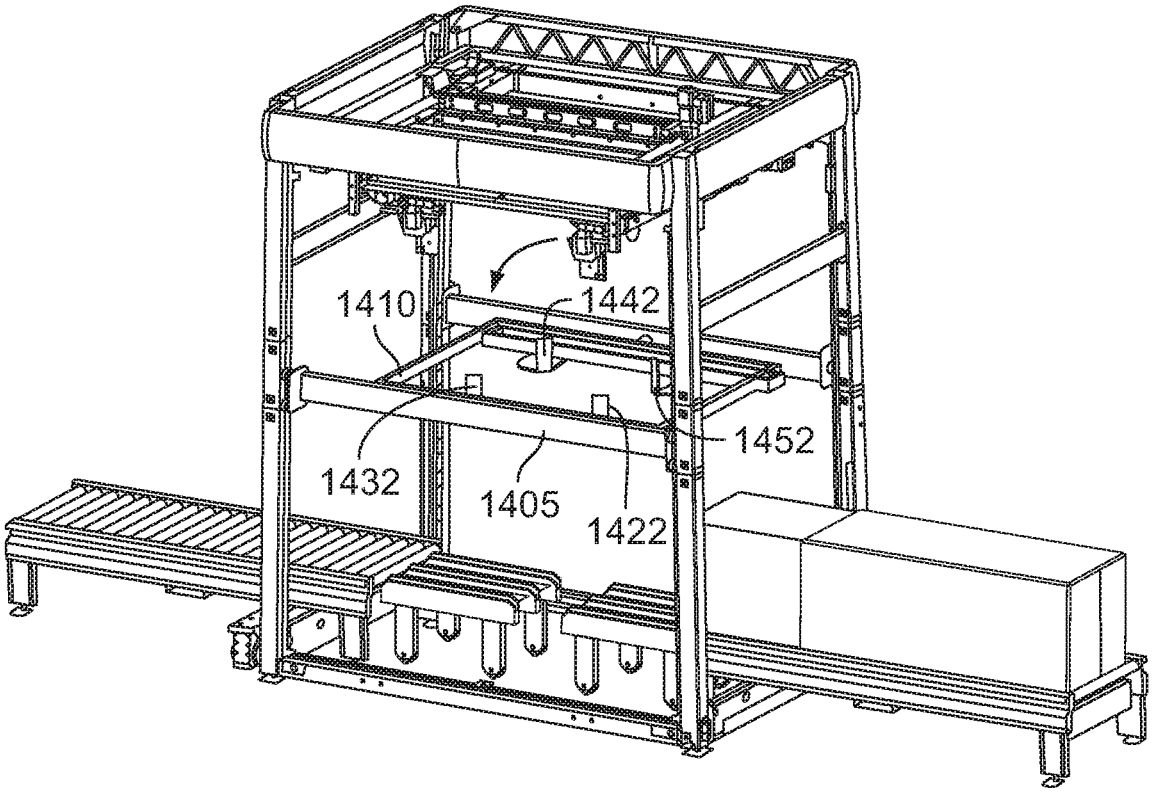
Figure 6L:
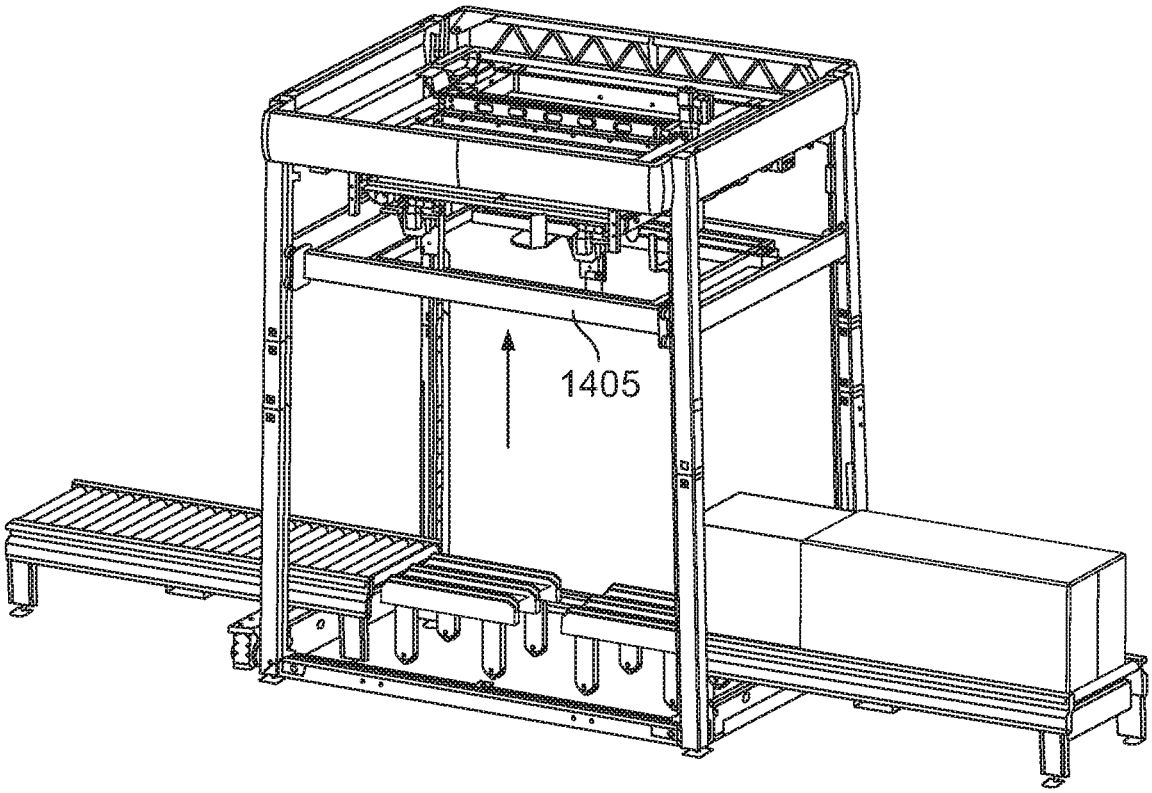

Afterwards, the controller 500 controls the wrapping-carriage-mount actuator 1405*a* to begin moving the wrapping-carriage mount 1405 (and the wrapping carriage 1410 thereon) upward, as shown in FIG. 6I; controls the reefing-device actuators 1460 to move the reefing devices 1420, 1430, 1440, and 1450 back to their insertion positions, as shown in FIG. 6J; controls the wrapping-carriage actuator 1410*a* to rotate the wrapping carriage back to its first rotational position, as shown in FIG. 6K; and controls the wrapping-carriage-mount actuator 1405*a* to move the wrapping-carriage mount 1405 (and the wrapping carriage 1410 thereon) upward to its upper position in preparation for receiving another segment of tubular stretch film F, as shown in FIG. 6L. Although the term "horizontally" is used, the load need not move precisely horizontally, so long as the primary component of movement of the load during the horizontal wrapping process is horizontal.

In certain situations, the operator may desire that the load L be enclosed by film on all sides (such as all six sides (front, back, left side, right side, top, and bottom) of a parallelepiped load). In these situations, a second segment of tubular stretch film F2 is reefed onto the reefing fingers of the wrapping carriage 1410 and stretched, as generally described above and as shown in FIG. 7A (in which the reefing devices are not shown for clarity). The controller 500 controls the wrapping-carriage-mount actuator 1405*a* to begin moving the wrapping-carriage mount 1405 (and the wrapping carriage 1410 thereon) downward, as shown in FIG. 7B. The controller 500 controls the wrapping-carriage actuator 1410*a* to rotate the wrapping carriage 1410 to its third rotational position, as shown in FIG. 7C. After this rotation, the seam (not shown) of the segment of tubular stretch film F2 is oriented vertically.

Figure 7D:
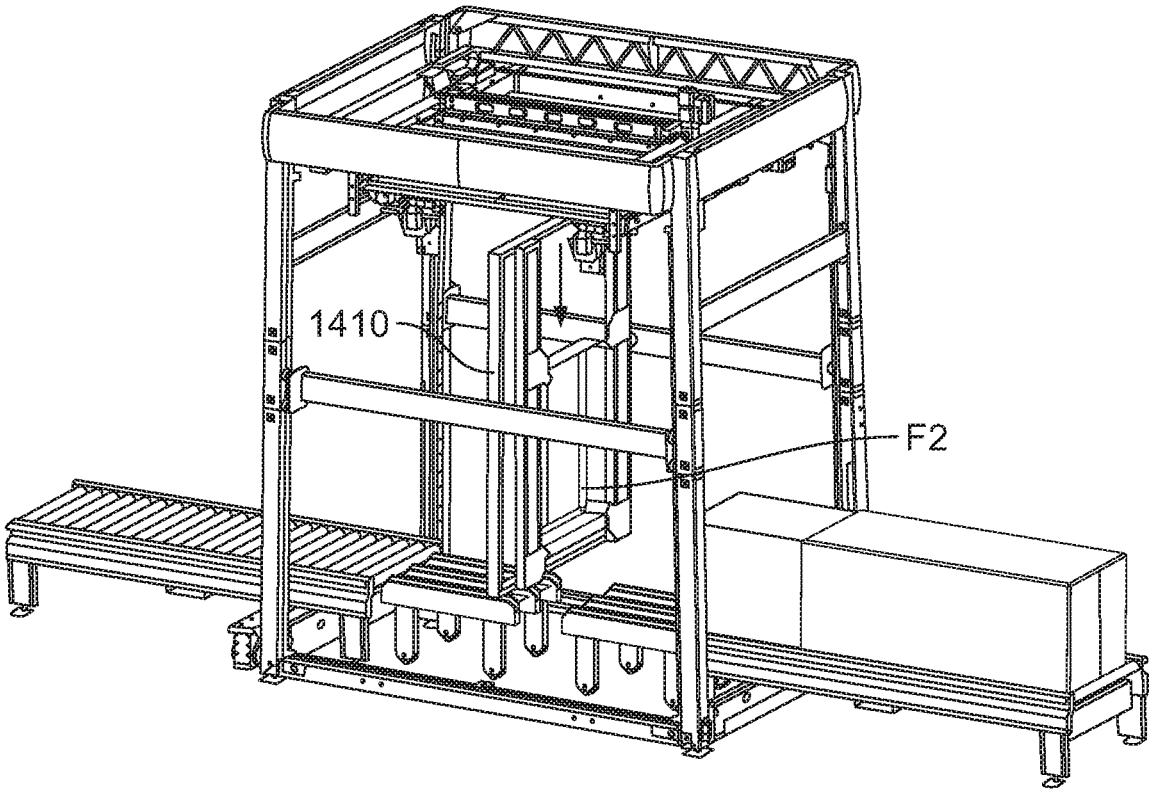
Figure 7E:
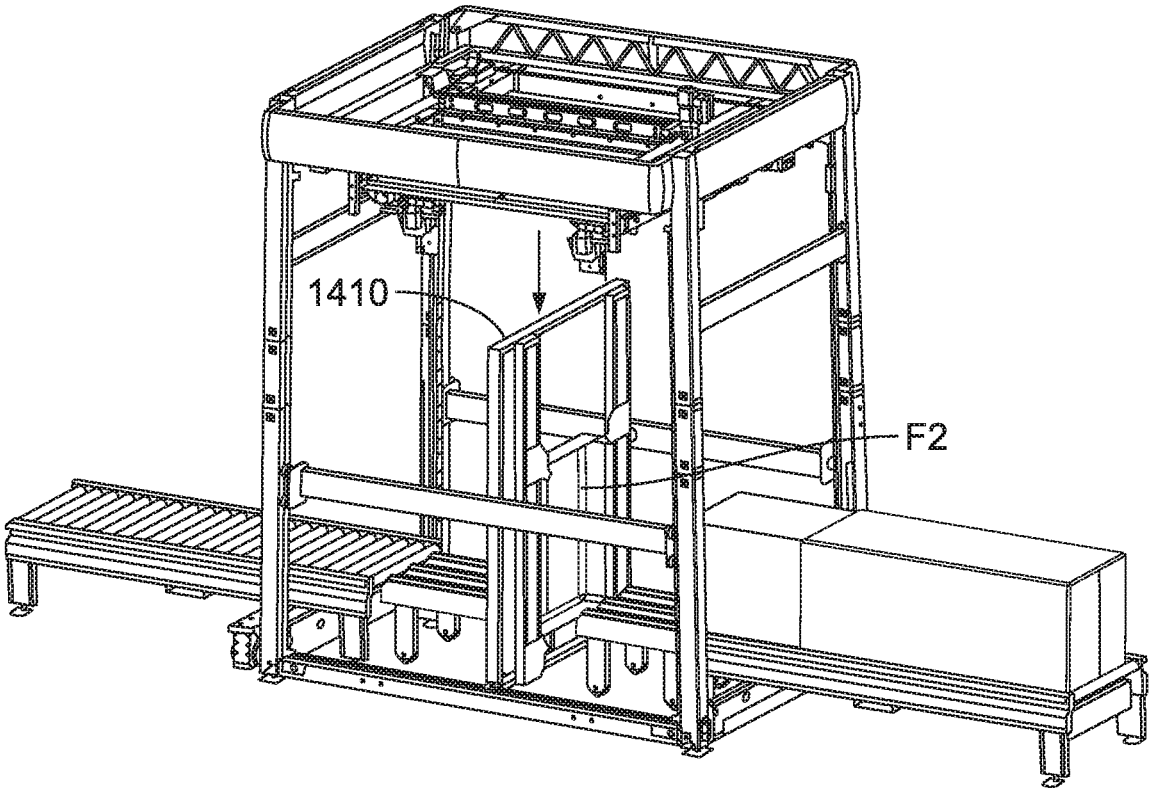
Figure 7F:
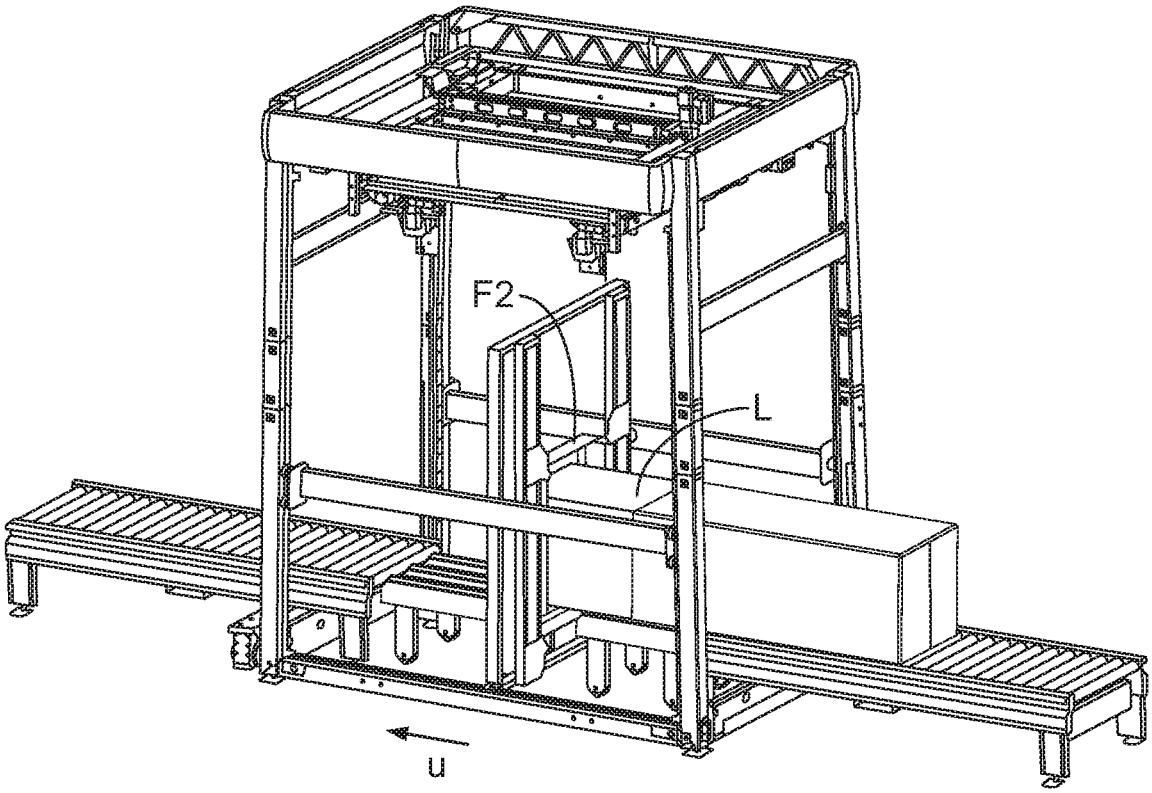
Figure 7G:
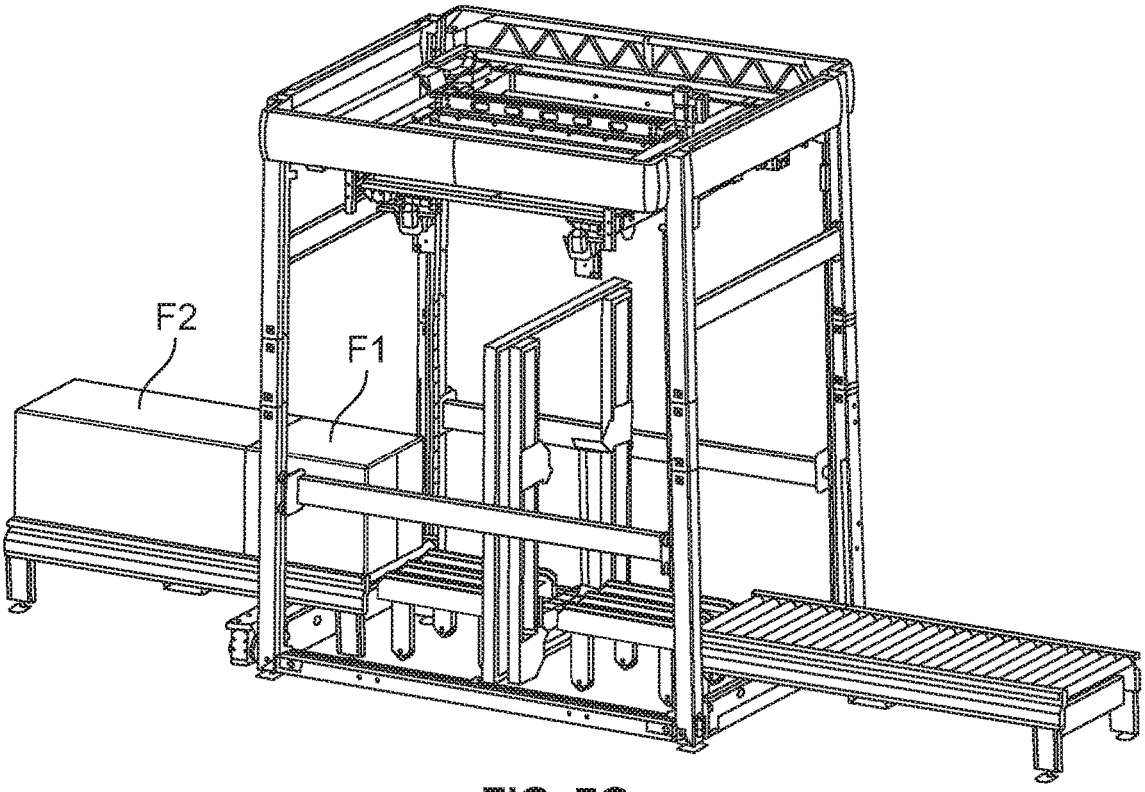

The controller 500 then controls the reefing-device actuators 1460 to move downward toward the (now) bottom of the wrapping carriage 1410, as shown in FIG. 7D (though this step is omitted in other embodiments). The controller 500 controls the wrapping-carriage-mount actuator 1405*a* to continue to move the wrapping-carriage mount 1405 (and the wrapping carriage 1410 thereon) downward until the segment of tubular stretch film F2 is positioned adjacent the load L, as shown in FIG. 7E. The controller 500 controls the conveyor assembly 100 (by controlling the outfeed-conveyor actuator 140*a*) to move the load L in the upstream direction U and into the (open bottom of the) segment of tubular stretch film F2, as shown in FIG. 7F. As shown in FIG. 7G, continued movement of the load L in the upstream direction U (via the infeed and outfeed conveyors 110 and 140) coupled with unreefing of the segment of tubular stretch film F2 from the reefing fingers (as described above) applies the segment of tubular stretch film F2 to the load L at this point, the film covers all sides of the load L such that the load L is fully encased in the two segments of tubular stretch film F and F2.

Accordingly, in this example embodiment the wrapping system 50 applies two segments of tubular film F and F2 to the load L in two different directions: the downstream direction D (for the segment of tubular film F) and the upstream direction U (for the segment of tubular film F2).

Figure 7H:
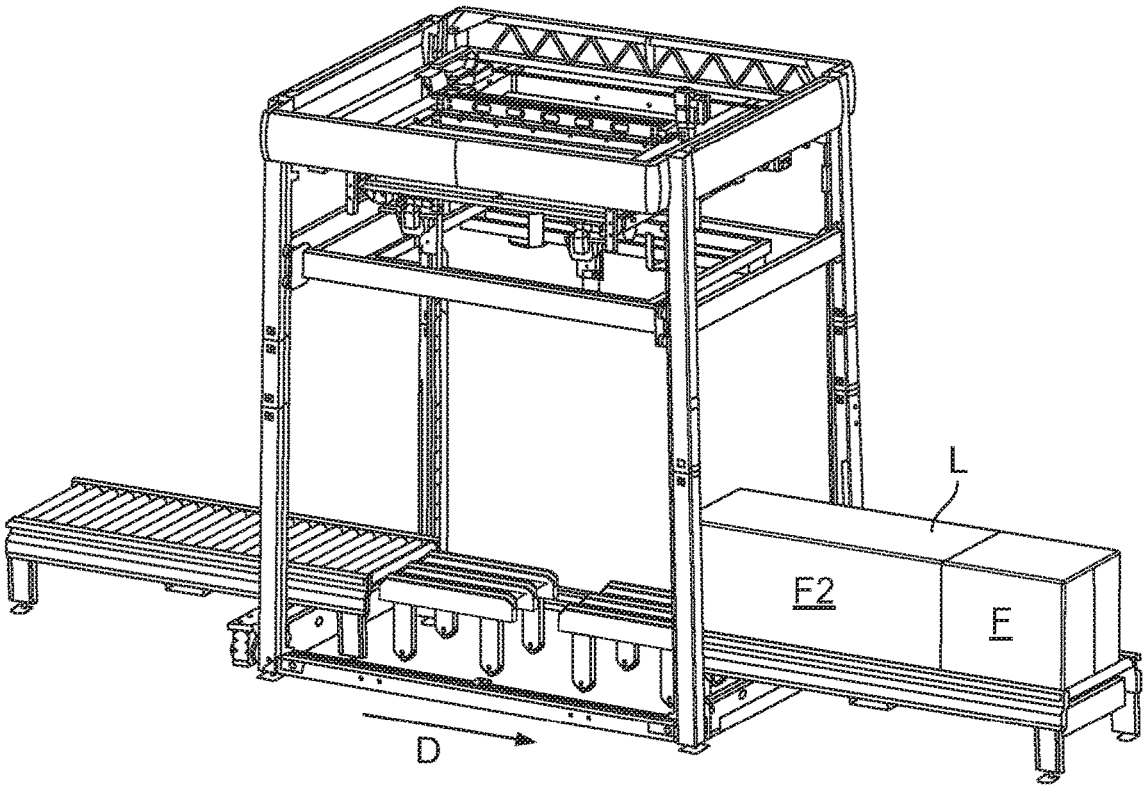

Afterwards, the controller 500 controls the wrapping-carriage-mount actuator 1405*a*, the wrapping-carriage actuator 1410*a*, and the reefing-device actuators 1460 to return the wrapping carriage to its upper position and its first rotational position and to return the reefing devices to their insertion positions, as generally described above and not shown for brevity, in preparation for the next wrapping process. As shown in FIG. 7H, the controller 500 controls the conveying system 100 to move the (wrapped) load L in the downstream direction D and out of the wrapping area.

The wrapping system and the horizontal wrapping process of the present disclosure are improvements over existing stretch-hood systems in that they enable a load to be covered in film on all sides without requiring the load to be inverted. Certain existing stretch-hood systems either are not capable of covering a load in film on all sides or include heavy-duty equipment (that is expensive to purchase, maintain, and operate) for inverting the load to enable it to be covered on all sides by consecutive vertical wrapping processes.

In other embodiments, the wrapping system is configured to enclose the entire load (all sides of the load) in a single segment of tubular stretch film. In these embodiments, the stretch-hood machine includes a sealing assembly in addition to the cutting-and-sealing assembly of the film-supply assembly. In some embodiments, the sealing assembly is supported by the wrapping carriage. In these embodiments, the sealing device is configured to seal the end of the tubular stretch film after unreefing the film onto the load or just before finishing unreefing the film onto the load.

Figure 8A:
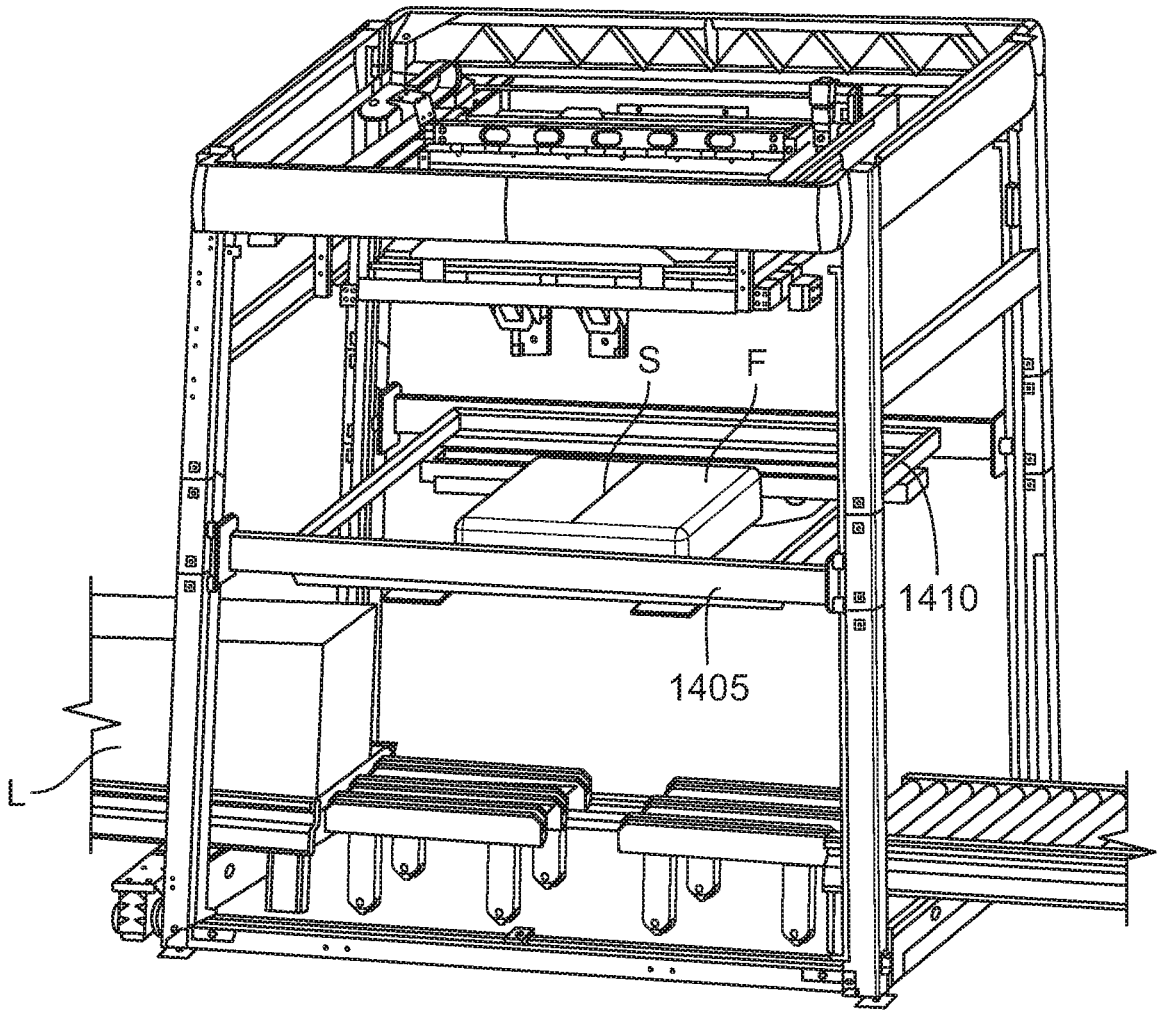
FIGS. 8A and 8B are perspective views of the wrapping system during application of a segment of tubular film with a horizontal seam to a load.
Figure 8B:
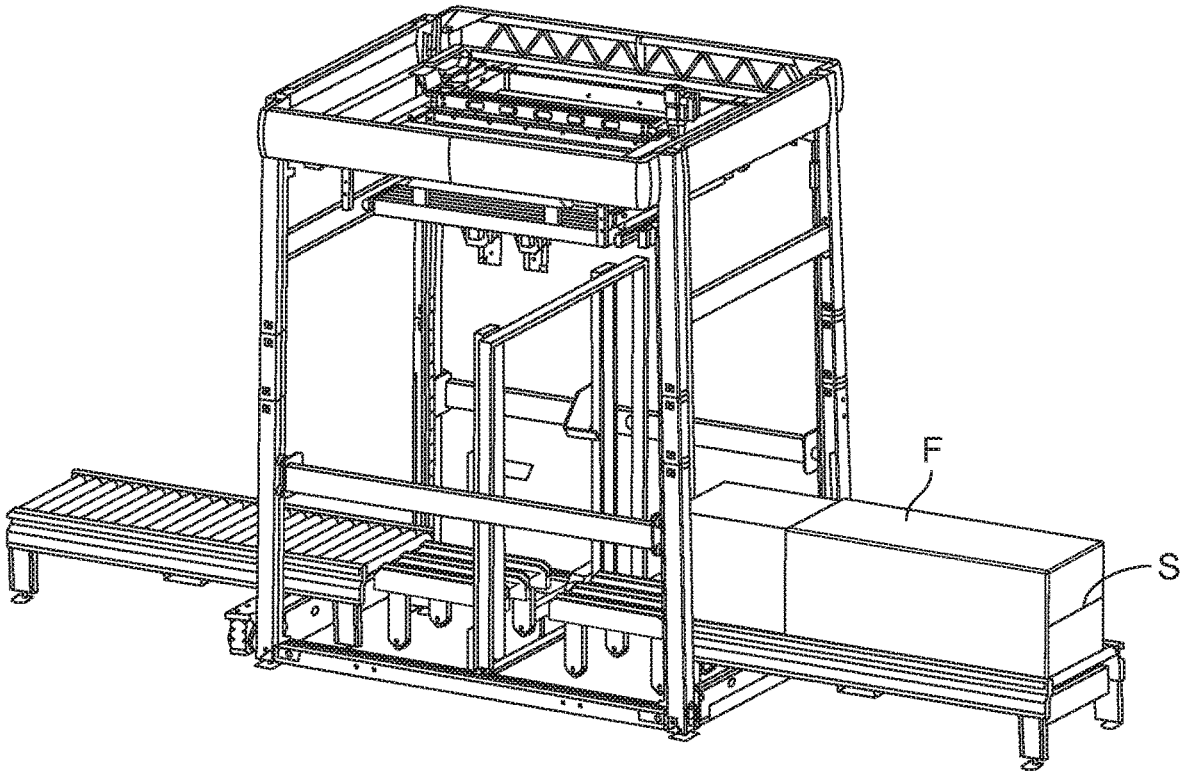

As shown in FIG. 6H, for instance, when the load L of goods is horizontally wrapped, the seam S of the segment of tubular stretch film F extends vertically. In other embodiments, certain components of the stretch-hood machine 1000 are configured to re-orient the segment of tubular stretch film F before it is applied to the goods to change the orientation of the seam S of the segment of tubular stretch film F so it extends horizontally after being applied to the load L. Depending on the embodiment, one or more of: the film-supply assembly 1200, the film-opening assembly 1220, and the wrapping carriage 1410 may be rotatable (such as via an actuator such as a motor (sometimes referred to as a "turning module"), not shown) relative to the other components of the stretch-hood machine 1000, the load L, and the conveyor assembly 100 about a vertical axis between a first rotational position, which corresponds to the position shown in FIGS. 6A-6L, and a second rotational position, which in this example embodiment is 90 degrees from the first rotational position. In these embodiments, the controller 500 is configured to rotate these one or more component(s) from the first position to the second rotational position before the segment of tubular stretch film F is applied to the load L. As shown in FIGS. 8A and 8B, the seam S of the segment of tubular stretch film F extends horizontally (and more specifically, orthogonally to the longitudinal direction of the load L and the downstream and upstream directions D and U) after wrapping.

Figure 9:
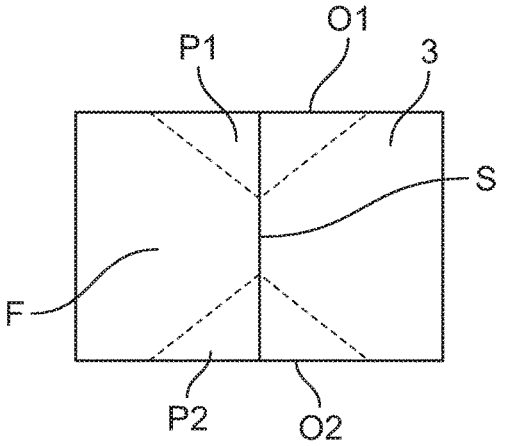
FIG. 9 is an end-on view of a load wrapped with a segment of tubular film having a vertical seam.
Figure 10:
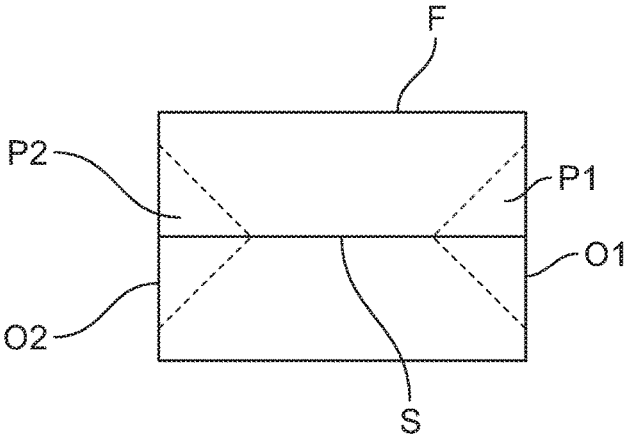
FIG. 10 is an end-on view of a load wrapped with a segment of tubular film having a horizontal seam.

Potential benefits of this horizontal orientation of the seam are described with respect to FIGS. 9 and 10, which show end-on views of a wrapped load L with a vertically oriented seam S (FIG. 9) and a horizontally oriented seam S (FIG. 10). As shown in FIG. 9, when the seam S is oriented vertically two triangular pockets P1 and P2 are formed on top and the bottom of the load L. The openings O1 and O2 of these pockets are located on the top and bottom of the end face of the load L such that they (or at least the top pocket P1) can collect moisture and debris during storage of the wrapped load L unless the wrapped load L is turned by 90 degrees to re-orient it—and the pockets and their openings—after wrapping. This requires additional equipment, takes time, and risks damaging the load or the film. In contrast and as shown in FIG. 10, when the seam S is aligned horizontally the pockets P1 and P2 are formed on the sides of the load L, and their openings O1 and O2 are oriented such that they will not collect moisture or debris.

Figure 11A:
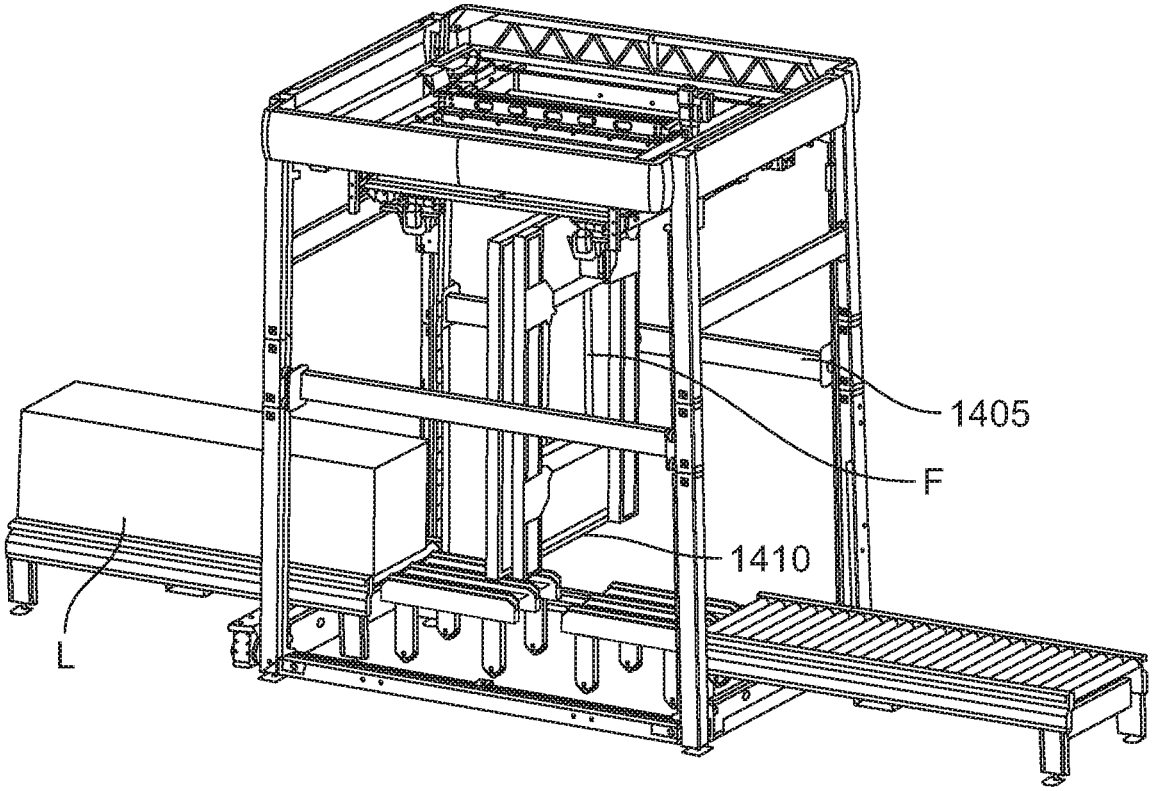
FIGS. 11A-11E are perspective views of the wrapping system during application of a segment of tubular film to a load in which the seam contacts the load.

Other embodiments of the present disclosure avoid this problem by orienting the segment of tubular stretch film F so the seam S is positioned "inside" the segment of tubular stretch film and contacts the load L. As shown in FIG. 11A, after the segment of tubular stretch film F is reefed and stretched, the controller 500 controls the wrapping-carriage-mount actuator 1405*a* to begin moving the wrapping-carriage mount 1405 (and the wrapping carriage 1410 thereon) downward and controls the wrapping-carriage actuator 1410*a* to rotate the wrapping carriage 1410 to its third rotational position. After this rotation, the seam S of the segment of tubular stretch film F is oriented vertically.

Figure 11B:
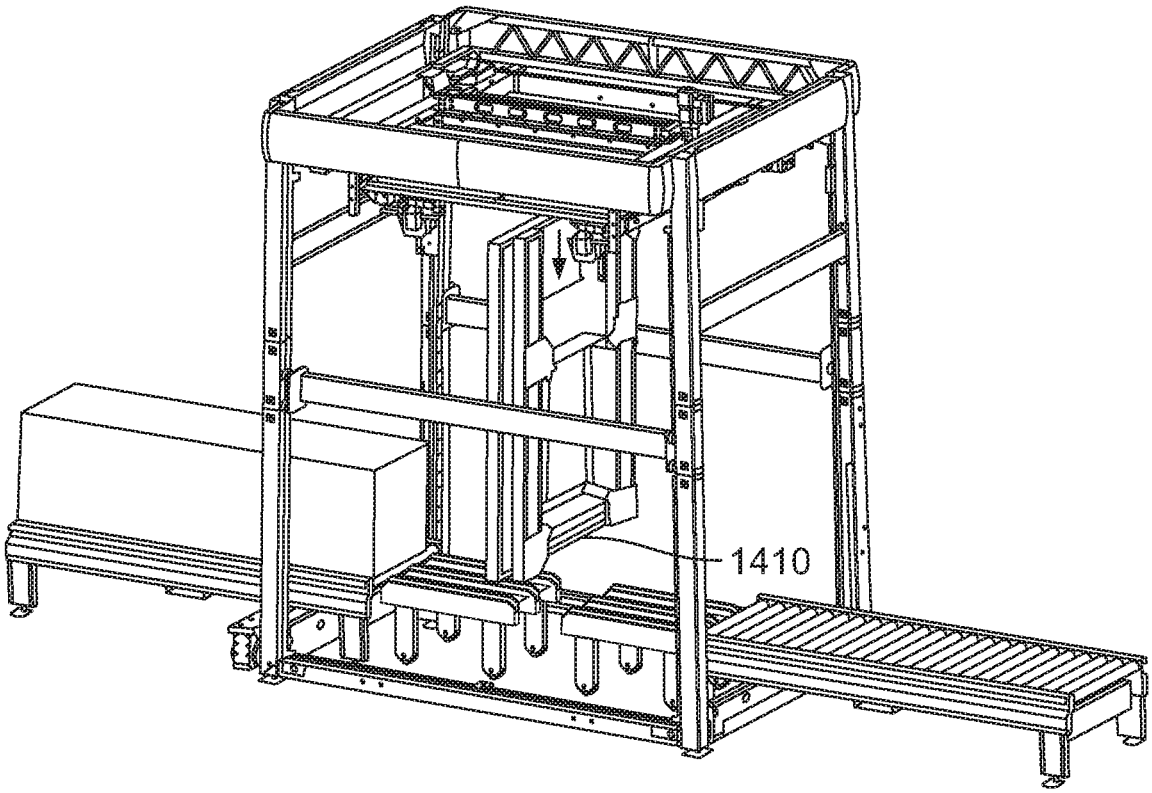
Figure 11C:
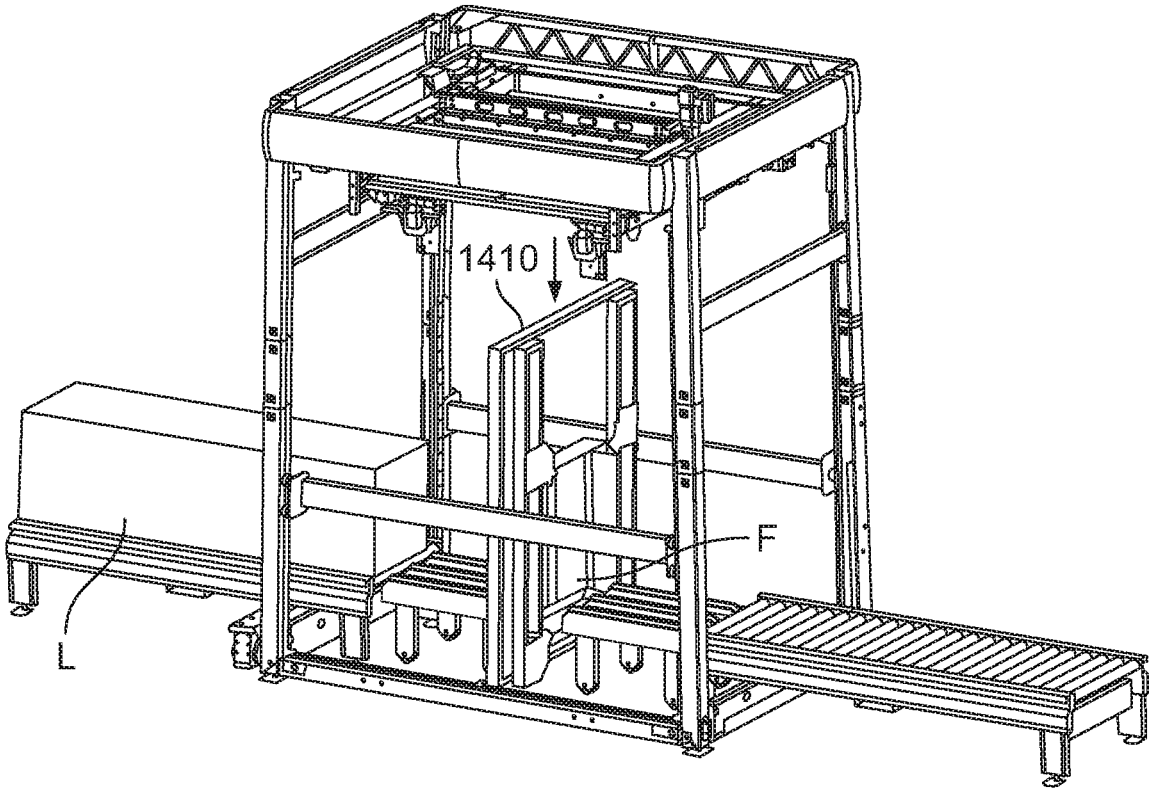
Figure 11D:
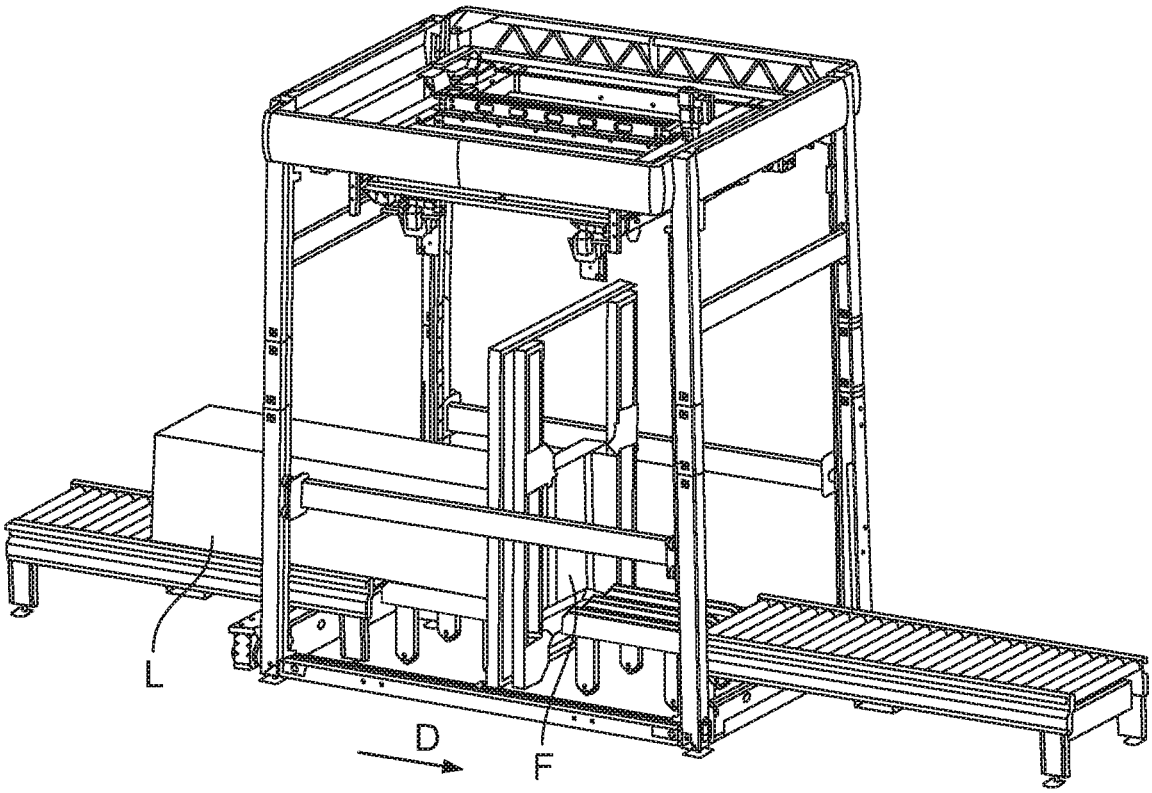
Figure 11E:
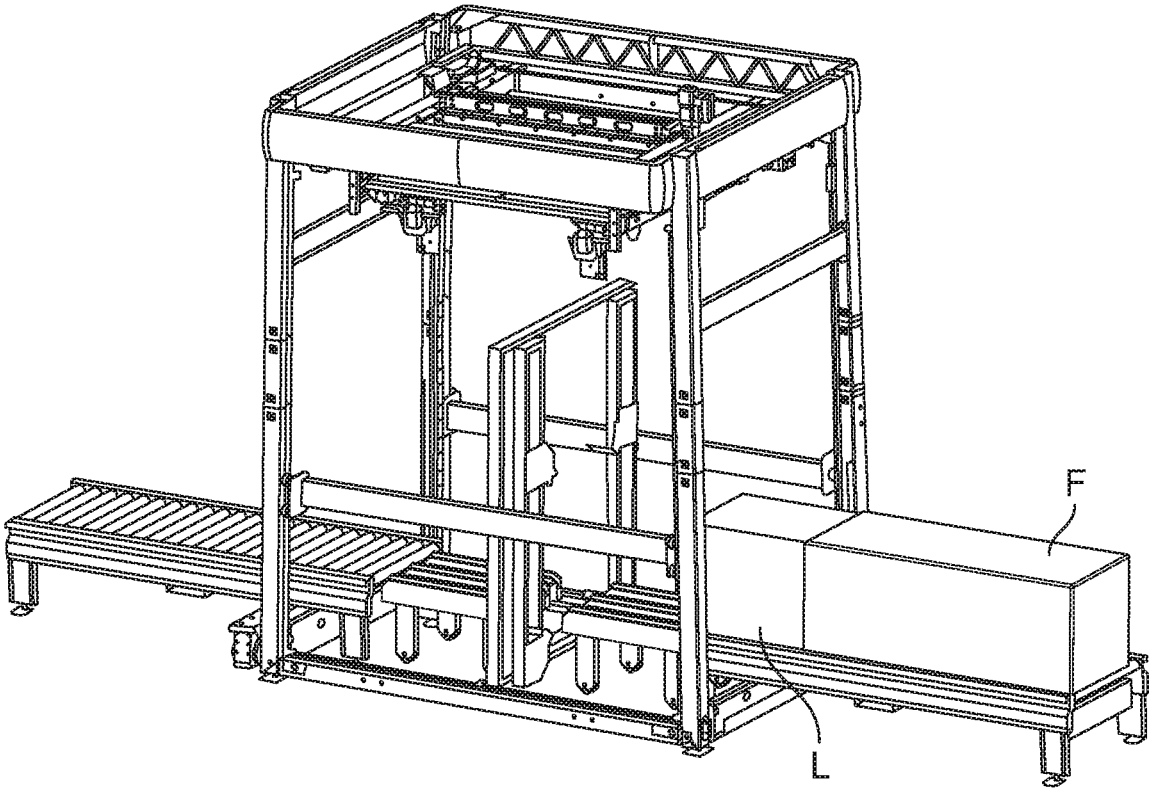
Figure 12:
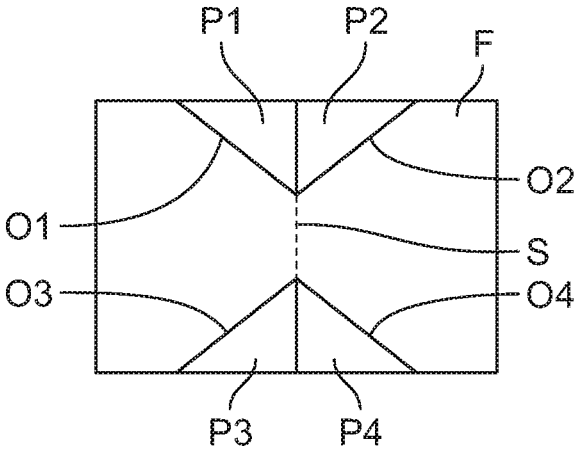
FIG. 12 is an end-on view of a load wrapped with a segment of tubular film such that the seam contacts the load.

The controller 500 then controls the reefing-device actuators 1460 to move downward toward the (now) bottom of the wrapping carriage 1410, as shown in FIG. 11B. The controller 500 controls the wrapping-carriage-mount actuator 1405*a* to continue to move the wrapping-carriage mount 1405 (and the wrapping carriage 1410 thereon) downward until the segment of tubular stretch film F is positioned adjacent the load L, as shown in FIG. 11C. The controller 500 controls the conveyor assembly 100 (by controlling the infeed-conveyor actuator 110*a*) to move the load L in the downstream direction D and into the (top of the) segment of tubular stretch film F, as shown in FIG. 11D. As this occurs, the end face of the load L contacts the seam S. As shown in FIG. 11E, continued movement of the load L in the downstream direction D (via the infeed and outfeed conveyors 110 and 140) coupled with unreefing of the segment of tubular stretch film F from the reefing fingers (as described above) applies the segment of tubular stretch film F to the load L, and the seam S is contained inside the applied segment of tubular stretch film F. FIG. 12 shows an end-on view of the wrapped load L with the seam S in dotted lines. Applying the segment of tubular stretch film F in this way results in four triangular pockets P1-P4 being formed. The openings O1-O4 of these pockets are oriented at a 45-degree angle such that any water or debris flows out of (and is therefore not collected in) the pockets.

In other embodiments, the controller 500 is configured to control the rotational position of the wrapping carriage 1410 and the rate of unreefing (or the rate the conveying system moves the load) so reinforced zones (sometimes referred to as bands or belts) that have a relatively high concentration of film are formed during film application. For instance, the controller 500 may rotate the wrapping carriage 1410 to a position between the first and second or first and third rotational positions such that the wrapping carriage is not perpendicular to the downstream and upstream directions. By doing this and by temporarily increasing the rate of unreefing and/or decreasing the rate of movement of the load L a reinforcing zone is formed in the segment of tubular stretch film. These reinforcing zones provide additional reinforcement to help the load L maintain its shape.

Described below and shown in FIGS. 13A-39C are several methods of applying two segments of tubular film to various different types of loads. The thicknesses, the lengths of the seams, and other aspects of the segments of tubular film shown in the Figures are exaggerated for clarity and ease of explanation. Occasionally segments of tubular film are shown as being spaced from one another and/or from the load after application for clarity and ease of explanation. This spacing in fact does not exist after application of the film, as the inherent properties of the film cause it to contract against and confirm to the load and/or to a previously applied segment of tubular film.

Figure 13A:
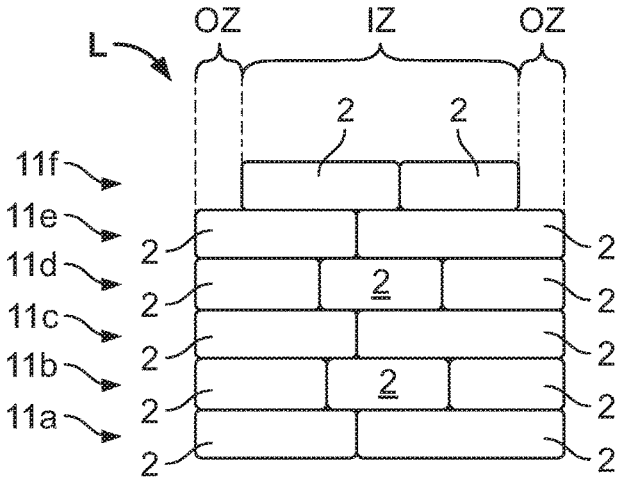
FIGS. 13A and 13B are side views of an example load.
Figure 13B:
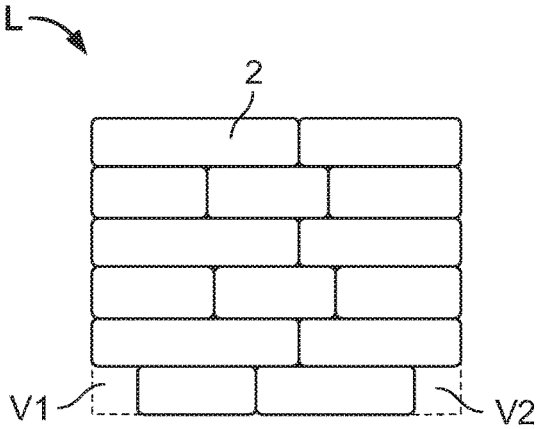

FIGS. 13A-13B show one example embodiment of a load L. Various methods for wrapping this load L without using a pallet are described below with reference to FIGS. 14A-19C. Some of these methods may be carried out by the wrapping system 50 described above. Some of these methods may be carried out by the wrapping system 50 described above in conjunction with one or more prior art machines configured to rotate the load about a horizontal and/or a vertical axis (depending on the method). Some of these methods may be carried out by a new system that includes prior art prior art purely horizontal and/or purely vertical stretch-hood machines in conjunction with one or more prior art machines configured to rotate the load about a horizontal and/or a vertical axis (depending on the method) programmed or otherwise configured to carry out these new methods. The load L—which is shown in a first orientation in FIG. 13A and a second orientation in FIG. 13B—is formed from components 2 (such as goods) stacked atop one another in several rows 11*a*-11*f*. When in its second orientation the load L is rotated 180 degrees about a horizontal axis from its first orientation. In this example embodiment, the components 2 are stacked in a brickwork pattern and form the six rows 11*a*-11*f* (though any suitable pattern and any suitable quantity of rows may be used). One of the (exterior) rows 11*f* is narrower than the others and centered relative to the other rows 11*a*-11*e* in the width direction such that an inner zone IZ of the load L—which is formed from all six of the rows 11*a*-11*e* of the components 2—has a height greater than two outer zones OZ of the load L—which are formed from five of the six rows 11*a*-11*e* of the components 2—that flank the inner zone IZ. When the load L is in its second orientation (as shown in FIG. 13B), the fact that the row 11*f* is narrower than the other rows 11*a*-11*e* results in two voids V1 and V2 being formed below the outer zones OZ and on either side of the inner zone IZ. This voids V1 and V2 (and the narrower row) are sized to receive the tines of a forklift (or other lifting device) to enable the load L to be transported after wrapping.

Figure 14A:
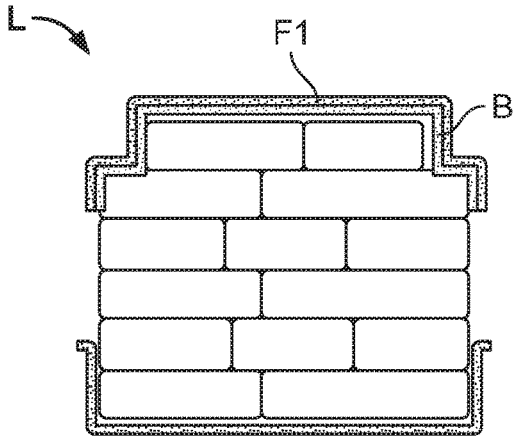
FIGS. 14A-14C are side views showing an example method of wrapping a load in two segments of tubular film and a base sheet in which the segments of tubular film and the base sheet are shown in cross-section.
Figure 14B:
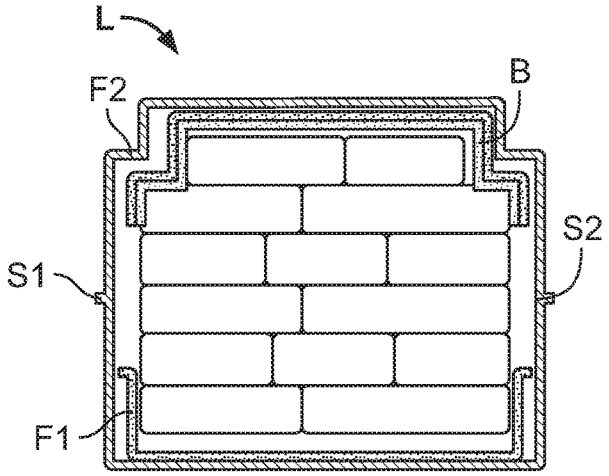
Figure 14C:
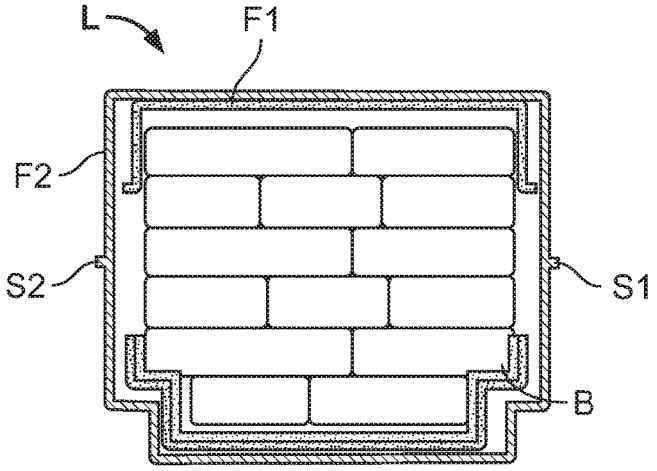

FIGS. 14A-14C show one method of wrapping the load L. As shown in FIG. 14A, with the load L in its first orientation, a flexible base sheet B is applied to the top of the load L. The base sheet increases the durability of the wrapped load by acting as a reinforcing layer for the portions of the film surrounding the voids that receive the forklift (or other suitable lifting device) tines. As also shown in FIG. 14A, a first segment of tubular stretch film F1 is horizontally applied to the load L over the base sheet B. The ends of the first segment of tubular stretch film F1 are not sealed closed. As shown in FIG. 14B, with the load L still in its first orientation a second segment of tubular stretch film F2 is horizontally applied to the load L over the first segment of tubular stretch film F1. The ends of the second segment of tubular stretch film F2 are sealed closed at seams S1 and S2. At this point all sides of the load L are enclosed in film. As shown in FIG. 14C, the (wrapped) load L is turned to its second orientation such that a forklift (or other suitable lifting device) can transport the load L.

Figure 15A:
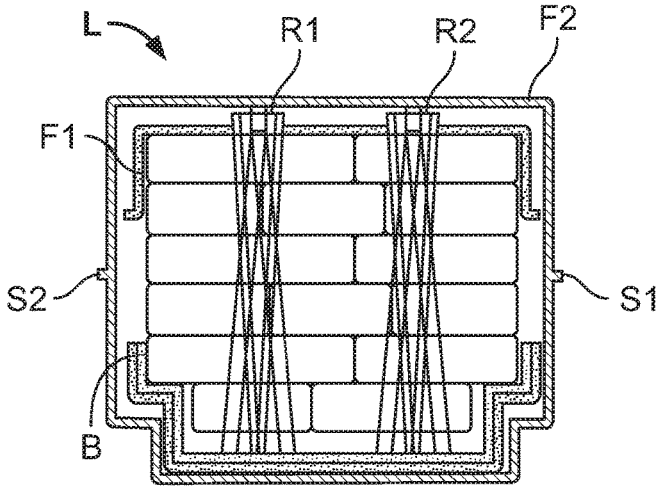
FIGS. 15A-15C are side views showing variations of the method shown in FIGS. 14A-14C in which one or more reinforced areas are formed in a segment of tubular film.
Figure 15B:
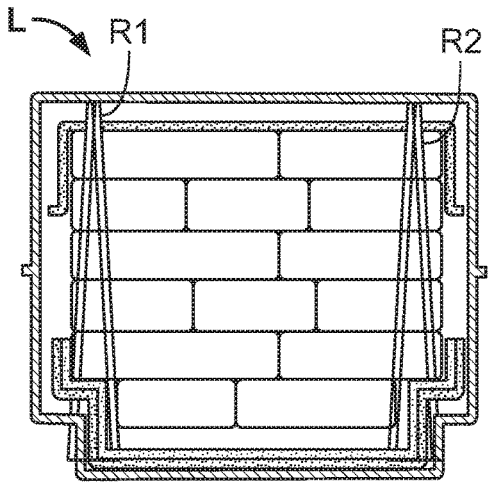
Figure 15C:
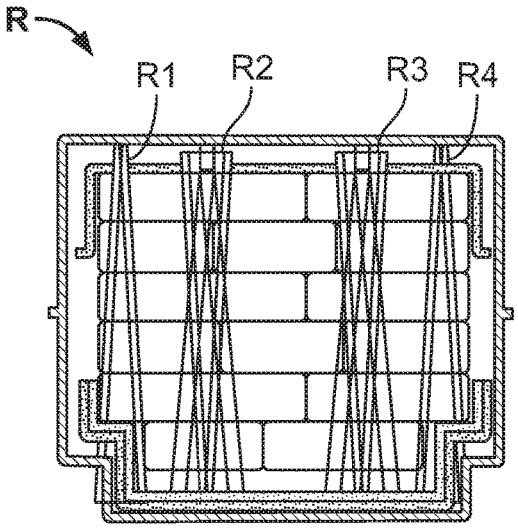

FIGS. 15A-15C show three variations of the wrapping method shown in FIGS. 14A-14C in which one or more reinforcing zones (described above) are formed in either the first or second segments of tubular stretch film during wrapping by temporarily increasing the rate of unreefing and/or decreasing the rate of movement of the load L. These reinforcing zones reinforce and further stabilize the load L. FIG. 15A shows two reinforcing zones R1 and R2 formed by the first segment of tubular stretch film F1 (though one or both could be formed by the second segment of tubular stretch film F2) and circumscribing the inner zone IZ of the load L. FIG. 15B shows two reinforcing zones R1 and R2 formed by the first segment of tubular stretch film F1 (though one or both could be formed by the second segment of tubular stretch film F2). Each reinforcing zone R1 and R2 circumscribes one of the outer zones OZ of the load L. FIG. 15C shows four reinforcing zones R1, R2, R3, and R4 formed by the first segment of tubular stretch film F1 (though one or more could be formed by the second segment of tubular stretch film F2). Each reinforcing zone R1 and R4 circumscribes one of the outer zones OZ of the load L, and the reinforcing zones R2 and R2 circumscribe the inner zone IZ of the load L.

Figure 16A:
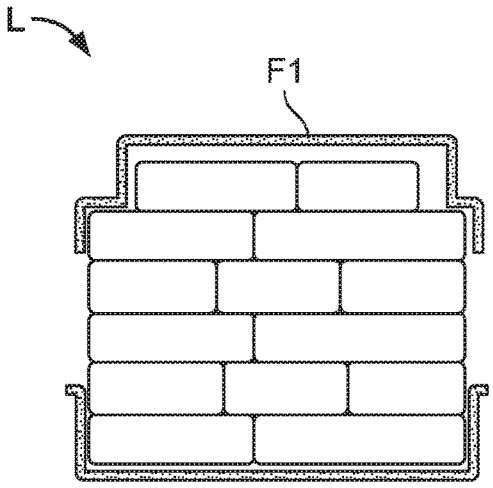
FIGS. 16A-16C are side views showing an example method of wrapping a load in two segments of tubular film in which the segments of tubular film are shown in cross-section.
Figure 16B:
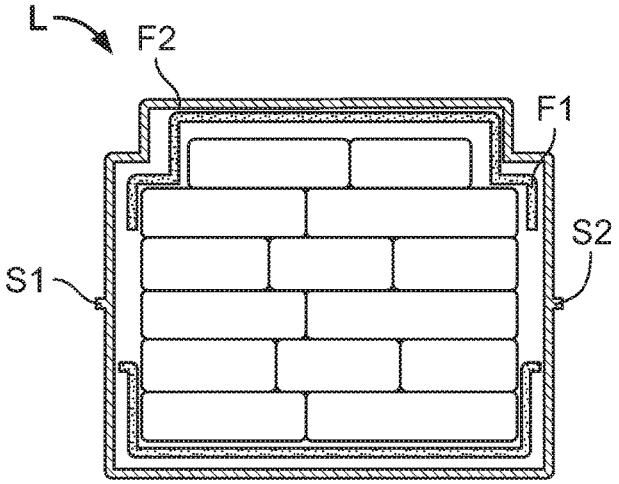
Figure 16C:
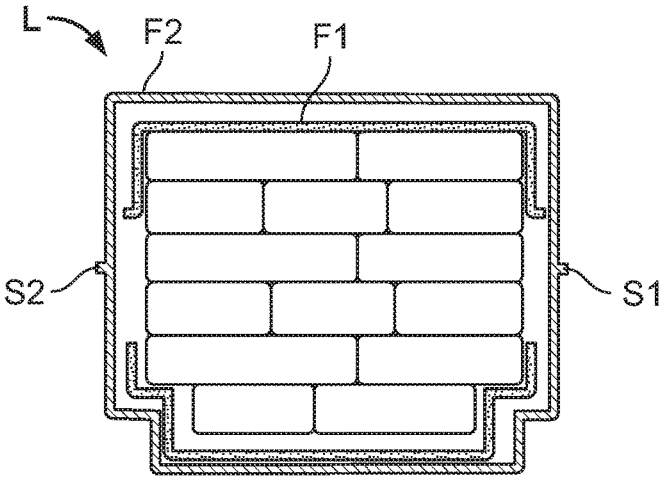
Figure 17A:
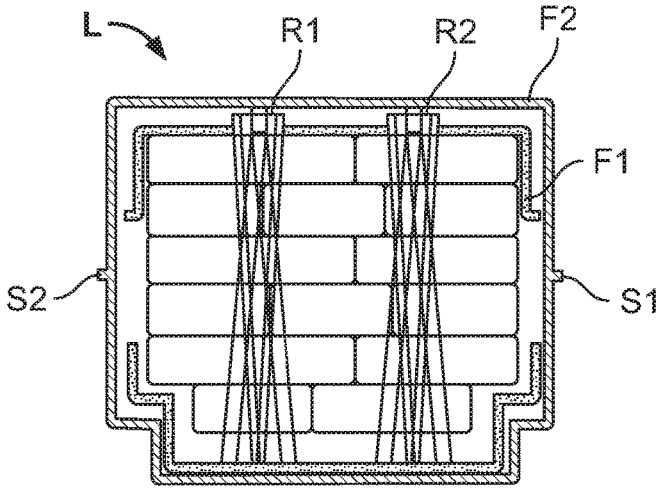
FIGS. 17A-17C are side views showing variations of the method shown in FIGS. 16A-16C in which one or more reinforced areas are formed in a segment of tubular film.
Figure 17B:
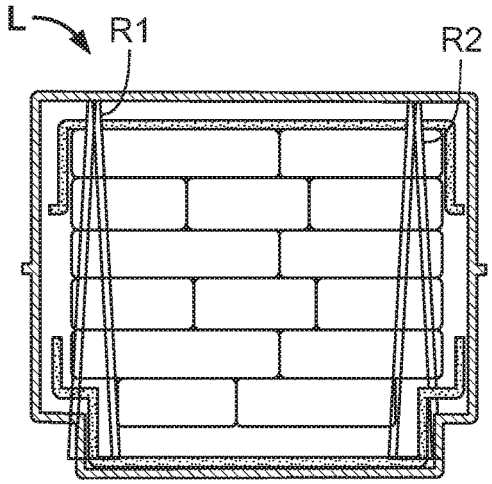
Figure 17C:
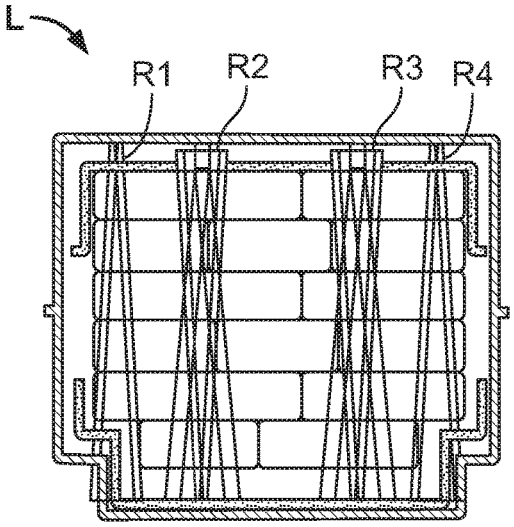

FIGS. 16A-16C show another method of wrapping the load L that is the same as the method shown in FIGS. 14A-14C and described above except that the base sheet is not used. FIGS. 17A-17C show three variations of the wrapping method shown in FIGS. 16A-16C in which one or more reinforcing zones are formed in either the first or second segments of tubular stretch film during wrapping. FIG. 17A shows two reinforcing zones R1 and R2 formed by the first segment of tubular stretch film F1 (though one or both could be formed by the second segment of tubular stretch film F2) and circumscribing the inner zone IZ of the load L. FIG. 17B shows two reinforcing zones R1 and R2 formed by the first segment of tubular stretch film F1 (though one or both could be formed by the second segment of tubular stretch film F2). Each reinforcing zone R1 and R2 circumscribes one of the outer zones OZ of the load L. FIG. 17C shows four reinforcing zones R1, R2, R3, and R4 formed by the first segment of tubular stretch film F1 (though one or more could be formed by the second segment of tubular stretch film F2). Each reinforcing zone R1 and R4 circumscribes one of the outer zones OZ of the load L, and the reinforcing zones R2 and R2 circumscribe the inner zone IZ of the load L.

Figure 18A:
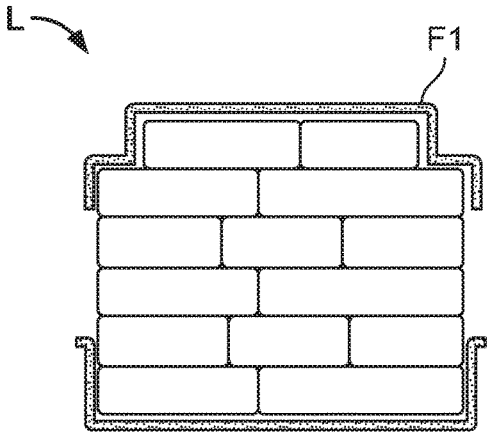
FIGS. 18A-18C are side views showing another example method of wrapping a load in two segments of tubular film in which the segments of tubular film are shown in cross-section.
Figure 18B:
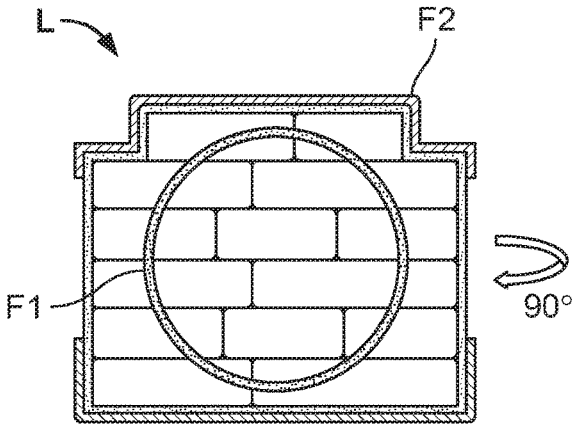
Figure 18C:
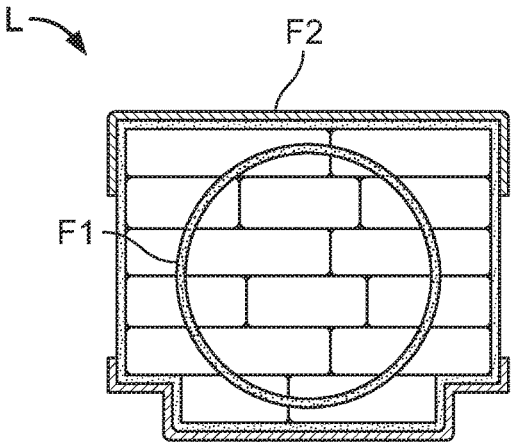

FIGS. 18A-18C show another method of wrapping the load L. As shown in FIG. 18A, with the load L in its first orientation, a first segment of tubular stretch film F1 is horizontally applied to the load L. The ends of the first segment of tubular stretch film F1 are not sealed closed. As shown in FIG. 18B, with the load L still in its first orientation the load L is rotated about a vertical axis and, afterwards, a second segment of tubular stretch film F2 is horizontally applied to the load L over the first segment of tubular stretch film F1. The ends of the second segment of tubular stretch film F2 are not sealed closed, but because the load L was rotated at this point all sides of the load L are enclosed in film. As shown in FIG. 18C, the (wrapped) load L is now turned to its second orientation such that a forklift (or other suitable lifting device) can transport the load L.

Figure 19A:
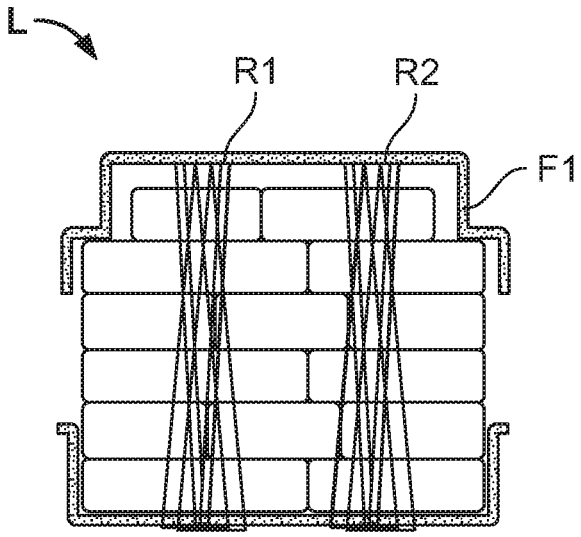
FIGS. 19A-19C are side views showing variations of the method shown in FIGS. 18A-18C in which one or more reinforced areas are formed in a segment of tubular film.
Figure 19B:
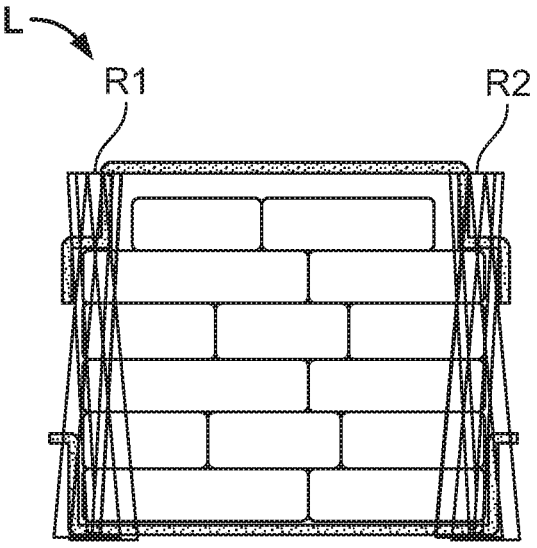
Figure 19C:
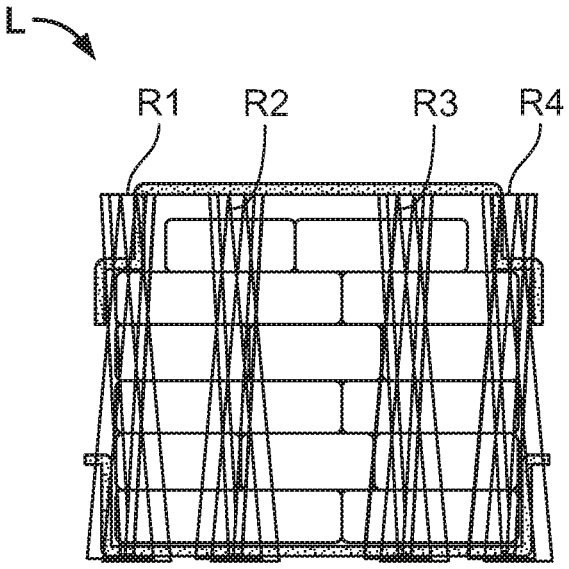

FIGS. 19A-19C show three variations of the wrapping method shown in FIGS. 18A-18C in which one or more reinforcing zones are formed in the first segment of tubular stretch film during wrapping. FIG. 19A shows two reinforcing zones R1 and R2 formed by the first segment of tubular stretch film F1 (though one or both could be formed by the second segment of tubular stretch film F2) and circumscribing the inner zone IZ of the load L. FIG. 19B shows two reinforcing zones R1 and R2 formed by the first segment of tubular stretch film F1 (though one or both could be formed by the second segment of tubular stretch film F2). Each reinforcing zone R1 and R2 circumscribes one of the outer zones OZ of the load L. FIG. 19C shows four reinforcing zones R1, R2, R3, and R4 formed by the first segment of tubular stretch film F1 (though one or more could be formed by the second segment of tubular stretch film F2). Each reinforcing zone R1 and R4 circumscribes one of the outer zones OZ of the load L, and the reinforcing zones R2 and R2 circumscribe the inner zone IZ of the load L.

Although not shown, in certain embodiments the load may be formed in its second orientation. In these example embodiments the methods proceed as described above, but the final turning step is not required because the load is already in its second orientation.

Various methods for wrapping another load L—which has component rows of equal width—are now described with reference to FIGS. 20A-28. The load L is positioned on a slip sheet SH after wrapping. The slip sheet SH enables a forklift (or other suitable lifting device) to transport the load L after wrapping.

Figure 20A:
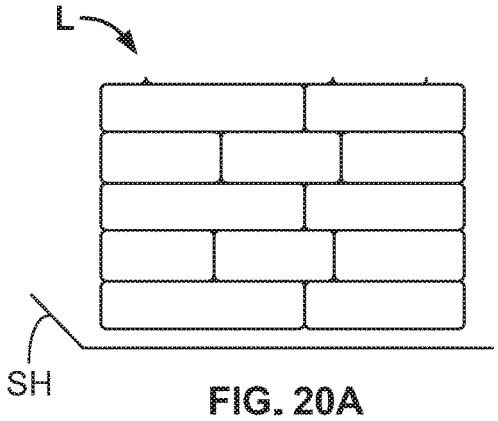
FIGS. 20A-20C are side views showing another example method of wrapping a load in two segments of tubular film in which the segments of tubular film are shown in cross-section.
Figure 20B:
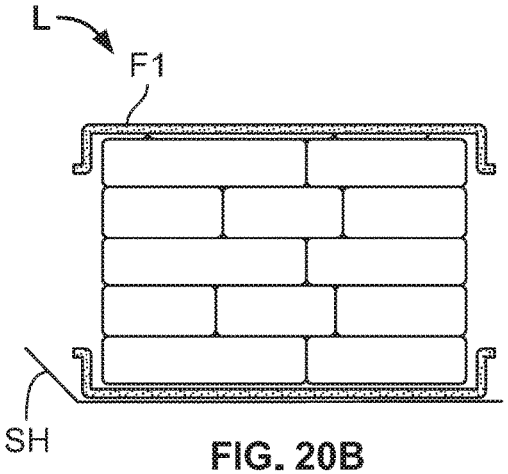
Figure 20C:
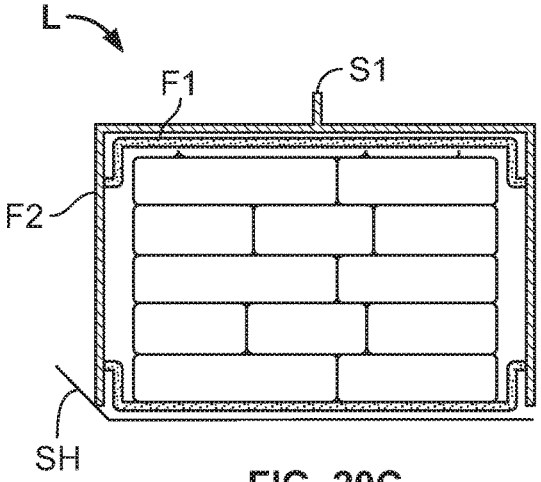
Figure 21:
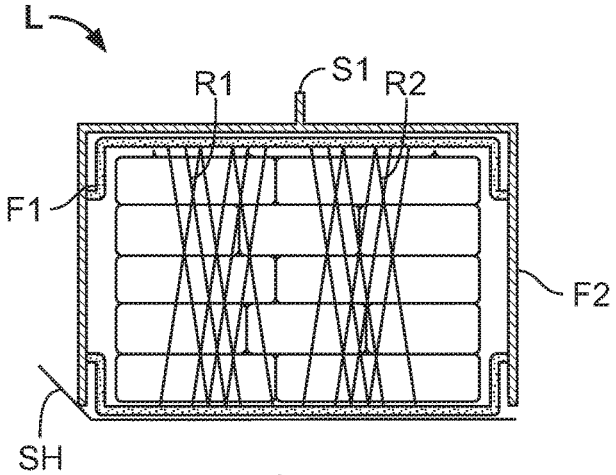
FIG. 21 is a side view showing a variation of the method shown in FIGS. 20A-20C in which one or more reinforced areas are formed in a segment of tubular film.

FIGS. 20A-20C show one method of wrapping the load L. As shown in FIG. 20B, a first segment of tubular stretch film F1 is horizontally applied to the load L. The ends of the first segment of tubular stretch film F1 are not sealed closed. As shown in FIG. 20C, a second segment of tubular stretch film F2 is vertically applied to the load L over the first segment of tubular stretch film F1. The upper end of the second segment of tubular stretch film F2 is sealed closed at seam S1 such that all sides of the load L are enclosed in film. FIG. 21 shows a variation of this method in which two reinforcing zones R1 and R2 (though any suitable quantity may be formed) are formed in the first segment of tubular stretch film F1 during wrapping.

Figure 22A:
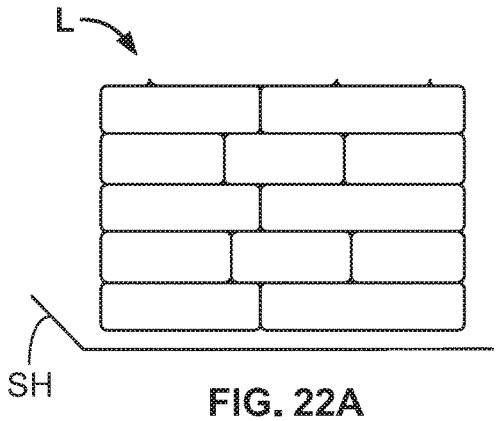
FIGS. 22A-22C are side views showing another example method of wrapping a load in two segments of tubular film in which the segments of tubular film are shown in cross-section.
Figure 22B:
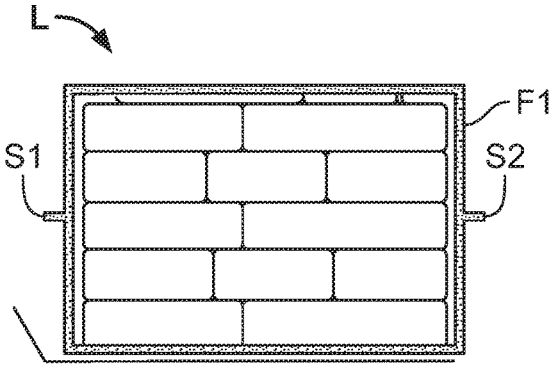
Figure 22C:
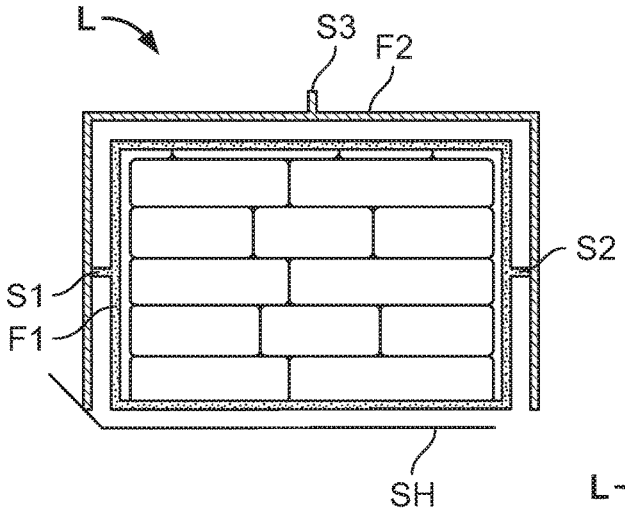
Figure 23:
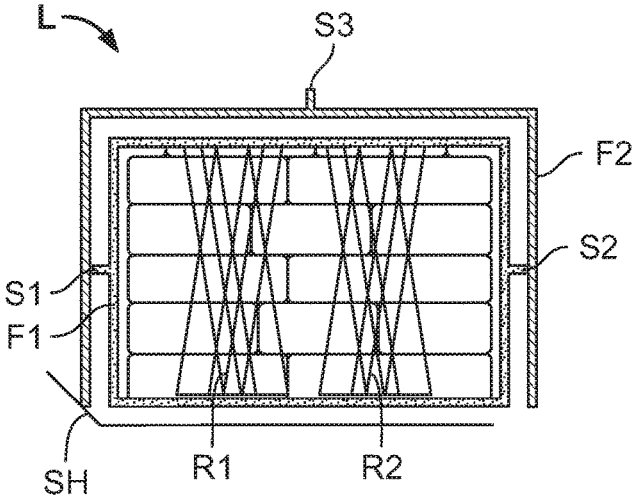
FIG. 23 is a side view showing a variation of the method shown in FIGS. 22A-22C in which one or more reinforced areas are formed in a segment of tubular film.

FIGS. 22A-22C show another method of wrapping the load L. As shown in FIG. 22B, a first segment of tubular stretch film F1 is horizontally applied to the load L. The ends of the first segment of tubular stretch film F1 are sealed closed at seams S1 and S2. At this point all sides of the load L are enclosed in film. As shown in FIG. 22C, a second segment of tubular stretch film F2 is vertically applied to the load L over the first segment of tubular stretch film F1. The upper end of the second segment of tubular stretch film F2 is sealed closed at seam S3. FIG. 23 shows a variation of this method in which two reinforcing zones R1 and R2 (though any suitable quantity may be formed) are formed in the first segment of tubular stretch film F1 during wrapping.

Figure 24A:
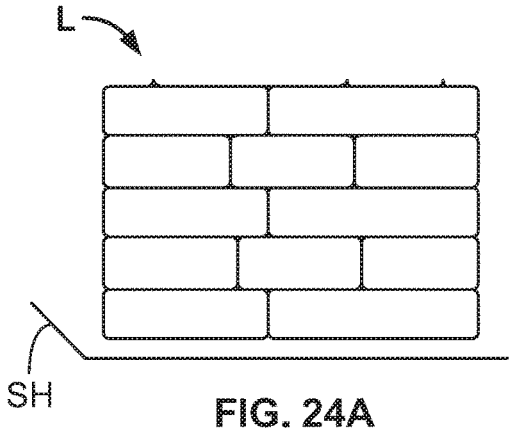
FIGS. 24A-24C are side views showing another example method of wrapping a load in two segments of tubular film in which the segments of tubular film are shown in cross-section.
Figure 24B:
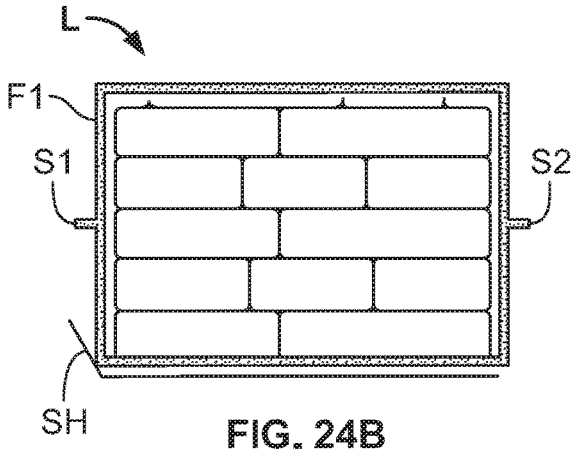
Figure 24C:
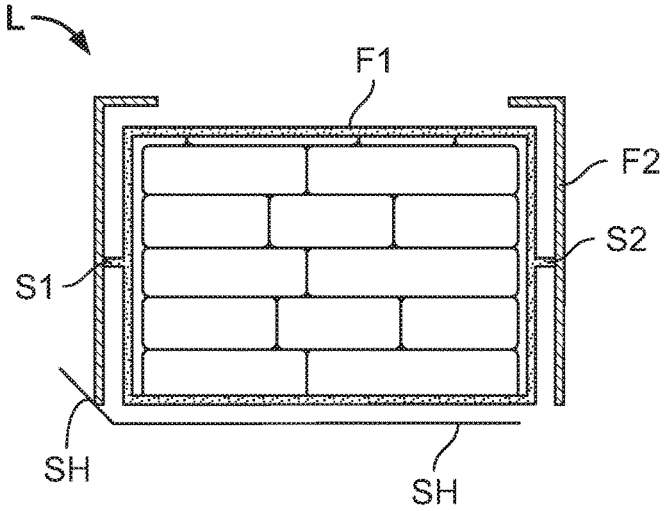

FIGS. 24A-24C show another method of wrapping the load L. As shown in FIG. 24B, a first segment of tubular stretch film F1 is horizontally applied to the load L. The ends of the first segment of tubular stretch film F1 are sealed closed at seams S1 and S2. At this point all sides of the load L are enclosed in film. As shown in FIG. 24C, a second segment of tubular stretch film F2 is vertically applied to the load L over the first segment of tubular stretch film F1. The upper end of the second segment of tubular stretch film F2 is not sealed closed. In one variation of this method (not shown), one or more reinforcing zones are formed in the first segment of tubular stretch film F1 during wrapping.

Figure 25A:
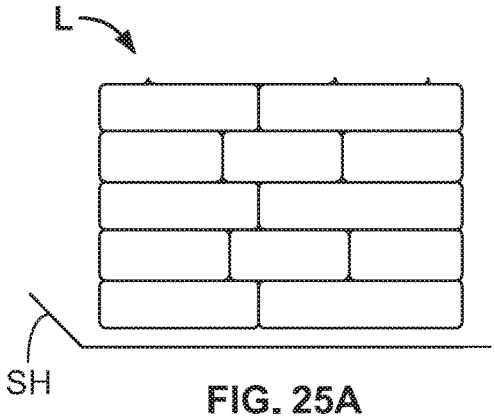
FIGS. 25A-25C are side views showing another example method of wrapping a load in two segments of tubular film in which the segments of tubular film are shown in cross-section.
Figure 25B:
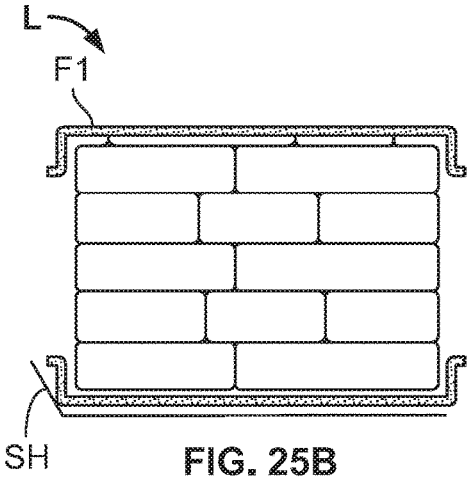
Figure 25C:
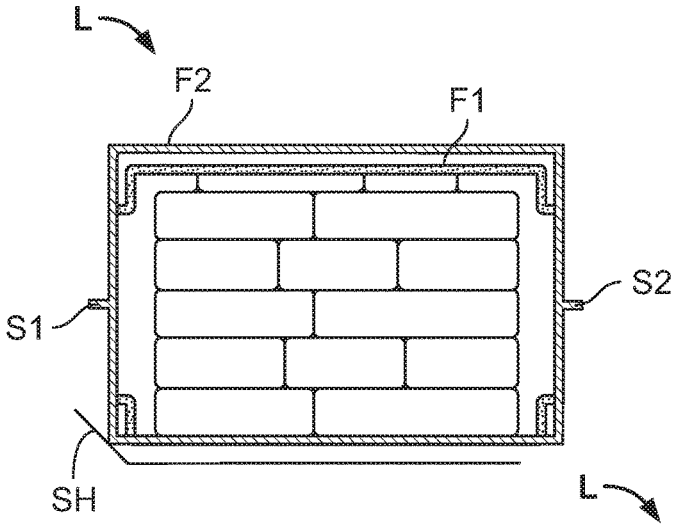
Figure 26:
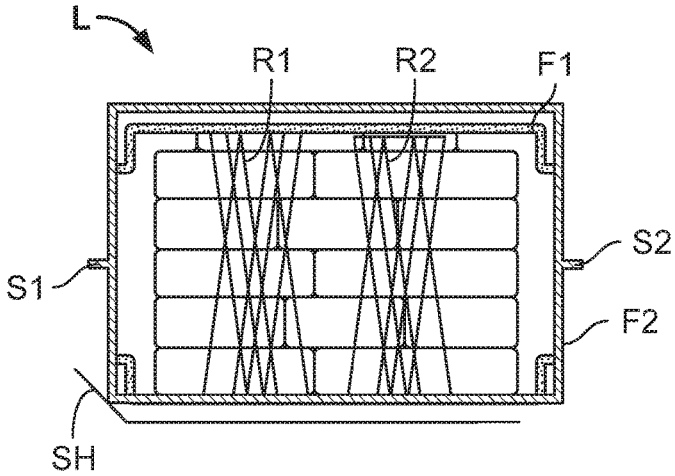
FIG. 26 is a side view showing a variation of the method shown in FIGS. 25A-25C in which one or more reinforced areas are formed in a segment of tubular film.

FIGS. 25A-25C show another method of wrapping the load L. As shown in FIG. 25B, a first segment of tubular stretch film F1 is horizontally applied to the load L. The ends of the first segment of tubular stretch film F1 are not sealed closed. As shown in FIG. 25C, a second segment of tubular stretch film F2 is horizontally applied to the load L over the first segment of tubular stretch film F1. The ends of the second segment of tubular stretch film F2 are sealed closed at seams S1 and S2. At this point all sides of the load L are enclosed in film. FIG. 26 shows a variation of this method in which two reinforcing zones R1 and R2 (though any suitable quantity of reinforcing zones may be formed) are formed in the first segment of tubular stretch film F1 during wrapping (though one or more of the reinforcing zones may be formed in the second segment of tubular stretch film F2).

Figure 27A:
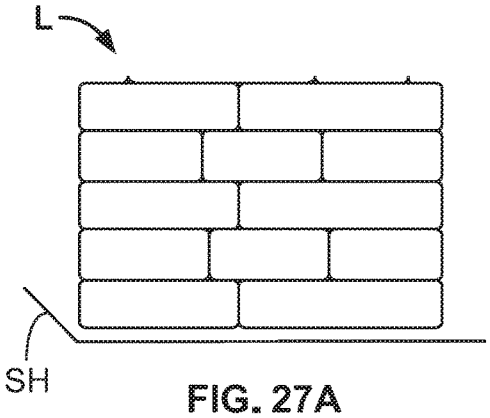
FIGS. 27A-27C are side views showing another example method of wrapping a load in two segments of tubular film in which the segments of tubular film are shown in cross-section.
Figure 27B:
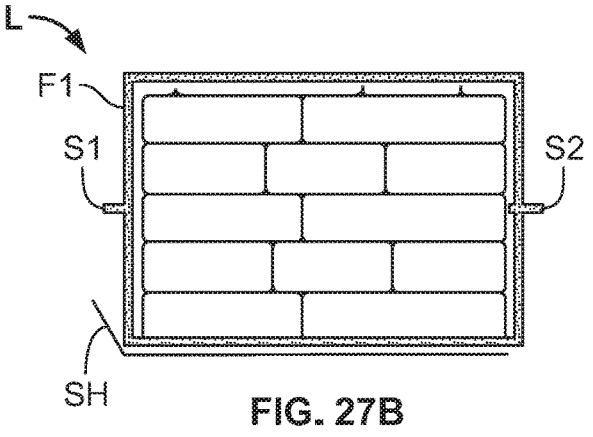
Figure 27C:
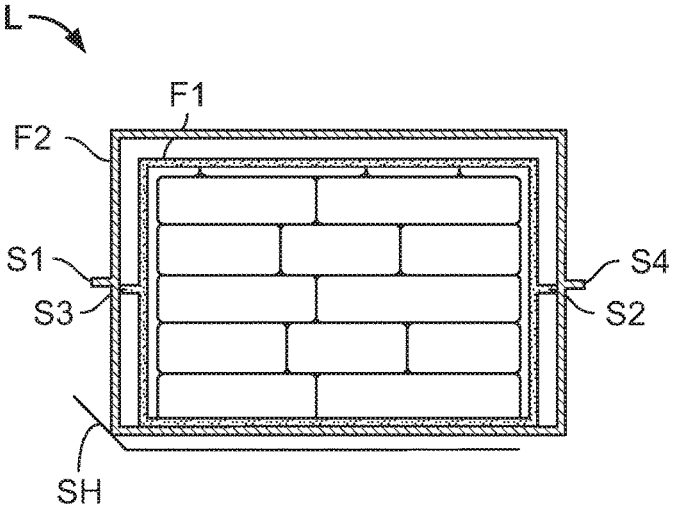
Figure 28:
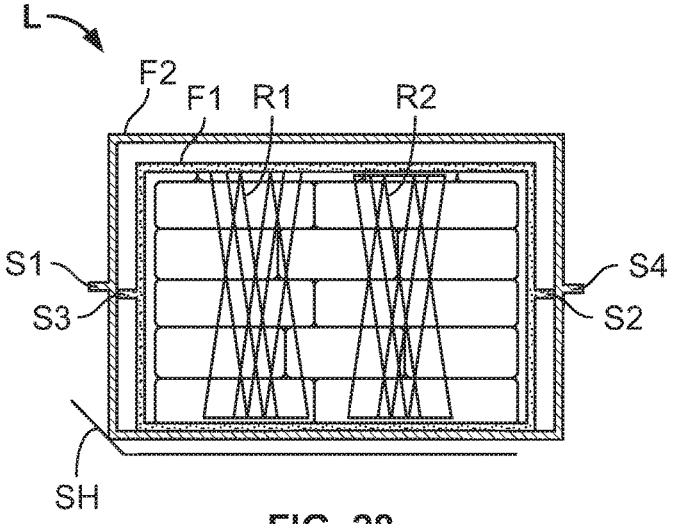
FIG. 28 is a side view showing a variation of the method shown in FIGS. 27A-27C in which one or more reinforced areas are formed in a segment of tubular film.

FIGS. 27A-27C show another method of wrapping the load L. As shown in FIG. 27B, a first segment of tubular stretch film F1 is horizontally applied to the load L. The ends of the first segment of tubular stretch film F1 are sealed closed at seams S1 and S2. At this point all sides of the load L are enclosed in film. As shown in FIG. 27C, a second segment of tubular stretch film F2 is horizontally applied to the load L over the first segment of tubular stretch film F1. The ends of the second segment of tubular stretch film F2 are sealed closed at seams S3 and S4. FIG. 28 shows a variation of this method in which two reinforcing zones R1 and R2 (though any suitable quantity of reinforcing zones may be formed) are formed in the first segment of tubular stretch film F1 during wrapping (though one or more of the reinforcing zones may be formed in the second segment of tubular stretch film F2).

Various methods for wrapping another load L are now described with reference to FIGS. 29A-39C. In these example embodiments, the differently sized external row of components of the load L is the inverse of that same row in the load L shown in FIGS. 13A and 13B. This causes the two outer zones OZ to have a height greater than the inner zone IZ. Additionally, when the load L is in its second orientation (as shown, for instance, in FIG. 29D) a void V3 is formed below the inner sone IZ and between the outer zones OZ. This void V3 is sized to receive the tines of a forklift (or other suitable lifting device) to enable the load L to be transported after wrapping.

Figure 29A:
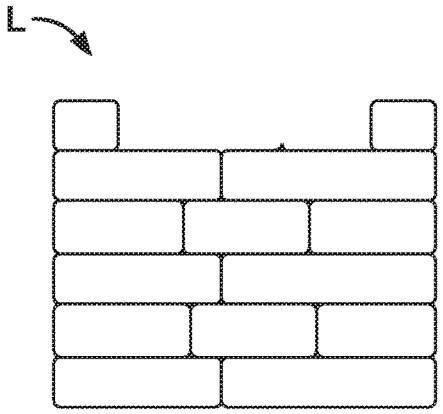
FIGS. 29A-29D are side views showing another example method of wrapping a load in two segments of tubular film in which the segments of tubular film are shown in cross-section.
Figure 29B:
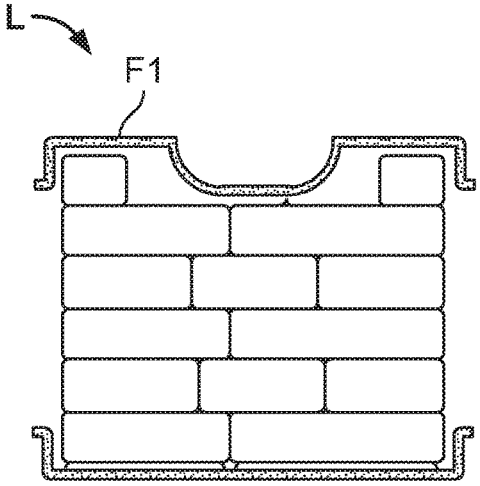
Figure 29C:
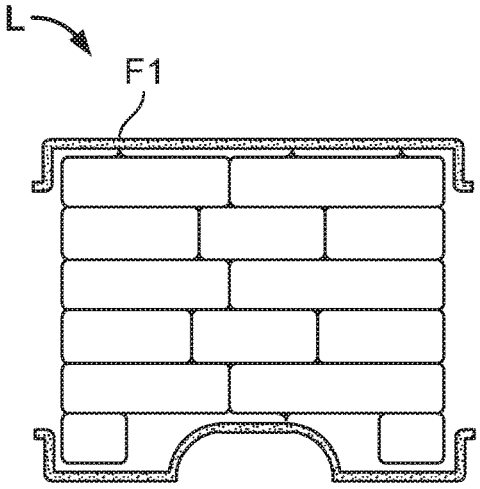
Figure 29D:
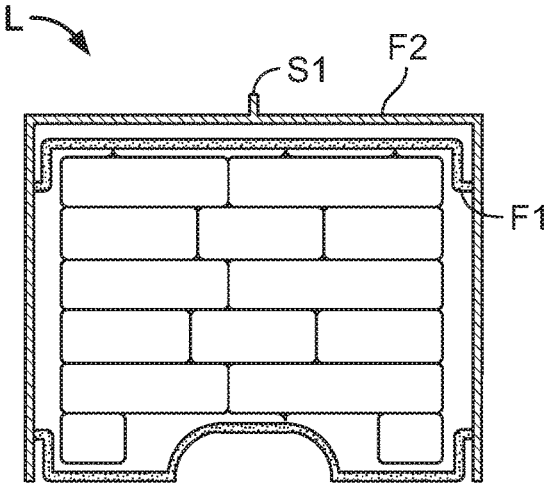

FIGS. 29A-29C show one method of wrapping the load L. As shown in FIG. 29B, with the load L in its first orientation, a first segment of tubular stretch film F1 is horizontally applied to the load L. The ends of the first segment of tubular stretch film F1 are not sealed closed. As shown in FIG. 29C, the load L is now turned to its second orientation. As shown in FIG. 29D, a second segment of tubular stretch film F2 is then vertically applied to the load L over the first segment of tubular stretch film F1. The upper end of the second segment of tubular stretch film F2 is sealed closed at seam S1. At this point all sides of the load L are enclosed in film. A forklift (or other suitable lifting device) can then transport the load L.

Figure 30A:
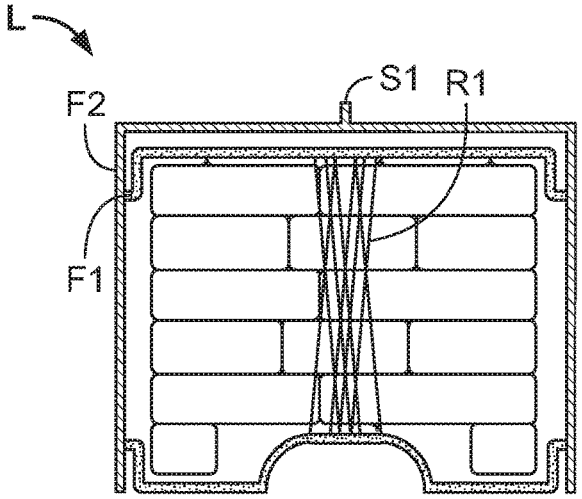
FIGS. 30A-30C are side views showing variations of the method shown in FIGS. 29A-29D in which one or more reinforced areas are formed in a segment of tubular film.
Figure 30B:
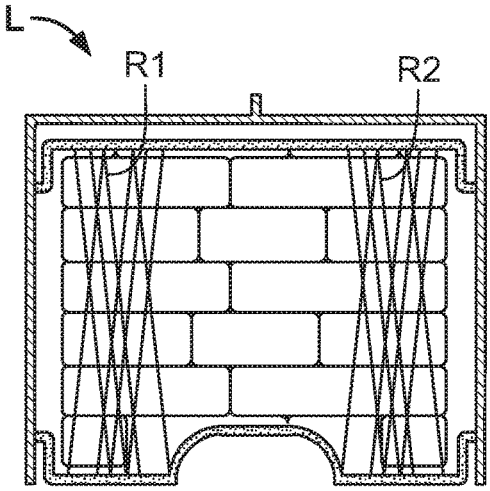
Figure 30C:
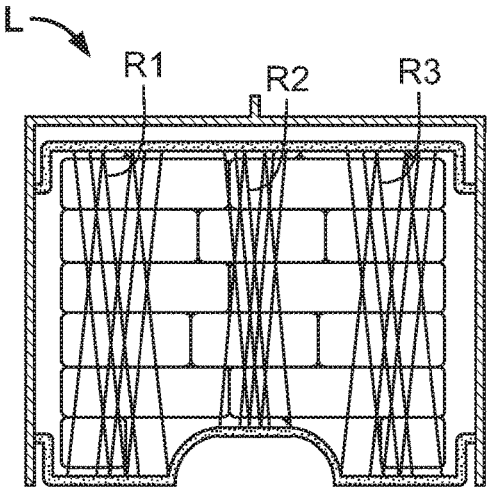

FIGS. 30A-30C show three variations of the wrapping method shown in FIGS. 29A-29C in which one or more reinforcing zones are formed in the first segment of tubular stretch film during wrapping. These reinforcing zones reinforce and further stabilize the load L. FIG. 30A shows a reinforcing zone R1 formed by the first segment of tubular stretch film F1 and circumscribing the inner zone IZ of the load L. FIG. 30B shows two reinforcing zones R1 and R2 formed by the first segment of tubular stretch film F1. Each reinforcing zone R1 and R2 circumscribes one of the outer zones OZ of the load L. FIG. 30C shows three reinforcing zones R1, R2, and R3 formed by the first segment of tubular stretch film F1. Each reinforcing zone R1 and R3 circumscribes one of the outer zones OZ of the load L, and the reinforcing zone R2 circumscribe the inner zone IZ of the load L.

Figure 31A:
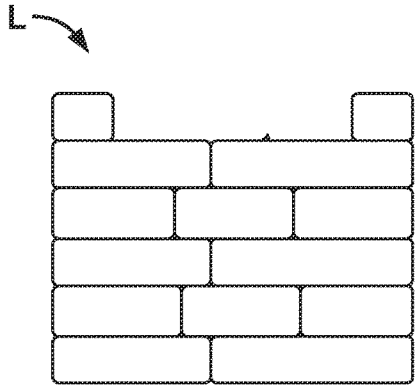
FIGS. 31A-31D are side views showing another example method of wrapping a load in two segments of tubular film in which the segments of tubular film are shown in cross-section.
Figure 31B:
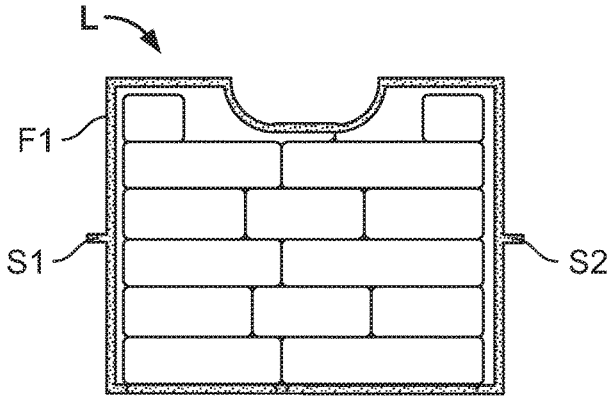
Figure 31C:
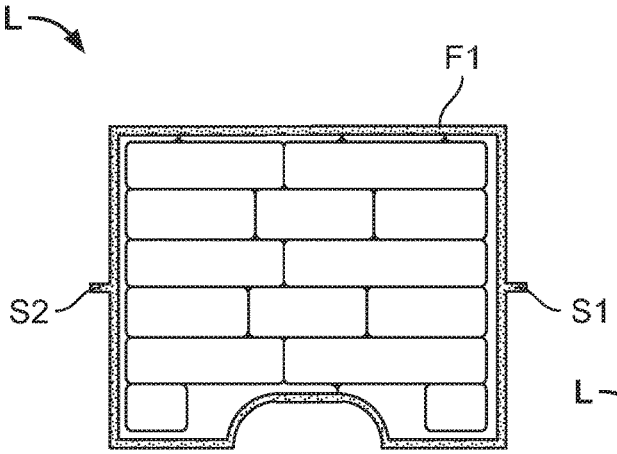
Figure 31D:
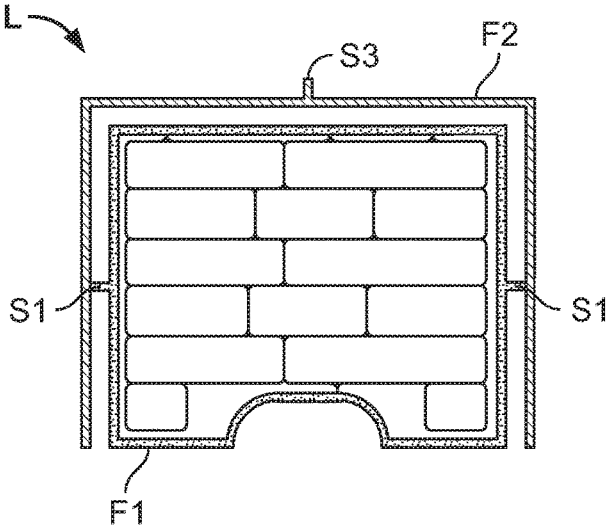

FIGS. 31A-31C show another method of wrapping the load L. As shown in FIG. 31B, with the load L in its first orientation, a first segment of tubular stretch film F1 is horizontally applied to the load L. The ends of the first segment of tubular stretch film F1 are sealed closed at seams S1 and S2. At this point all sides of the load L are enclosed in film. As shown in FIG. 31C, the load L is now turned to its second orientation. As shown in FIG. 31D, a second segment of tubular stretch film F2 is then vertically applied to the load L over the first segment of tubular stretch film F1. The upper end of the second segment of tubular stretch film F2 is sealed closed at seam S3. A forklift (or other suitable lifting device) can then transport the load L.

Figure 32A:
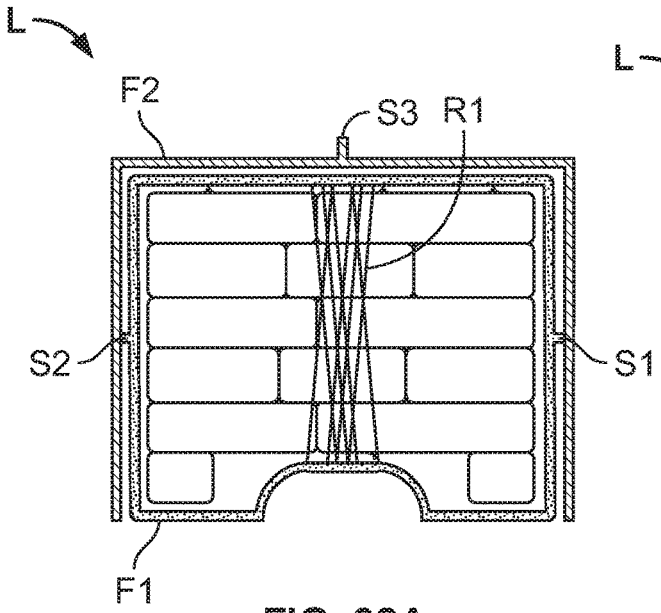
FIGS. 32A-32C are side views showing variations of the method shown in FIGS. 31A-31D in which one or more reinforced areas are formed in a segment of tubular film.
Figure 32B:
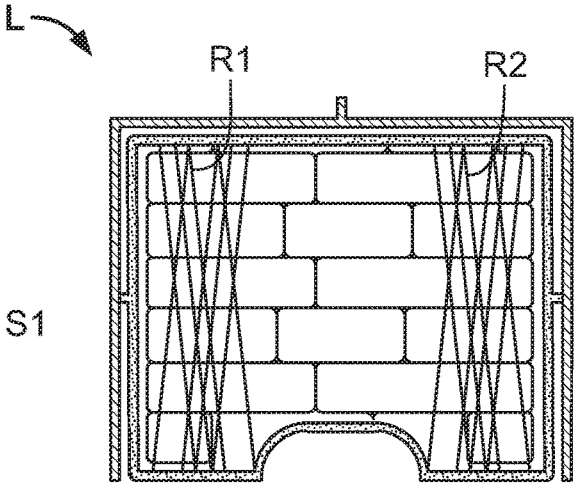
Figure 32C:
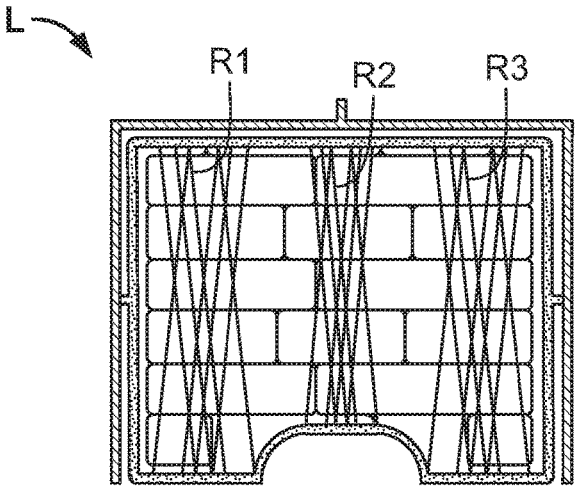

FIGS. 32A-32C show three variations of the wrapping method shown in FIGS. 31A-31C in which one or more reinforcing zones are formed in the first segment of tubular stretch film during wrapping. FIG. 32A shows a reinforcing zone R1 formed by the first segment of tubular stretch film F1 and circumscribing the inner zone IZ of the load L. FIG. 32B shows two reinforcing zones R1 and R2 formed by the first segment of tubular stretch film F1. Each reinforcing zone R1 and R2 circumscribes one of the outer zones OZ of the load L. FIG. 32C shows three reinforcing zones R1, R2, and R3 formed by the first segment of tubular stretch film F1. Each reinforcing zone R1 and R3 circumscribes one of the outer zones OZ of the load L, and the reinforcing zone R2 circumscribes the inner zone IZ of the load L.

Figure 33A:
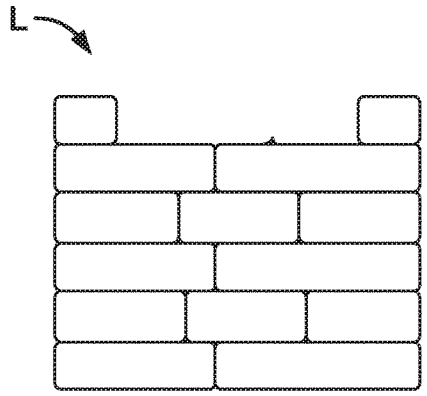
FIGS. 33A-33D are side views showing another example method of wrapping a load in two segments of tubular film in which the segments of tubular film are shown in cross-section.
Figure 33B:
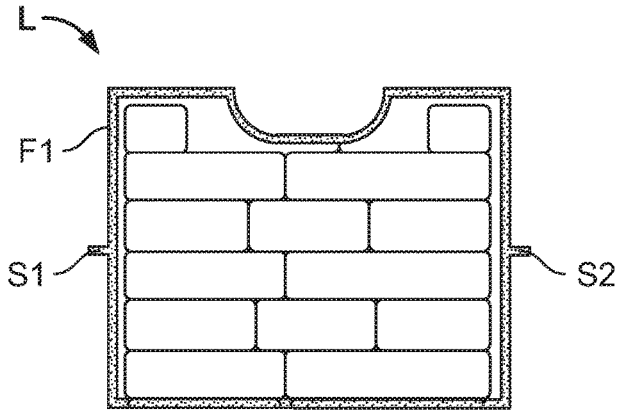
Figure 33C:
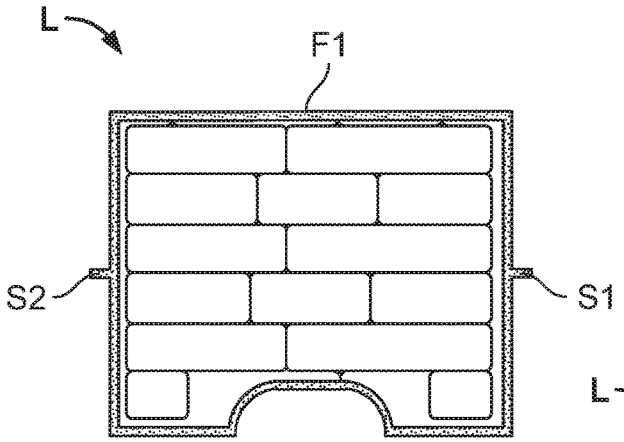
Figure 33D:
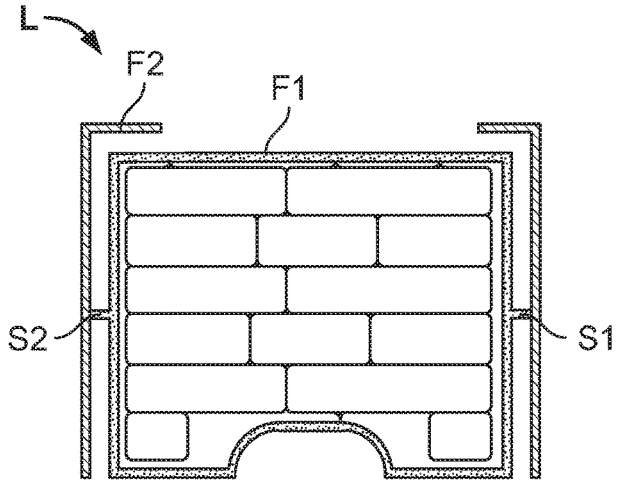

FIGS. 33A-33C show another method of wrapping the load L. As shown in FIG. 33B, with the load L in its first orientation, a first segment of tubular stretch film F1 is horizontally applied to the load L. The ends of the first segment of tubular stretch film F1 are sealed closed at seams S1 and S2. At this point all sides of the load L are enclosed in film. As shown in FIG. 33C, the load L is now turned to its second orientation. As shown in FIG. 33D, a second segment of tubular stretch film F2 is then vertically applied to the load L over the first segment of tubular stretch film F1. The upper end of the second segment of tubular stretch film F2 is not sealed closed. A forklift (or other suitable lifting device) can then transport the load L. In one variation of this method (not shown), one or more reinforcing zones are formed in the first segment of tubular stretch film F1 during wrapping.

Figure 34A:
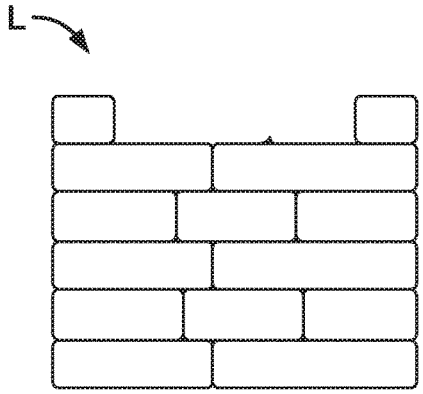
FIGS. 34A-34D are side views showing another example method of wrapping a load in two segments of tubular film in which the segments of tubular film are shown in cross-section.
Figure 34B:
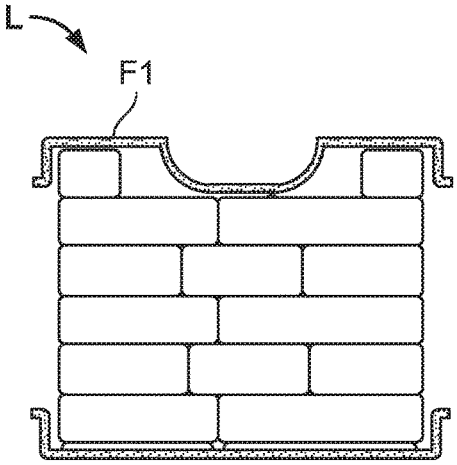
Figure 34C:
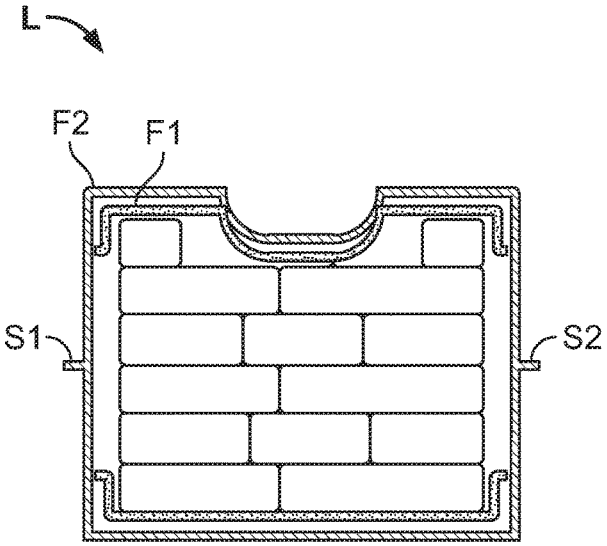
Figure 34D:
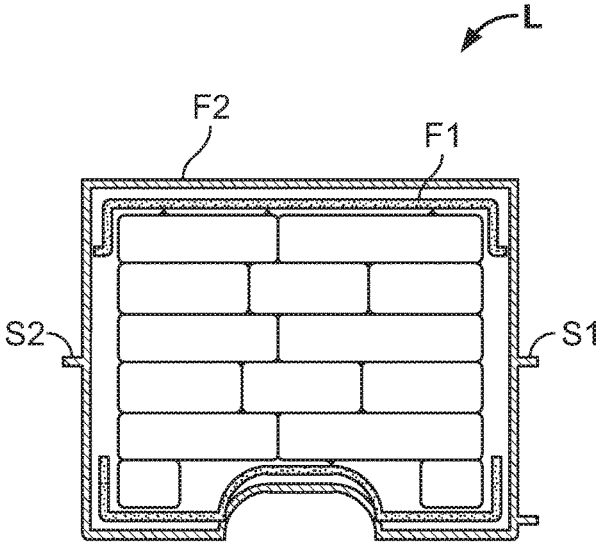

FIGS. 34A-34C show another method of wrapping the load L. As shown in FIG. 34B, with the load L in its first orientation, a first segment of tubular stretch film F1 is horizontally applied to the load L. The ends of the first segment of tubular stretch film F1 are not. As shown in FIG. 34C, a second segment of tubular stretch film F2 is horizontally applied to the load L over the first segment of tubular stretch film F1. The ends of the second segment of tubular stretch film F2 are sealed closed at seams S1 and S2. At this point all sides of the load L are enclosed in film. As shown in FIG. 34D, the load L is then turned to its second orientation such that a forklift (or other suitable lifting device) can then transport the load L.

Figure 35A:
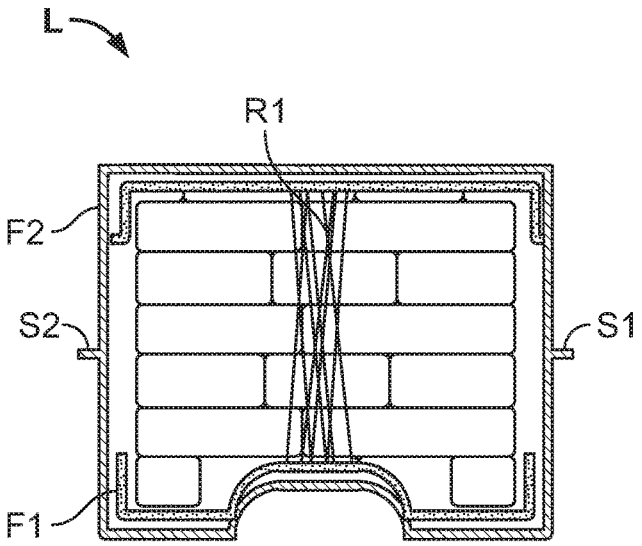
FIGS. 35A-35C are side views showing variations of the method shown in FIGS. 34A-34D in which one or more reinforced areas are formed in a segment of tubular film.
Figure 35B:
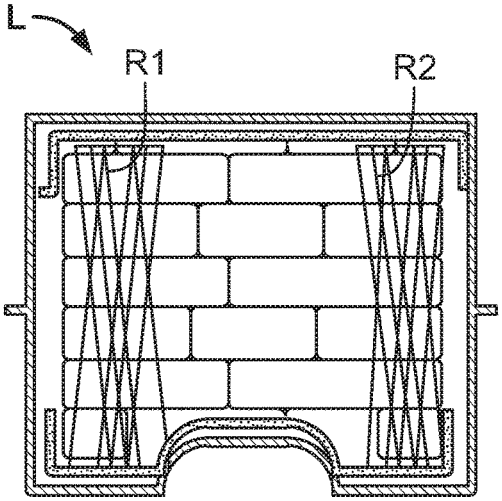
Figure 35C:
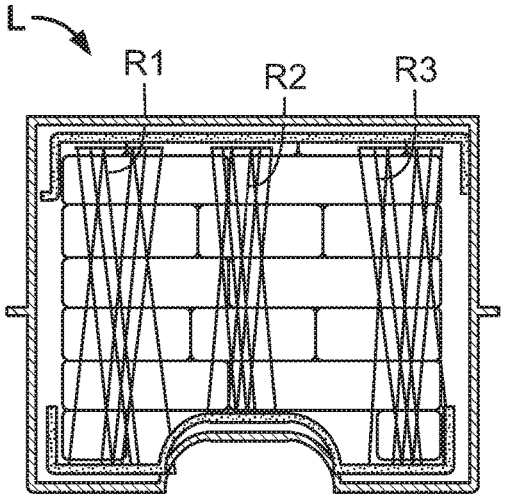

FIGS. 35A-35C show three variations of the wrapping method shown in FIGS. 34A-34C in which one or more reinforcing zones are formed in the first segment of tubular stretch film during wrapping (though they may be formed in the second segment of tubular stretch film). FIG. 35A shows a reinforcing zone R1 formed by the first segment of tubular stretch film F1 and circumscribing the inner zone IZ of the load L. FIG. 35B shows two reinforcing zones R1 and R2 formed by the first segment of tubular stretch film F1. Each reinforcing zone R1 and R2 circumscribes one of the outer zones OZ of the load L. FIG. 35C shows three reinforcing zones R1, R2, and R3 formed by the first segment of tubular stretch film F1. Each reinforcing zone R1 and R3 circumscribes one of the outer zones OZ of the load L, and the reinforcing zone R2 circumscribes the inner zone IZ of the load L.

Figure 36A:
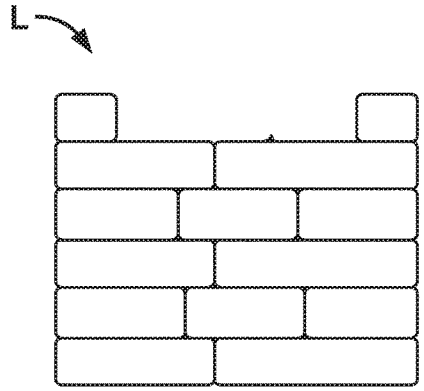
FIGS. 36A-36D are side views showing another example method of wrapping a load in two segments of tubular film in which the segments of tubular film are shown in cross-section.
Figure 36B:
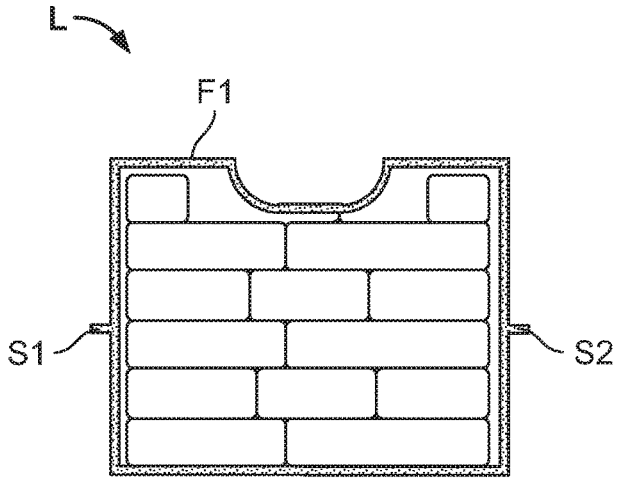
Figure 36C:
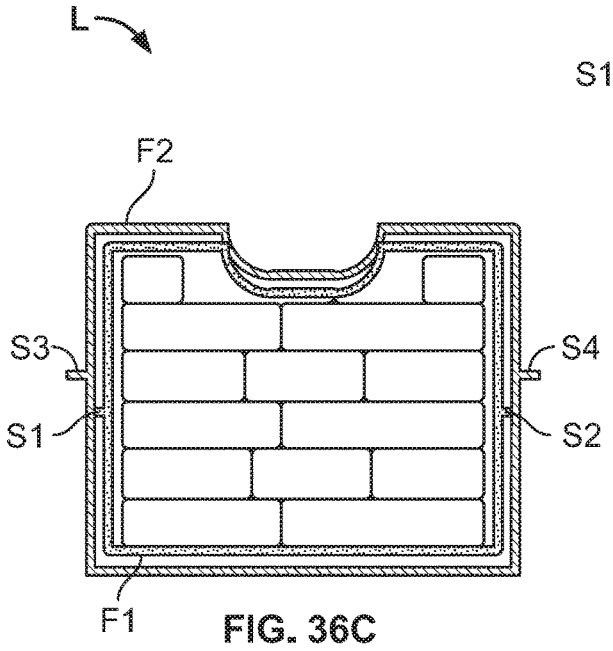
Figure 36D:
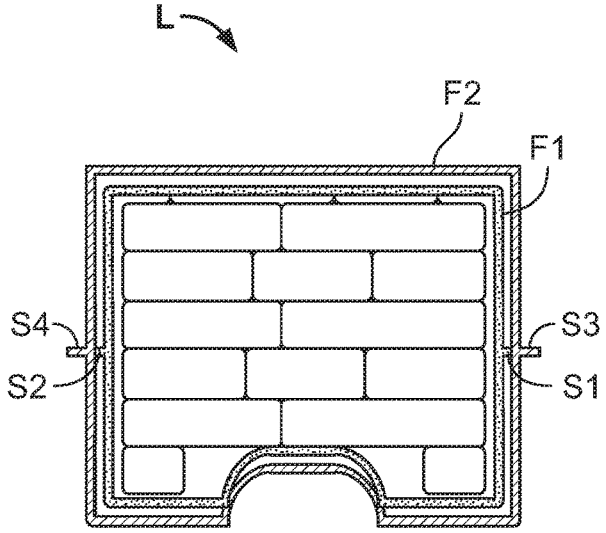

FIGS. 36A-36C show another method of wrapping the load L. As shown in FIG. 36B, with the load L in its first orientation, a first segment of tubular stretch film F1 is horizontally applied to the load L. The ends of the first segment of tubular stretch film F1 are sealed closed at seams S1 and S2. At this point all sides of the load L are enclosed in film. As shown in FIG. 36C, a second segment of tubular stretch film F2 is horizontally applied to the load L over the first segment of tubular stretch film F1. The ends of the second segment of tubular stretch film F2 are sealed closed at seams S3 and S4. As shown in FIG. 36D, the load L is then turned to its second orientation such that a forklift (or other suitable lifting device) can then transport the load L.

Figure 37A:
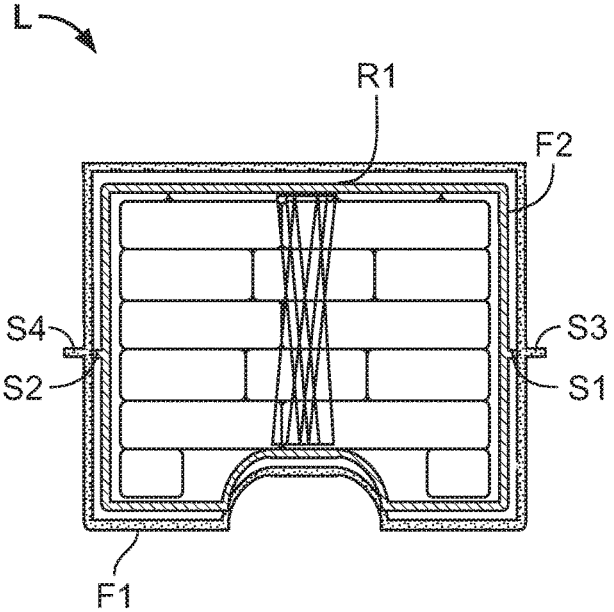
FIGS. 37A-37C are side views showing variations of the method shown in FIGS. 36A-36D in which one or more reinforced areas are formed in a segment of tubular film.
Figure 37B:
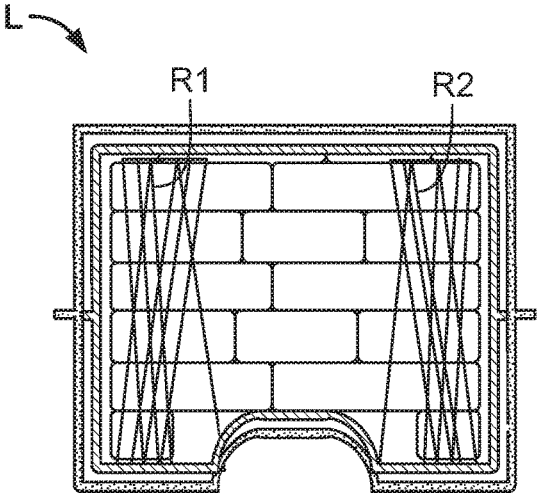
Figure 37C:
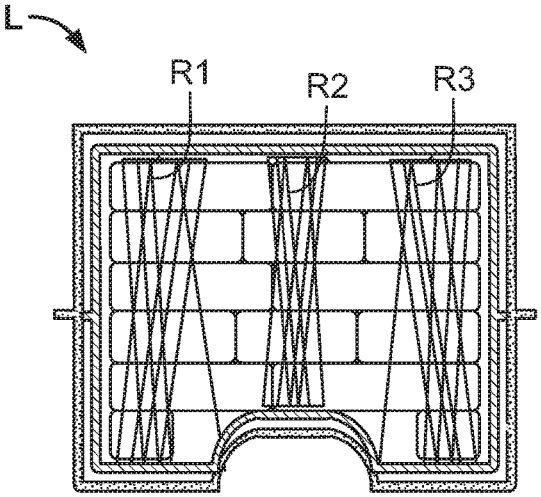

FIGS. 37A-37C show three variations of the wrapping method shown in FIGS. 36A-36C in which one or more reinforcing zones are formed in the first segment of tubular stretch film during wrapping (though they may be formed in the second segment of tubular stretch film). FIG. 37A shows a reinforcing zone R1 formed by the first segment of tubular stretch film F1 and circumscribing the inner zone IZ of the load L. FIG. 37B shows two reinforcing zones R1 and R2 formed by the first segment of tubular stretch film F1. Each reinforcing zone R1 and R2 circumscribes one of the outer zones OZ of the load L. FIG. 37C shows three reinforcing zones R1, R2, and R3 formed by the first segment of tubular stretch film F1. Each reinforcing zone R1 and R3 circumscribes one of the outer zones OZ of the load L, and the reinforcing zone R2 circumscribe the inner zone IZ of the load L.

Figure 38A:
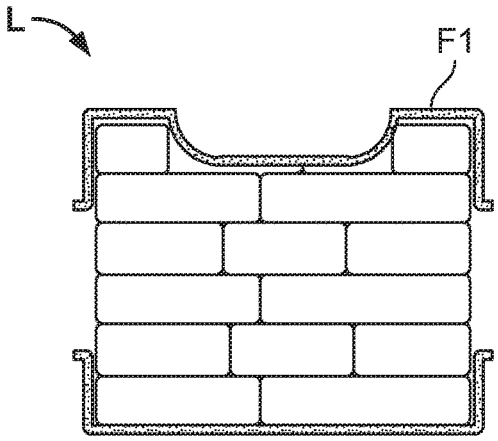
FIGS. 38A-38C are side views showing another example method of wrapping a load in two segments of tubular film in which the segments of tubular film are shown in cross-section.
Figure 38B:
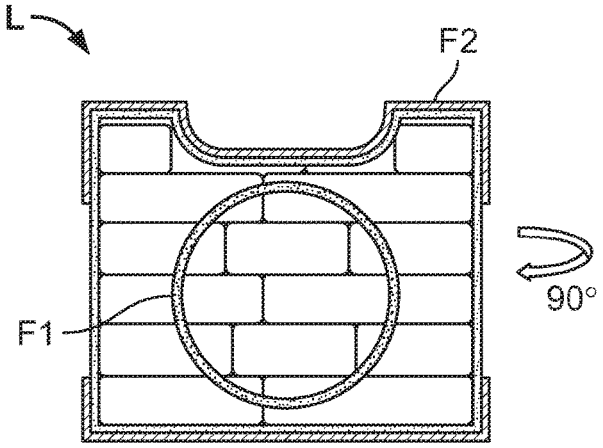
Figure 38C:
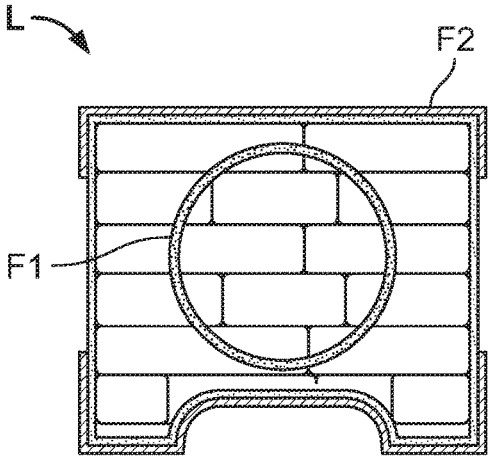

FIGS. 38A-38C show another method of wrapping the load L. As shown in FIG. 38A, with the load L in its first orientation, a first segment of tubular stretch film F1 is horizontally applied to the load L. The ends of the first segment of tubular stretch film F1 are not sealed closed. As shown in FIG. 38B, with the load L still in its first orientation the load L is rotated about a vertical axis and, afterwards, a second segment of tubular stretch film F2 is horizontally applied to the load L over the first segment of tubular stretch film F1. The ends of the second segment of tubular stretch film F2 are not sealed closed, but because the load L was rotated at this point all sides of the load L are enclosed in film. As shown in FIG. 38C, the (wrapped) load L is now turned to its second orientation such that a forklift (or other suitable lifting device) can transport the load L.

Figure 39A:
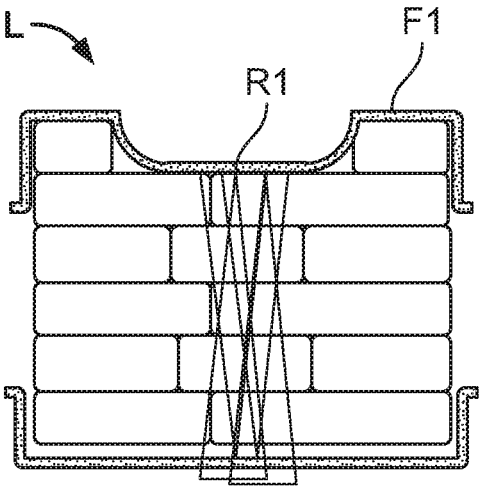
FIGS. 39A-39C are side views showing variations of the method shown in FIGS. 38A-38C in which one or more reinforced areas are formed in a segment of tubular film.
Figure 39B:
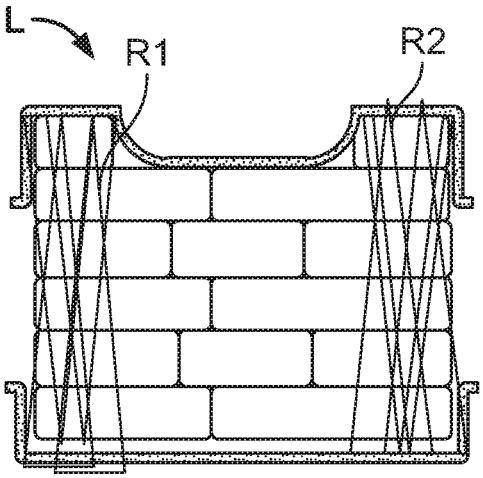
Figure 39C:
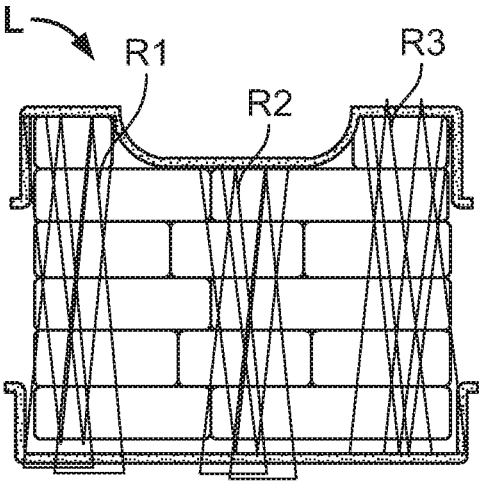

FIGS. 39A-39C show three variations of the wrapping method shown in FIGS. 38A-38C in which one or more reinforcing zones are formed in either the first or second segments of tubular stretch film during wrapping. FIG. 39A shows one reinforcing zone R1 formed by the first segment of tubular stretch film F1 (though it could be formed by the second segment of tubular stretch film F2) and circumscribing the inner zone IZ of the load L. FIG. 39B shows two reinforcing zones R1 and R2 formed by the first segment of tubular stretch film F1 (though one or both could be formed by the second segment of tubular stretch film F2). Each reinforcing zone R1 and R2 circumscribes one of the outer zones OZ of the load L. FIG. 39C shows three reinforcing zones R1, R2, and R3 formed by the first segment of tubular stretch film F1 (though one or more could be formed by the second segment of tubular stretch film F2). Each reinforcing zone R1 and R3 circumscribes one of the outer zones OZ of the load L, and the reinforcing zone R2 circumscribes the inner zone IZ of the load L.

Although not shown, in certain embodiments the load may be formed in its second orientation. In these example embodiments the processes proceed as described above, but the final turning step is not required because the load is already in its second orientation.

Although not shown, in embodiments in which the wrapping method includes both horizontal and vertical application of segments of tubular stretch film to the load, the vertical application may occur before the horizontal application.

The invention claimed is:

1. A method of wrapping a load with multiple segments of tubular stretch film, the method comprising:

applying, via a reefing-and-wrapping assembly, a first segment of tubular stretch film to the load by at least one of: (a) moving the first segment of tubular stretch film in a first direction relative to the load; and (b) moving the load in the first direction relative to the first segment of tubular stretch film; and applying, via the reefing-and-wrapping assembly, a second segment of tubular stretch film to the load by at least one of: (a) moving the second segment of tubular stretch film in a second direction relative to the load; and (b) moving the load in the second direction relative to the second segment of tubular stretch film, wherein the first direction and the second direction are different, wherein the first and second segments of tubular stretch film together enclose the load on all sides.

2. The method of claim 1, wherein the first direction comprises a first horizontal direction and wherein the second direction comprises a second horizontal direction.

3. The method of claim 2, wherein applying the second segment of tubular stretch film to the load comprises sealing opposing ends of the second segment of tubular stretch film closed such that the second segment of tubular stretch film encloses the load on all sides.

4. The method of claim 3, wherein applying the first segment of tubular stretch film to the load comprises sealing opposing ends of the first segment of tubular stretch film closed such that the first segment of tubular stretch film encloses the load on all sides.

5. The method of claim 3, further comprising applying the first segment of tubular stretch film to the load before applying the second segment of tubular stretch film to the load.

6. The method of claim 5, wherein applying the first segment of tubular stretch film to the load comprises applying the first segment of tubular stretch film to the load without sealing closed at least one end of the first segment of tubular stretch film.

7. The method of claim 2, further comprising rotating the load after applying the first segment of tubular stretch film to the load and before applying the second segment of tubular stretch film to the load.

8. The method of claim 7, further comprising rotating the load about 90 degrees about a generally vertical axis after applying the first segment of tubular stretch film to the load and before applying the second segment of tubular stretch film to the load.

9. The method of claim 7, wherein applying the first and second segments of tubular stretch film to the load comprise applying the first and second segments of tubular stretch film to the load without sealing closed at least one end of each of the first and second segments of tubular stretch film.

10. The method of claim 2, further comprising turning the load 180 degrees about a horizontal axis after applying at least one of the first and second segments of tubular stretch film to the load.

11. The method of claim 1, wherein the first direction comprises a horizontal direction and wherein the second direction comprises a vertical direction.

12. The method of claim 11, wherein applying the first segment of tubular stretch film to the load comprises sealing opposing ends of the first segment of tubular stretch film closed such that the first segment of tubular stretch film encloses the load on all sides.

13. The method of claim 12, wherein applying the second segment of tubular stretch film to the load comprises sealing at least one of the ends of the second segment of tubular stretch film closed.

14. The method of claim 12, wherein applying the second segment of tubular stretch film to the load comprises applying the second segment of tubular stretch film to the load without sealing closed the ends of the second segment of tubular stretch film.

15. The method of claim 11, wherein applying the first segment of tubular stretch film to the load comprises applying the first segment of tubular stretch film to the load without sealing closed at least one end of the first segment of tubular stretch film.

16. The method of claim 15, wherein applying the second segment of tubular stretch film to the load comprises sealing at least one of the ends of the second segment of tubular stretch film closed.

17. The method of claim 15, wherein applying the second segment of tubular stretch film to the load comprises applying the second segment of tubular stretch film to the load without sealing closed the ends of the second segment of tubular stretch film.

18. The method of claim 11, further comprising applying the first segment of tubular stretch film to the load before applying the second segment of tubular stretch film to the load.

19. The method of claim 11, wherein applying the first segment of tubular stretch film to the load comprises forming one or more reinforcing zones in the first segment of tubular stretch film, wherein the one or more reinforcing zones encircle the load.

20. The method of claim 19, wherein the load comprises multiple rows of components stacked atop one another, wherein one of the rows of components is of a different width than at least one of the other rows of components such that the load has an inner zone and two outer zones flanking the inner zone, wherein the inner zone has a height different than heights of the outer zones.

21. The method of claim 20, wherein forming the one or more reinforcing zones in the first segment of tubular stretch film comprises forming a first reinforcing zone that encircles the inner zone of the load.

22. The method of claim 20, wherein forming the one or more reinforcing zones in the first segment of tubular stretch film comprises forming a first reinforcing zone that encircles one of the outer zones of the load.

23. The method of claim 22, wherein forming the one or more reinforcing zones in the first segment of tubular stretch film comprises forming a second reinforcing zone that encircles the inner zone of the load.

24. The method of claim 23, wherein forming the one or more reinforcing zones in the first segment of tubular stretch film comprises forming a third reinforcing zone that encircles the other of the outer zones of the load.

25. The method of claim 24, wherein forming the one or more reinforcing zones comprises at least one of: (1) decreasing a movement speed of the load relative to the first segment of tubular stretch film; and (2) increasing a rate at which the first segment of tubular stretch film is unreefed from multiple reefing fingers onto the load.

26. A method of wrapping a load with multiple segments of tubular stretch film, the method comprising:

applying a first segment of tubular stretch film to the load, wherein applying the first segment of tubular stretch film to the load comprises forming one or more reinforcing zones in the first segment of tubular stretch film, wherein the one or more reinforcing zones encircle the load; and applying a second segment of tubular stretch film to the load, wherein the first and second segments of tubular stretch film together enclose the load on all sides.

27. The method of claim 26, wherein the load comprises multiple rows of components stacked atop one another, wherein one of the rows of components is of a different width than at least one of the other rows of components such that the load has an inner zone and two outer zones flanking the inner zone, wherein the inner zone has a height different than heights of the outer zones.

28. The method of claim 27, wherein forming the one or more reinforcing zones in the first segment of tubular stretch film comprises forming a first reinforcing zone that encircles the inner zone of the load.

29. The method of claim 27, wherein forming the one or more reinforcing zones in the first segment of tubular stretch film comprises forming a first reinforcing zone that encircles one of the outer zones of the load.

30. The method of claim 29, wherein forming the one or more reinforcing zones in the first segment of tubular stretch film comprises forming a second reinforcing zone that encircles the inner zone of the load.

31. The method of claim 30, wherein forming the one or more reinforcing zones in the first segment of tubular stretch film comprises forming a third reinforcing zone that encircles the other of the outer zones of the load.

32. The method of claim 26, wherein forming the one or more reinforcing zones comprises at least one of: (1) decreasing a movement speed of the load relative to the first segment of tubular stretch film; and (2) increasing a rate at which the first segment of tubular stretch film is unreefed from multiple reefing fingers onto the load.

* * * * *